US007157218B2

(12) United States Patent
Suzuki

(10) Patent No.: US 7,157,218 B2
(45) Date of Patent: Jan. 2, 2007

(54) PHOTOTHERMOGRAPHIC MATERIAL

(75) Inventor: Keiichi Suzuki, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 10/747,411

(22) Filed: Dec. 30, 2003

(65) Prior Publication Data

US 2004/0161714 A1 Aug. 19, 2004

(30) Foreign Application Priority Data

Jan. 6, 2003 (JP) ..... 2003-000315

(51) Int. Cl.
*G03C 1/76* (2006.01)
*G03C 1/047* (2006.01)
*G03C 1/498* (2006.01)

(52) U.S. Cl. ..... 430/523; 430/531; 430/539; 430/621; 430/631; 430/639; 430/640; 430/935

(58) Field of Classification Search ..... 430/619, 430/523, 531, 621, 631, 639, 640, 53; 530/539, 530/935
See application file for complete search history.

(56) References Cited

U.S. PATENT DOCUMENTS 4,113,854 A * 9/1978 Andrews et al. ..... 424/78.05
4,332,889 A * 6/1982 Siga et al. ..... 430/583
4,898,810 A * 2/1990 Eggert et al. ..... 430/523
6,143,488 A * 11/2000 Uytterhoeven et al. ..... 430/619
6,261,754 B1 * 7/2001 Ishigaki et al. ..... 430/523
6,582,898 B1 * 6/2003 Morita ..... 430/619
6,821,720 B1 * 11/2004 Iwado ..... 430/523
2001/0051319 A1 * 12/2001 Oya et al. ..... 430/611

FOREIGN PATENT DOCUMENTS

EP 1310825 A1 * 5/2003

* cited by examiner

*Primary Examiner*—Thorl Chea
(74) *Attorney, Agent, or Firm*—Margaret A. Burke; Sheldon J. Moss

(57) ABSTRACT

A photothermographic material contains a support having thereon an image forming layer containing a photosensitive silver halide, a non-photosensitive organic silver salt, a reducing agent and a binder, and a non-photosensitive outermost layer on a side of the support where the image forming layer is provided, The photosensitive silver halide contains silver iodide in an amount of from 40 to 100% by mole, and a binder contained in the outermost layer contains at least one of a latex polymer and a water soluble polymer that is not derived from an animal protein in an amount of 50% by mass or more.

17 Claims, No Drawings

PHOTOTHERMOGRAPHIC MATERIAL

CROSS-REFERENCE TO RELATED APPLICATIONS

This application claims priority to Japanese patent application number 2003-315 filed Jan. 6, 2003, the disclosure of which is incorporated herein by reference.

BACKGROUND OF THE INVENTION

1. Field of the Invention

The present invention relates to a photothermographic material, and in particular, it relates to a photothermographic material using a silver halide emulsion having a high silver iodide content and to a photothermographic material that is significantly improved in sensitivity, is low in fogging, and is excellent in storage stability of an image after development.

2. Description of the Related Art

In recent years, a dry development process has been sought in the medical field and the printing and prepress field from the standpoint of environment protection and space saving. In these fields, digitalizatio has progressed, and sysytems in which image information is imported to a computer, stored, and then processed have widely spread. Such systems are advantageous since image information can be communicated to a desired location and then output to a photosensitive material, which is developed to form an image. The photosensitive material is required to have such characteristics that recordation can be attained by exposure with laser light having a high illuminance to form a clear black image having high resolution and sharpness. For use as the digital imaging recording material, various kinds of hardcopy systems utilizing pigments and dyes, such as an ink-jet printer and an electrophotographic system, have been commercially available as a general image forming system. However, they are insufficient in image quality (such as sharpness, graininess, gradation and color tone) required for diagnostic medical images and in recording rate (sensitivity).

A thermal image forming system utilizing an organic silver salt has been described in the literature. In particular, a photothermographic material generally has an image forming layer containing a photosensitive silver halide, a reducing agent, a reducing silver salt (such as an organic silver salt), and depending on necessity, a color toning agent for controlling the color tone of silver, which are dispersed in the matrix of a binder.

After subjecting a photothermographic material to imagewise exposure, it is heated to a high temperature (for example, 80° C. or more) to form a black silver image through a redox reaction between the silver halide or the reducing silver salt (which functions as an oxidizing agent) and the reducing agent. The redox reaction is accelerated by catalytic action of a latent image of a silver halide formed through exposure. As a result, a black silver image is formed on an exposed area. As a practical application for a medical image forming system, FUJI MEDICAL DRY IMAGER FM-DP L has been commercially available.

The image forming system utilizing an organic silver salt has a significant problem in storage stability of an image, particularly a tendancy to cause a printout upon irradiation with light, due to the absence of a fixing process. As a measure for improving a printout, U.S. Pat. No. 6,143,488 and EP-A 0,922,995 disclose methods of utilizing silver iodide formed by converting an organic silver salt. Thus, a printout has been improved by using silver iodide.

However, the methods thus disclosed, where an organic silver salt is converted with iodine, cannot provide sufficient sensitivity, and thus it is difficult to constitute a practical system. Photosensitive materials utilizing silver iodide are also described in International Publication Nos. 97/48014 and 97/48015, U.S. Pat. No. 6,165,705, JP-A No. 8-297345 and Japanese Patent No. 2,785,129, but they cannot attain sufficient sensitivity and fogging property and thus cannot be practically used as a photosensitive material for laser exposure.

The utilization of silver iodide brings about other problems in addition to that in sensitivity. For example, there are such problems specific to silver iodide in that the gradation becomes high contrast, and the in that there is a tendancy for sensitivity to be lowered prior to use due to deteriorated storage stability.

SUMMARY OF THE INVENTION

An object of the invention is to provide a photothermographic material that results in suppressed fogging and printout and is excellent in storage stability of an image against stain, by using a photothermographic material having a high silver iodide content.

The aforementioned and other objects of the invention have been attained by the following aspect of the invention.

The invention relates to, as a first aspect, a photothermographic material containing a support having thereon an image forming layer containing a photosensitive silver halide, a non-photosensitive organic silver salt, a reducing agent and a binder, and a non-photosensitive outermost layer on a side of the support where the image forming layer is provided, the photosensitive silver halide containing silver iodide in an amount of from 40 to 100% by mole, and a binder contained in the outermost layer containing at least one of a latex polymer and a water soluble polymer that is not derived from an animal protein in an amount of 50% by mass or more.

DETAILED DESCRIPTION OF THE INVENTION

A photothermographic material of the invention contains a support having thereon an image forming layer containing a photosensitive silver halide, a non-photosensitive organic silver salt, a reducing agent and a binder, and a non-photosensitive outermost layer on a side of the support where the image forming layer is provided. In the photothermographic material, the photosensitive silver halide contains silver iodide in an amount of from 40 to 100% by mole, and a binder contained in the outermost layer contains at least one of a latex polymer and a water soluble polymer that is not derived from an animal protein in an amount of 50% by mass or more. The photothermographic material described is designated as a first aspect of the invention.

As other aspects of the invention, second to nineteenth aspects will be described below.

2. A photothermographic material according to the first aspect, wherein the photothermographic material further contains at least one non-photosensitive layer adjacent to the outermost layer.

3. A photothermographic material according to the second aspect, wherein the layer adjacent to the outermost layer contains a binder that gels upon a decrease in temperature of the binder.

4. A photothermographic material according to the first aspect, wherein a binder contained in the layer adjacent to the outermost layer contains a water soluble polymer derived from an animal protein in an amount of 50% by mass or more.

5. A photothermographic material according to the fourth aspect, wherein the water soluble polymer derived from an animal protein is gelatin.

6. A photothermographic material according to the third aspect, wherein the layer adjacent to the outermost layer contains a gelation agent.

7. A photothermographic material according to the sixth aspect, wherein the gelation agent is at least one selected from the group consisting of agar, κ-carrageenan, ι-carrageenan, alginic acid, an alginate salt, agarose, furcelleran, gellan gum, glucono-δ-lactone, azotobacter vinelandii gum, xanthan gum, pectin, guar gum, locust bean gum, tara gum, cassia gum, glucomannan, tragant gum, karaya gum, pullulan, gum arabic, arabinogalactan, dextran, a carboxymethylcellulose sodium salt, methylcellulose, cyalume seed gum, starch, chitin, chitosan and curdlan.

8. A photothermographic material according to the seventh aspect, wherein the gelation agent is κ-carrageenan.

9. A photothermographic material according to the second aspect, wherein a layer adjacent to the outermost layer contains a polymer latex.

10. A photothermographic material according to the second aspect, wherein a layer adjacent to the outermost layer contains a water soluble polymer that is not derived from an animal protein.

11. A photothermographic material according to the first aspect, wherein the water soluble polymer that is not derived from an animal protein is polyvinyl alcohol.

12. A photothermographic material according to the sixth aspect, further containing a gelation accelerator.

13. A photothermographic material according to the twelfth aspect, wherein the gelation accelerator is contained in a layer that is not in direct contact with a layer containing the gelation agent.

14. A photothermographic material according to the twelfth aspect, wherein the gelation accelerator is at least one selected from the group consisting of salts of potassium, calcium, magnesium, zinc, cobalt and nickel.

15. A photothermographic material according to the first aspect, wherein one of layers on the side of the support where the outermost layer is provided contains a fluorine compound having a fluoroalkyl group having at least 2 carbon atoms and no more than 13 fluorine atoms.

16. A photothermographic material according to the first aspect, wherein one of layers on the side of the support where the outermost layer is provided contains a fluorine compound having a fluoroalkyl group at least 2 carbon atoms and no more than 12 fluorine atoms.

17. A photothermographic material according to the second aspect, wherein at least one of the outermost layer and a layer adjacent to the outermost layer contains a matting agent.

18. A photothermographic material according to the sixteenth aspect, wherein the matting agent has been dispersed with a surface active agent.

19. A photothermographic material according to the sixteenth aspect, wherein the matting agent has been dispersed with a water soluble polymer that is not derived from an animal protein.

20. A photothermographic material according to the first aspect, wherein the non-photosensitive layer and the image forming layer are formed by simultaneous multiple layer coating.

As described as the first aspect, the photothermographic material of the invention includes a support having thereon an image forming layer containing a photosensitive silver halide, a non-photosensitive organic silver salt, a reducing agent and a binder, and a non-photosensitive outermost layer on a side of the support where the image forming layer is provided, in which the photosensitive silver halide contains silver iodide in an amount of from 40 to 100% by mole, and a binder contained in the outermost layer contains at least one of a latex polymer and a water soluble polymer that is not derived from an animal protein in an amount of 50% by mass or more.

Pursuant to the invention, image storage stability is improved against stain image (salt from being touched by fingers) after forming an image by using a binder containing at least one of a latex polymer and a water soluble polymer that is not derived from an animal protein in an amount of 50% by mass or more in the outermost layer, and thus the first aspect of the invention has been completed.

A photothermographic material having a high silver iodide content has such an advantage that the addition amount of an antifoggant may be small, but it has been found that a stain mark is discolored upon storage of an image due to the small amount of an antifoggant. This is a problem that is unexpected from studies on photothermographic materials containing silver bromide or silver iodobromide.

It has been found that the use of a binder containing at least one of a latex polymer and a water soluble polymer that is not derived from an animal protein in an amount of 50% by mass or more in the outermost layer is effective to solve the problem. Modification of the binder exerts great influence on other layers adjacent to the outermost layer (such as the image forming layer), and thus, selecting of a material that is excellent in anti-staining property brings about deterioration of the output image of the photothermographic material. Therefore, it is necessary that the binder of the outermost layer is selected taking the output image into consideration.

A polymer that is a water soluble polymer that is not derived from an animal (such as polyvinyl alcohol) and a hydrophobic polymer have no setting property. The setting property refers to the tendency of polymer gels to lose flowability upon a decrease in temperature. By utilizing such tendency, flowability of a heated coating composition coated on a support can be suppressed by cooling, whereby unevenness due to blowing air during drying is unlikely to occur and a uniform surface property is obtained. Therefore, uniform surface property without unevenness upon coating is significantly difficult to attain in the case where a polymer having no setting property is used in the outermost layer. As a measure for solving the problem, the second to fourteenth aspects of the invention have been developed by using a binder having a setting property in the layer adjacent to the outermost layer.

It has been further found that in the case where the latex layer and the layer containing gelatin which has a setting property are provided adjacent to each other, a hydrophobic polymer of the latex is aggregated to cause adhesion failure upon thermal development. It is presumed that the phenomenon is caused in such a manner that in the case where the gelatin-containing layer having a low pH and the latex layer which is a neutral are in contact with each other, the pH of the latex layer is lowered, whereby the hydrophobic polymer in the latex is aggregated. Therefore, it has been found that the coated surface property is deteriorated particularly in the case where the latex-containing layer and the gelatin-containing layer are disposed directly adjacent to each other, and thus it has been found that a charge effect of a fluorine compound having a fluoroalkyl group having at least 2 carbon atoms and no more than 13 (or 12) fluorine atoms is significantly effective for suppressing aggregation of the hydrophobic polymer (the fifteenth and sixteenth aspects of the invention).

The phenomenon also occurs due to the same reason in the case where a layer containing a matting agent and the gelatin-containing layer are disposed in direct contact with each other, and thus it has been found that a surface active agent is effective for dispersing a matting agent (the eighteenth aspect).

It has also been found that, in order to suppress aggregation of a matting agent, it is effective if the matting agent has been dispersed with a water soluble polymer that is not derived from an animal protein (the nineteenth aspect of the invention).

The invention will be described in detail below.

The photothermographic material of the invention is not particularly limited as far as the photosensitive silver halide contains silver iodide in an amount of from 40 to 100% by mole, and the outermost layer contains at least one of a latex polymer and a water soluble polymer that is not derived from an animal protein in an amount of 50% by mass or more.

The layer structure of the photothermographic material of the invention will first be described, and then the constitutional components of the respective layers will be described.

1. Layer Structure

The photothermographic material of the invention has at least one image forming layer and has an outermost layer on a side of the support where the image forming layer is provided.

A non-photosensitive layer can be generally classified, from the standpoint of arrangement thereof, into (a) a surface protective layer provided on an image forming layer (on the far side with respect to a support), (b) an intermediate layer provided between plural image forming layers or between an image forming layer and a surface protective layer, (c) an undercoating layer provided between an image forming layer and a support, and (d) a back layer provided on the side opposite to an image forming layer.

In the invention, one of the characteristic features resides in the non-photosensitive layer classified into the item (a). That is, the non-photosensitive outermost layer is provided at such a position that is on the same side as the image forming layer and is farthest from the support (i.e., the position farther from the support than the image forming layer). The binder contained in the outermost layer contains at least one of a latex polymer and a water soluble polymer that is not derived from an animal protein in an amount of 50% by mass or more.

In the invention, another surface protective layer (a), an intermediate layer (b), an undercoating layer (c) and a back layer (d) may also be provided in addition to the outermost layer. The layers each may be a single layer or may have a multilayer structure.

A layer functioning as an optical filter may be provided as the non-photosensitive layer classified into the item (a) or (b). An antihalation layer may be provided as the layer classified into the item (c) or (d).

The photothermographic material of the invention may be either a single sided type, where an image forming layer is provided on only one side of a support, or a double sided type, where image forming layers are provided on both sides of a support. A single sided type is preferred, and in this case, it is preferred that a back layer is provided on the opposite side of the support to the image forming layer (hereinafter, referred to a back surface). The same binder may be used as a binder of an outermost layer constituting the back layer, but there is no particular limitation.

The image forming layer in the invention is constituted with one or more layer on the support. In the case where the image forming layer is constituted with only one layer, the image forming layer contains an organic silver salt, a photosensitive silver halide, a reducing agent and a binder, and depending on necessity, may contain additional components, such as a color toning agent, a coating aid and other auxiliary agents. In the case where the image forming layer is constituted with two or more layers, a first image forming layer (which is generally a layer adjacent to the support) contains an organic silver salt and a photosensitive silver salt, and a second image forming layer or both of the layers contain the other components. In the constitution of a multi-color photothermographic material, the combinations of two layers may be contained for the respective colors, or in alternative, all the components may be contained in one layer as described in U.S. Pat. No. 4,708,928. In the case where a multi-dye and multi-color photothermographic material, non-functional barrier layers are provided among the respective emulsion layers to maintain them separately.

It is preferred that a binder of a layer adjacent to the outermost layer has a setting property. That is, the coated surface property is further improved by using a binder that gels upon decreasing temperature in the layer adjacent to the outermost layer. The binder that gels upon decreasing temperature may be a water soluble polymer that is derived from an animal protein in an amount of 50% by mass or more, a water soluble polymer that is not derived from an animal protein or a hydrophobic polymer, to which a gelation agent is added. The layer adjacent to the outermost layer may be either an image forming layer or a non-photosensitive layer.

2. Constitutional Components of Layers

[Description of Water Soluble Polymer not Derived from Animal Protein]

The water soluble polymer that is not derived from an animal protein in the invention includes a natural polymer (such as a polysaccharide series, a microorganism series and an animal series) other than an animal protein, such as gelatin, a semisynthetic polymer (such as a cellulose series, a starch series and an alginic acid series), and a synthetic polymer (such as vinyl series and other series), and synthetic polymers, such as polyvinyl alcohol, and natural and semi-synthetic polymers, such as those derived from vegetables, such as cellulose, which will be described later, are encompassed. It is preferably a polyvinyl alcohol compound and an acrylic acid-vinyl alcohol copolymer. The water soluble polymer not derived from an animal protein is used as a binder of the outermost layer in the invention. The water soluble polymer that is not derived from an animal protein may also be used in a layer adjacent to the outermost layer, but since it does not have a setting property, it is preferred that a gelation agent is used in combination therewith upon using the water soluble polymer that is not derived from an animal protein in a layer adjacent to the outermost layer.

(1) Polyvinyl Alcohol Compound

The water soluble polymer that is not derived from an animal protein in the invention is preferably a polyvinyl alcohol compound.

Examples of the polyvinyl alcohol (PVA) that is preferably used in the invention include those described below, which have various saponification degree, polymerization degree, neutralization degree, include various modified products and copolymers with various kinds of monomers.

Examples of a total saponification product include PVA-105 (polyvinyl alcohol (PVA) content: 94.0% by mass or more, saponification degree: 98.5±0.5% by mole, sodium acetate content: 1.5% by mass or less, volatile matter content: 5.0% by mass or less, viscosity (4% by mass at 20° C.): 5.6±0.4 cps), PVA-110 (PVA content: 94.0% by mass, saponification degree: 98.5±0.5% by mole, sodium acetate content: 1.5% by mass, volatile matter content: 5.0% by mass, viscosity (4% by mass at 20° C.): 11.0±0.8 cps), PVA-117 (PVA content: 94.0% by mass, saponification degree: 98.5±0.5% by mole, sodium acetate content: 1.0% by mass, volatile matter content: 5.0% by mass, viscosity (4% by mass at 20° C.): 28.0±3.0 cps), PVA-117H (PVA content: 93.5% by mass, saponification degree: 99.6±0.3% by mole, sodium acetate content: 1.85% by mass, volatile matter content: 5.0% by mass, viscosity (4% by mass at 20° C.): 29.0±3.0 cps), PVA-120 (PVA content: 94.0% by mass, saponification degree: 98.5±0.5% by mole, sodium acetate content: 1.0% by mass, volatile matter content: 5.0% by mass, viscosity (4% by mass at 20° C.): 39.5±4.5 cps), PVA-124 (PVA content: 94.0% by mass, saponification degree: 98.5±0.5% by mole, sodium acetate content: 1.0% by mass, volatile matter content: 5.0% by mass, viscosity (4% by mass at 20° C.): 60.0±6.0 cps), PVA-124H (PVA content: 93.5% by mass, saponification degree: 99.6±0.3% by mole, sodium acetate content: 1.85% by mass, volatile matter content: 5.0% by mass, viscosity (4% by mass at 20° C.): 61.0±6.0 cps), PVA-CS (PVA content: 94.0% by mass, saponification degree: 97.5±0.5% by mole, sodium acetate content: 1.0% by mass, volatile matter content: 5.0% by mass, viscosity (4% by mass at 20° C.): 27.5±3.0 cps), PVA-CST (PVA content: 94.0% by mass, saponification degree: 96.0±0.5% by mole, sodium acetate content: 1.0% by mass, volatile matter content: 5.0% by mass, viscosity (4% by mass at 20° C.): 27.0±3.0 cps), and PVA-HC (PVA content: 90.0% by mass, saponification degree: 99.85% by mole or more, sodium acetate content: 2.5% by mass, volatile matter content: 8.5% by mass, viscosity (4% by mass at 20° C.): 25.0±3.5 cps), which are all trade names produced by Kuraray Co., Ltd.

Examples of a partial saponification product include PVA-203 (PVA content: 94.0% by mass, saponification degree: 88.0±1.5% by mole, sodium acetate content: 1.0% by mass, volatile matter content: 5.0% by mass, viscosity (4% by mass at 20° C.): 3.4±0.2 cps), PVA-204 (PVA content: 94.0% by mass, saponification degree: 88.0±1.5% by mole, sodium acetate content: 1.0% by mass, volatile matter content: 5.0% by mass, viscosity (4% by mass at 20° C.): 3.9±0.3 cps), PVA-205 (PVA content: 94.0% by mass, saponification degree: 88.0±1.5% by mole, sodium acetate content: 1.0% by mass, volatile matter content: 5.0% by mass, viscosity (4% by mass at 20° C.): 5.0±0.4 cps), PVA-210 (PVA content: 94.0% by mass, saponification degree: 88.0±1.0% by mole, sodium acetate content: 1.0% by mass, volatile matter content: 5.0% by mass, viscosity (4% by mass at 20° C.): 9.0±1.0 cps), PVA-217 (PVA content: 94.0% by mass, saponification degree: 88.0±1.0% by mole, sodium acetate content: 1.0% by mass, volatile matter content: 5.0% by mass, viscosity (4% by mass at 20° C.): 22.5±2.0 cps), PVA-220 (PVA content: 94.0% by mass, saponification degree: 88.0±1.0% by mole, sodium acetate content: 1.0% by mass, volatile matter content: 5.0% by mass, viscosity (4% by mass at 20° C.): 30.0±3.0 cps), PVA-224 (PVA content: 94.0% by mass, saponification degree: 88.0. ±1.5% by mole, sodium acetate content: 1.0% by mass, volatile matter content: 5.0% by mass, viscosity (4% by mass at 20° C.): 44.0±4.0 cps), PVA-228 (PVA content: 94.0% by mass, saponification degree: 88.0±1.5% by mole, sodium acetate content: 1.0% by mass, volatile matter content: 5.0% by mass, viscosity (4% by mass at 20° C.): 65.0±5.0 cps), PVA-235 (PVA content: 94.0% by mass, saponification degree: 88.0±1.5% by mole, sodium acetate content: 1.0% by mass, volatile matter content: 5.0% by mass, viscosity (4% by mass at 20° C.): 95.0±15.0 cps), PVA-217EE (PVA content: 94.0% by mass, saponification degree: 88.0±1.0% by mole, sodium acetate content: 1.0% by mass, volatile matter content: 5.0% by mass, viscosity (4% by mass at 20° C.): 23.0±3.0 cps), PVA-217E (PVA content: 94.0% by mass, saponification degree: 88.0±1.0% by mole, sodium acetate content: 1.0% by mass, volatile matter content: 5.0% by mass, viscosity (4% by mass at 20° C.): 23.0±3.0 cps), PVA-220E (PVA content: 94.0% by mass, saponification degree: 88.0±1.0% by mole, sodium acetate content: 1.0% by mass, volatile matter content: 5.0% by mass, viscosity (4% by mass at 20° C.): 31.0±4.0 cps), PVA-224E (PVA content: 94.0% by mass, saponification degree: 88.0±1.0% by mole, sodium acetate content: 1.0% by mass, volatile matter content: 5.0% by mass, viscosity (4% by mass at 20° C.): 45.0±5.0 cps), PVA-403 (PVA content: 94.0% by mass, saponification degree: 80.0±1.5% by mole, sodium acetate content: 1.0% by mass, volatile matter content: 5.0% by mass, viscosity (4% by mass at 20° C.): 3.1±0.3 cps), PVA-405 (PVA content: 94.0% by mass, saponification degree: 81.5±1.5% by mole, sodium acetate content: 1.0% by mass, volatile matter content: 5.0% by mass, viscosity (4% by mass at 20° C.): 4.8±0.4 cps), PVA-420 (PVA content: 94.0% by mass, saponification degree: 79.5±1.5% by mole, sodium acetate content: 1.0% by mass, volatile matter content: 5.0% by mass), PVA-613 (PVA content: 94.0% by mass, saponification degree: 93.5±1.0% by mole, sodium acetate content: 1.0% by mass, volatile matter content: 5.0% by mass, viscosity (4% by mass at 20° C.): 16.5±2.0 cps), and L-8 (PVA content: 96.0% by mass, saponification degree: 71.0±1.5% by mole, sodium acetate content: 1.0% by mass (ash content), volatile matter content: 3.0% by mass, viscosity (4% by mass at 20° C.): 5.4±0.4 cps), which are all trade names produced by Kuraray Co., Ltd.

The aforementioned measurement values are obtained according to JIS K6726-1977.

Examples of the modified polyvinyl alcohol include a cation-modified compound, an anion-modified compound, a compound modified with an —SH compound, a compound modified with an alkylthio compound, and a compound modified with a silanol compound. Modified polyvinyl alcohol described in Poval, by K. Nagano, et al., published by Kobunshi Kankokai Co., Ltd. may also be used.

Examples of the modified polyvinyl alcohol (modified PVA) include C-118, C-318, C-318-2A and C-506 as a C-POLYMER, which are all trade names produced by Kuraray Co., Ltd., HL-12E and HL-1203 as a HL-POLYMER, which are all trade names produced by Kuraray Co., Ltd., HM-03 and HM-N-03 as an HN-POLYMER, which are all trade names produced by Kuraray Co., Ltd., KL-118, KL-318, KL-506, KM-118T and KM-618 as a K-POLY- MER, which are all trade names produced by Kuraray Co., Ltd., M-115 as an M-POLYMER, which is a trade name produced by Kuraray Co., Ltd., MP-102, MP-202 and MP-203 as an MP-POLYMER, which are all trade names produced by Kuraray Co., Ltd., MPK-1, MPK-2, MPK-3, MPK-4, MPK-5 and MPK-6 as an MPK-POLYMER, which are all trade names produced by Kuraray Co., Ltd., R-1130, R-2105 and R-2130 as an R-POLYMER, which are all trade names produced by Kuraray Co., Ltd., and V-2250 as a V-POLYMER, which is a trade name produced by Kuraray Co., Ltd.

Polyvinyl alcohol can be controlled in viscosity and can be stabilized in viscosity with a slight amount of a solvent or an inorganic salt added to an aqueous solution thereof. Details thereof are described in Poval, p. 144 to 154, by K. Nagano, et al., published by Kobunshi Kankokai Co., Ltd. As a representative example thereof, it is preferred that the coated surface property can be improved by adding boric acid. The addition amount of boric acid is preferably from 0.01 to 40% by mass based on the amount of polyvinyl alcohol.

Polyvinyl alcohol is increased in crystallization degree through a heat treatment and thus is improved in water resistance, as described in Poval, by K. Nagano, et al., published by Kobunshi Kankokai Co., Ltd. In the invention, polyvinyl alcohol can be heated upon drying a coated layer or additionally heated after drying to improve the water resistance, and therefore, it is preferred among water soluble polymers in the invention.

In order that the water resistance is further improved, a water resisting agent described in Poval, p. 256 to 261, by K. Nagano, et al., published by Kobunshi Kankokai Co., Ltd. is preferably added. Examples thereof include an aldehyde compound, a methylol compound (such as N-methylolurea and N-methylolmelamine), an activated vinyl compound (such as divinylsulfone and a derivative thereof), bis(β-hydroxyethylsulfone), an epoxy compound (such as epichlorohydrin and a derivative thereof), a polyvalent carboxylic acid (such as a dicarboxylic acid, and polyacrylic acid, a methyl vinyl ether-maleic acid copolymer and an isobutylene-maleic anhydride copolymer as polycarboxylic acids), a diisocyanate compound, and an inorganic crosslinking agent (such as compounds containing Cu, B, Al, Ti, Zr, Sn, V and Cr).

Preferred examples of the water resisting agent used in the invention include an inorganic crosslinking agent, and boric acid and a derivative thereof are preferred among these, with boric acid being particularly preferred. Specific examples of a boric acid derivative are described below.

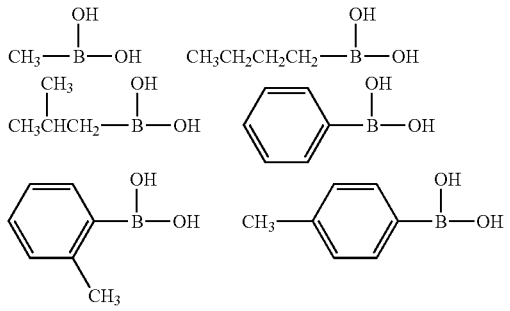

-continued

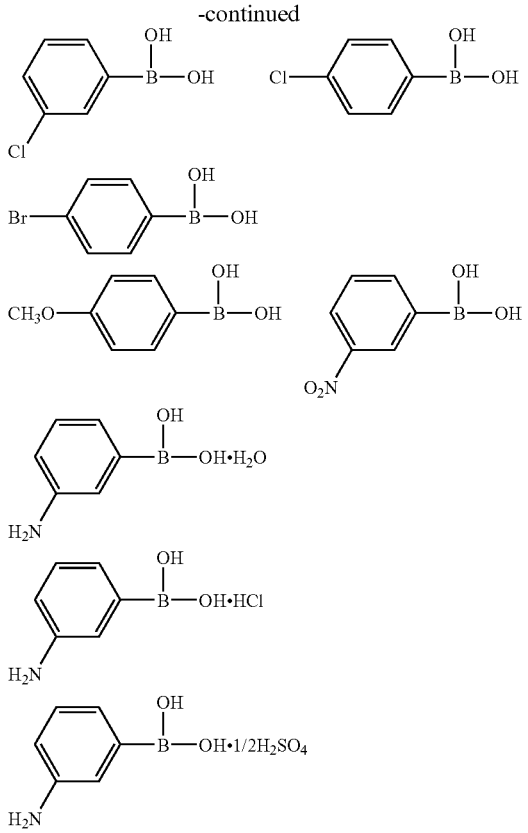

The addition amount of the water resisting agent is preferably adjusted within a range of from 0.01 to 40% by mass based on the amount of the polyvinyl alcohol.

(2) Other Water Soluble Polymers that is not Derived from Animal Protein

Examples of the water soluble polymer that is not derived from an animal protein include those described below, in addition to the polyvinyl alcohol compounds having been described. Among these, polymers that can be a gelation agent, which will be described later, are included.

Specific examples thereof include a vegetable polysaccharide, such as gum arabic, κ-carrageenan, ι-carrageenan, λ-carrageenan, guar gum (such as SUPERCOL, produced by Squalon), locust bean gum, pectin, tragant, corn starch (such as PURITY-21, produced by National Starch & Chemical Co.) and phosphorylated starch (such as NATIONAL 78-1898, produced by National Starch & Chemical Co.).

Examples of the microorganism polysaccharide include xanthan gum (such as KELTROL T, produced by CP Kelco) and dextrin (such as NADEX 360, produced by National Starch & Chemical Co.), and examples of the animal polysaccharide include sodium chondroitin sulfate (such as CROMOIST CS, produced by Croda International).

Examples of the cellulose series polymer include ethylcellulose (such as CELLOFAS WLD, produced by I.C.I.), carboxymethylcellulose (such as CMC, produced by Daicel Chemical Industries, Ltd.), hydroxyethylcellulose (such as HEC, produced by Daicel Chemical Industries, Ltd.), hydroxypropylcellulose (such as KLUCEL, produced by Aqualon), methylcellulose (such as VISCONTRAN, produced by Henkel), nitrocellulose (such as ISOPROPYL WET, produced by Hercules) and cationized cellulose (such as CRODACEL QM, produced by Croda). Examples of the alginic acid series include sodium alginate (such as KELTONE, produced by Kelco) and propylene glycol alginate, and examples of other series include cationized guar gum (such as HI-CARE 1000, produced by Alcolac) and sodium hyaluronate (such as HYALURE, produced by Lifecare Biomedial).

Other examples include agar, furcelleran, guar gum, karaya gum, larch gum, guar seed gum, cyalume seed gum, tamarind gum, gellan gum and tara gum. Among these, one having high water solubility is preferred, and one forming such an aqueous solution that exerts sol-gel transformation through temperature change within a temperature range of from 5 to 95° C. in 24 hours is preferably used.

Examples of the synthetic polymer include an acrylic series, such as sodium polyacrylic acid, a polyacrylic acid copolymer, polyacrylamide and a polyacrylamide copolymer, a vinyl series, such as polyvinylpyrrolidone and a polyvinylpyrrolidone copolymer, and other series, such as polyethylene glycol, polypropylene glycol, polyvinyl ether, polyethyleneimine, polystyrenesulfonic acid and a copolymer thereof, polyvinylsulfanic acid and a copolymer thereof, polyacrylic acid and a copolymer thereof, acrylic acid or a copolymer thereof, a maleic acid copolymer, a maleic acid monoester copolymer, and acryloylmethylpropanesulfonic acid and a copolymer thereof.

A high water absorbing polymer described in U.S. Pat. No. 4,960,681 and JP-A No. 62-245260, i.e., a homopolymer of a vinyl monomer having —COOM or —$SO_3M$ (wherein M represents a hydrogen atom or an alkali metal), a copolymer of the vinyl monomers and a copolymer of the vinyl monomer with another monomer (such as sodium methacrylate, ammonium methacrylate and SUMIKAGEL L-5H, produced by Sumitomo Chemical Co., Ltd.), may also be used.

What is particularly preferably used in the invention among these water soluble polymers is SUMIKAGEL L-5H, produced by Sumitomo Chemical Co., Ltd.

The using amount of the water soluble polymer in terms of a coated amount per 1 $m^2$ of the support is preferably from 0.3 to 6.0 $g/m^2$, and more preferably from 0.5 to 4.0 $g/m^2$.

The concentration thereof in a coating composition is not particularly limited and is preferably adjusted to such a value that the addition thereof provides a viscosity suitable for simultaneous double-layer coating. In general, the concentration in the composition is from 0.01 to 30% by mass, more preferably from 0.05 to 20% by mass, and particularly preferably from 0.1 to 10% by mass. The viscosity obtained therefrom in terms of an increment from the initial viscosity is preferably from 1 to 200 mPa·s, and more preferably from 5 to 100 mPa·s. The viscosity herein is a value measured with a B-type rotation viscometer at 25° C. The glass transition temperature of the water soluble polymer that is preferably used in the invention is not particularly limited and is preferably from 40 to 220° C. from the standpoint of brittleness, such as belt marks upon thermal development and formation of dusts upon processing. The glass transition temperature is more preferably from 60 to 200° C., particularly preferably from 80 to 180° C., and most preferably from 90 to 170° C.

A polymer capable of being dispersed in an aqueous solvent may be used in combination with the water soluble polymer that is not derived from an animal protein in the invention.

Suitable examples of the polymer capable of being dispersed in an aqueous solvent include a synthetic resin, a polymer, a copolymer and other media forming a film, such as a cellulose acetate compound, a cellulose acetate butyrate compound, a poly(methyl methacrylate) compound, a poly(vinyl chloride) compound, a poly(methacrylic acid) compound, a styrene-maleic anhydride copolymer, a styrene-acrylonitrile copolymer, a styrene-butadiene copolymer, a poly(vinylacetal) compound (such as poly(vinylformal) and poly(vinylbutyral)), a poly(ester) compound, a poly(urethane) compound, a phenoxy resin, a poly(vinylidene chloride) compound, a poly(epoxide) compound, a poly(carbonate) compound, a poly(vinyl acetate) compound, a poly(olefin) compound, a cellulose ester compound and a poly(amide) compound.

Preferred examples of the latex include those described for the description of the latex polymer below.

[Description of Latex Polymer]

The latex polymer that can be used in the invention is in such a state in that fine particles of a water insoluble hydrophobic polymer are dispersed in water.

The average diameter of the dispersed particles is generally from 1 to 50,000 nm, preferably from 5 to 1,000 nm, more preferably from 10 to 500 nm, and further preferably from 50 to 200 nm. The particle diameter distribution of the dispersed particles is not particularly limited, and either those having a broad particle diameter distribution or those having a mono-dispersion particle diameter distribution may be used. The use of a mixture of two or more kinds of particles having a mono-dispersion particle diameter distribution is preferred for controlling the physical property of the coating composition.

Preferred examples of the latex polymer in the invention include a hydrophobic polymer, such as an acrylic polymer, a poly(ester) compound, a rubber compound (such as an SBR resin), a poly(urethane) compound, a poly(vinyl chloride) compound, a poly(vinyl acetate) compound, a poly(vinylidene chloride) compound and a poly(olefin) compound. The polymer may be a linear polymer, a branched polymer or a crosslinked polymer, and may be a so-called homopolymer formed by polymerizing a single monomer or a copolymer formed by polymerizing two or more kinds of monomers. In the case of the copolymer, it may be a random copolymer or a block copolymer (for example, a urethane-vinyl copolymer having an acidic group described in U.S. Pat. No. 6,077,648). The molecular weight of the polymer in terms of a number average molecular weight is generally from 5,000 to 1,000,000, and preferably from 10,000 to 200,000. A polymer having a too small molecular weight is not preferred since it is insufficient in mechanical strength of the image forming layer, and that having a too large molecular weight is also not preferred since it exhibits poor film forming property. A crosslinked polymer latex is particularly preferably used.

The glass transition temperature Tg of the polymer latex is preferably in a range of from −20 to 70° C., more preferably from −10 to 60° C., and most preferably from 0 to 50° C. The Tg within the range may be obtained by using two or more kinds of polymers. In other words, even in the case where a polymer having Tg outside the range is used, the weight average Tg of the polymer is preferably within the range.

(1) Specific Examples of Latex

Preferred examples of the latex polymer include those described below. In the following description, the polymers are expressed by raw material monomers, the numerals in parentheses are percent by mass, and the molecular weights are number average molecular weights. In the case where a polyfunctional monomer is used, a crosslinked structure is formed, and thus the molecular weight cannot be conceptually applied. These cases are expressed with the term "crosslinked", and indication of molecular weight is omitted. Tg represents a glass transition temperature.

P-1: latex of MMA (70), EA (27) and MAA (3) (molecular weight: 37,000, Tg: 61° C.)

P-2: latex of MMA (70), 2EHA (20), St (5) and AA (5) (molecular weight: 40,000, Tg: 59° C.)

P-3: latex of St (50), Bu (47) and MAA (3) (crosslinked, Tg: −17° C.)

P-4: latex of St (68), Bu (29) and AA (3) (crosslinked, Tg: 17° C.)

P-5: latex of St (71), Bu (26) and AA (3) (crosslinked, Tg: 24° C.)

P-6: latex of St (70), Bu (27) and IA (3) (crosslinked)

P-7: latex of St (75), Bu (24) and AA (1) (crosslinked, Tg: 29° C.)

P-8: latex of St (60), Bu (35), DVB (3) and MAA (2) (crosslinked)

P-9: latex of St (70), Bu (25), DVB (2) and AA (3) (crosslinked)

P-10: VC (50), MMA (20), EA (20), AN (5) and AA (5) (molecular weight: 80,000)

P-11: latex of VDC (85), MMA (5) EA (5) and MAA (5) (molecular weight: 67,000)

P-12: latex of Et (90) and MAA (10) (molecular weight: 12,000)

P-13: latex of St (70),2EHA (27) and AA (3) (molecular weight: 130,000, Tg: 43° C.)

P-14: latex of MMA (63), EA (35) and AA (2) (molecular weight: 33,000, Tg: 47° C.)

P-15: latex of St (70.5), Bu (26.5) and AA (3) (crosslinked, Tg: 23° C.)

P-16: latex of St (69.5), Bu (27.5) and AA (3) (crosslinked, Tg: 20.5° C.)

In the aforementioned structures, symbols of the monomers means as follows.

MMA: methyl methacrylate
EA: ethyl acrylate
MAA: methacrylic acid
2EHA: 2-ethylhexyl acrylate
St: styrene
Bu: butadiene
AA: acrylic acid
DVB: divinylbenzene
VC: vinyl chloride
AN: acrylonitrile
VDC: vinylidene chloride
Et: ethylene
IA: itaconic acid The polymer latexes described in the foregoing are commercially available, and the following polymers can be used. Examples of the acrylic polymer include CEVIAN A-4635, 4718 and 4601 (all produced by Daicel Chemical Industries, Ltd.), NIPOL LX 811, 814, 821, 820, 855 (P-17, Tg: 36° C.) and 857×2 (P-18, Tg: 43° C.) (all produced by Zeon Corp.), VONCOAT R 3370 (P-19, Tg: 25° C.) and 4280 (P-20, Tg: 15° C.) (all produced by Dainippon Ink And Chemicals, Inc.), JURYMER ET-410 (P-21, Tg: 44° C.) (produced by Nihon Junyaku Co., Ltd.), AE116 (P-22, Tg: 50° C.), AE119 (P-23, Tg: 55° C.), AE121 (P-24, Tg: 58° C.), AE125 (P-25, Tg: 60° C.), AE134 (P-26, Tg: 48° C.), AE137 (P-27, Tg: 48° C.), AE140 (P-28, Tg: 53° C.) and AE173 (P-29, Tg: 60° C.) (all produced by JSR Corp.), and ARON A-104 (P-30, Tg: 45° C.) (produced by Toagosei Co., Ltd.). Examples of the poly(ester) compound include FINETEX ES 650, 611, 675 and 850 (all produced by Dainippon Ink And Chemicals, Inc.), WD-SIZE and WMS (all produced by Eastman Chemical Co.). Examples of the poly(urethane) compound include HYDRAN AP 10 (P-31, Tg: 37° C.), 20, 30, 40 (P-32, Tg: 55° C.) and 101H, and VONDIC 1320NS and 1610NS (all produced by Dainippon Ink And Chemicals, Inc.). Examples of the rubber compound include LACASTER 7310K, 3307B (P-33, Tg: 13° C.), 4700H and 7132C(P-34, Tg: 70° C.) (all produced by Dainippon Ink And Chemicals, Inc.), and NIPOL LX 416 (P-35, Tg: 50° C.), 410, 430, 435, 110, 415A (P-36, Tg: 27° C.), 438C, 2507H(P-37, Tg: 58° C.) and 303A (P-38, Tg: 100° C.) (all produced by Zeon Corp.). Examples of the poly(vinyl chloride) compound include G351 and G576 (all produced by Zeon Corp.). Examples of the poly(vinylidene chloride) compound include L502 and L513 (all produced by Asahi Kasei Corp.) and D-5071 (P-39, Tg: 36° C.) (produced by Dainippon Ink And Chemicals, Inc.). Examples of the poly (olefin) compound include CHEMIPEARL S120, SA100 and V300 (P-40, Tg: 80° C.) (all produced by Mitsui Chemicals, Inc.) and VONCOAT 2830 (P-41, Tg: 38° C.), 2210 and 2960 (all produced by Dainippon Ink And Chemicals, Inc.).

These latexes may be used solely or in combination of two or more kinds thereof.

(2) Preferred Latex

The polymer latex used in the invention is particularly preferably a latex of a styrene-butadiene copolymer. The mass ratio of the styrene monomer unit and the butadiene monomer unit in the styrene-butadiene copolymer is preferably from 40:60 to 95:5.

In the copolymer formed by polymerizing two or more kinds of monomers, it is preferred that the total amount of the styrene monomer unit and the butadiene monomer unit is from 60 to 99% by mass based on the amount of the copolymer. The copolymer in the invention is preferably obtained by polymerizing by adding acrylic acid or methacrylic acid in an amount of from 1 to 6% by mass based on the total amount of styrene and butadiene, and more preferably by adding acrylic acid or methacrylic acid in an amount of from 2 to 5% by mass. In particular, a polymer obtained by polymerizing by adding acrylic acid is preferred. The preferred molecular weight of the copolymer is the same as that described hereinabove.

Specific examples of the preferred latex of a styrene-butadiene copolymer include P-3 to P-8 and P-15, as well as LACSTAR-3307B and 7132C, and NIPOL LX 416, which are commercially available products.

(3) Layer to Which Latex May be Added

In the photothermographic material of the invention, the polymer latex is used as a binder contained in the outermost layer. The polymer latex has no setting property. Therefore, in the case where the polymer latex is used as a binder in the layer adjacent to the outermost layer, a gelation agent is used in combination.

The polymer latex may also be used as a binder of the other layers than the outermost layer and the layer adjacent to the outermost layer.

It is necessary in the invention that the outermost layer on the side of the image forming layer contains at least one of the water soluble polymer that is not derived from an animal protein (such as polyvinyl alcohol) and the latex polymer in an amount of 50% by mass or more based on the total binder in the outermost layer. That is, one of the water soluble polymer that is not derived from an animal protein and the latex polymer is preferably contained in the total binder in the outermost layer in an amount of 50% by mass or more, and more preferably from 80 to 100% by mass.

As the binder of the outermost layer, other polymers than the water soluble polymer that is not derived from an animal protein and the latex polymer may be used in combination (such as gelatin as a water soluble polymer that is derived from an animal protein).

(4) Addition Amount

In the case where the polymer latex is used in the outermost layer, the content of the polymer is preferably from 50 to 100% by mass, and more preferably from 70 to 100% by mass, based on the total binder.

[Description of Gelling Binder]

In the invention, a binder that gels upon decreasing temperature is used in the layer adjacent to the outermost layer. The gelling binder includes a water soluble polymer that is derived from an animal protein, and a water soluble polymer that is not derived from an animal protein and a hydrophobic polymer, to which a gelation agent is added.

The flowability of the layer formed by coating is lost by gelation, and thus the surface of the image forming layer is hard to receive influences of air blow for drying in the drying process after the coating process, whereby a photothermographic material having a uniform surface property can be obtained.

It is important herein that the coating composition does not gel upon coating. In view of the convenience of the coating operation, the coating composition has flowability upon coating but gels to lose the flowability immediately before entering the drying process after coating.

The viscosity of the coating composition upon coating is preferably from 5 to 200 mPa·s, and more preferably from 10 to 100 mPa·s.

In the invention, an aqueous solvent is used as a solvent for the coating composition. The aqueous solvent herein means water or a mixture of water and 70% by mass or less of a water miscible organic solvent. Examples of the water miscible organic solvent include an alcohol solvent, such as methyl alcohol, ethyl alcohol and propyl alcohol, a cellosolve solvent, such as methylcellosolve, ethylcellosolve and butylcellosolve, ethyl acetate, and dimethylformamide.

Although it is difficult to measure the viscosity of the layer thus formed immediately before entering into the drying process after coating since the layer gels in this stage, it is expected that the viscosity is generally about from 200 to 5,000 mPa·s, and preferably about from 500 to 5,000 mPa·s.

The gelation temperature is not particularly limited, and in view of the operation efficiency of coating, the gelation temperature is preferably around room temperature. This is because the preferred temperature is such a temperature that the flowability of the coating composition can be easily increased for easiness of coating, such a temperature that the flowability thereof can be maintained (i.e., such a temperature that the increased temperature can be easily maintained), and such a temperature that the cooling operation for losing the flowability can be easily carried out after coating. Specifically, the gelation temperature is preferably from 0 to 40° C., and more preferably from 0 to 35° C.

The temperature upon coating the coating composition is not particularly limited as far as it is set at a higher temperature than the gelation temperature, and the cooling temperature before entering into the drying process after coating is also not particularly limited as far as it is set at a lower temperature than the gelation temperature. However, in the case where the difference between the temperature of the coating composition and the cooling temperature is small, gelation starts during the coating operation to cause problems, such as failure of uniform coating. On the other hand, in the case where the temperature of the coating composition is set at a too higher temperature for increasing the temperature difference, the solvent of the coating composition is evaporated to cause problems, such as change in viscosity. Therefore, the temperature difference is preferably from 5 to 50° C., and more preferably from 10 to 40° C.

[Description of Water Soluble Polymer that is Derived from Animal Protein]

The polymer that is derived from an animal protein in the invention includes natural and chemically modified water soluble polymers, such as glue, casein, gelatin and albumen.

It is preferably gelatin, which is classified in view of the synthesis method thereof into an acid processed gelatin and an alkali processed gelatin (such as lime processed gelatin), and both of them can be preferably used. The molecular weight of the gelatin is preferably 10,000 to 1,000,000. Modified gelatin obtained by subjecting gelatin to a modification treatment by utilizing an amino group and a carboxyl group of gelatin may also be used (such as phthalated gelatin).

A gelatin aqueous solution forms sol upon heating to a temperature of 30° C. or more and gels to lose flowability upon cooling under that temperature. Because gelatin reversibly exhibits the sol-gel transformation with temperature, the gelatin aqueous solution as the coating composition has the setting property where the solution loses flowability upon cooling to a temperature of 30° C. or less.

The content of the water soluble polymer that is derived from an animal protein in the coating composition is generally from 1 to 20% by mass, and preferably from 2 to 12% by mass, based on the total coating composition.

[Description of Gelation Agent]

The gelation agent in the invention is such a substance that is added to a latex aqueous solution of the water soluble polymer that is not derived from an animal protein or the hydrophobic polymer in the invention to cause gelation, or such a substance that is used in combination with a gelation accelerator to cause gelation. Upon causing gelation, the flowability is significantly lowered.

Specific examples of the gelation agent include water soluble polysaccharides, such as agar, κ-carrageenan, ι-carrageenan, alginic acid, an alginate salt, agarose, furcelleran, gellan gum, glucono-δ-lactone, azotobacter vinelandii gum, xanthan gum, pectin, guar gum, locust bean gum, tara gum, cassia gum, glucomannan, tragant gum, karaya gum, pullulan, gum arabic, arabinogalactan, dextran, a carboxymethylcellulose sodium salt, methylcellulose, cyalume seed gum, starch, chitin, chitosan and curdlan.

Examples of such a substance that is cooled to cause gelation after dissolving under heat include agar, carrageenan and gellan gum.

Among the gelation agents, κ-carrageenan (such as K-9F, produced by Taito Co., Ltd., and K-15, K-21 to K-24 and I-3, produced by Nitta Gelatin, Inc.), ι-carrageenan and agar are more preferred, and κ-carrageenan is particularly preferred.

The gelation agent is generally used in an amount of from 0.01 to 10.0% by mass, preferably from 0.02 to 5.0% by mass, and more preferably from 0.05 to 2.0% by mass, based on the binder polymer.

The gelation agent is preferably used in combination with a gelation accelerator. The gelation accelerator in the invention is such a compound that accelerates gelation upon contacting with the gelation agent, and the function thereof is exerted through the particular combination with the gelation agent. Examples of the combination of the gelation agent and the gelation accelerator include:

(1) combinations of an alkali metal ion, such as potassium ion, or an alkaline earth metal ion, such as calcium ion and magnesium ion, as the gelation accelerator, with carrageenan, an alginate salt, gellan gum, azotobacter vinelandii gum, pectin or an carboxymethylcellulose sodium salt, as the gelation agent;

(2) combinations of a boron compound, such as boric acid, as the gelation accelerator, with guar gum, locust bean gum, tara gum or cassia gum, as the gelation agent;

(3) combinations of an acid or an alkali, as the gelation accelerator, with an alginate salt, glucomannan, pectin, chitin, chitosan or curdlan, as the gelation agent; and (4) combinations where such a water soluble polysaccharide that forms gel through reaction with the gelation agent is used as the gelation accelerator, specific examples thereof include a combination of xanthan gum as the gelation agent with cassia gum as the gelation accelerator, and a combination of carrageenan as the gelation agent with locust bean gum as the gelation accelerator.

Specific examples of the combination of the gelation agent and the gelation accelerator include the following (a) to (g).

(a) combination of κ-carrageenan and potassium (b) combination of ι-carrageenan and calcium (c) combination of low methoxy pectin and calcium (d) combination of sodium alginate and calcium (e) combination of gellan gum and calcium (f) combination of gellan gum and an acid (g) combination of locust bean gum and xanthan gum Plural combinations may be used simultaneously.

While the gelation accelerator may be added to the same layer as the gelation agent added thereto, it is preferably added to a different layer to exert the function thereof. More preferably, the gelation accelerator is added to such a layer that is not directly adjacent to the layer, to which the gelation agent is added. In other words, it is more preferred that a layer containing no gelation agent and no gelation accelerator is provided between the layer, to which the gelation agent is added, and the layer, to which the gelation accelerator is added.

The gelation accelerator is preferably added in an amount of from 0.1 to 200% by mass, and more preferably from 1.0 to 100% by mass, based on the amount of the gelation agent.

(Description of Matting Agent)

In the invention, a matting agent may be contained in at least one of the outermost layer and the layer adjacent to the outermost layer. It is preferred that the matting agent is added to the outermost layer. The layer, to which the matting agent is added, may be a single layer or plural layers.

In particular, it is preferred that the matting agent is previously dispersed with a water soluble polymer that is not derived from an animal protein, and thus used as a matting agent particle dispersion. It is more preferred that a surface active agent, examples of which are described below, is added to the matting agent particle dispersion.

The matting agent used in the invention generally includes water insoluble organic or inorganic fine particles. Arbitrary matting agents may be used in the invention, and examples thereof include those widely known in this field of art, such as organic matting agents described in U.S. Pat. Nos. 1,939,213, 2,701,245, 2,322,037, 3,262,782, 3,539,344 and 3,767,448, and inorganic matting agents described in U.S. Pat. Nos. 1,260,772, 2,192,241, 3,257,206, 3,370,951, 3,532,022 and 3,769,020.

Examples of the organic compound that can be used as the matting agent include water dispersible vinyl polymer, such as polymethyl acrylate, polymethyl methacrylate, polyacrylonirile, an acrylonitrilie-α-methylstyrene copolymer, polystyrene, a styrene-divinylbenzene copolymer, polyvinyl acetate, polyethylene carbonate and polytetrafluoroethylene, a cellulose derivative, such as methylcellulose, cellulose acetate and cellulose acetate propionate, a starch derivative, such as carboxyl starch, carboxynitrophenyl starch and a urea-formaldehyde-starch reaction product, gelatin having been hardened with a known hardener, and a hardened gelatin formed into a fine capsulated hollow particles through coacervate hardening.

Examples of the inorganic compound include silicon dioxide, titanium dioxide, magnesium dioxide, aluminum oxide, barium sulfate, calcium carbonate, silver chloride and silver bromide that have been desensitized by a known method, glass, and diatom earth. The matting agent may be used by mixing different substances depending on necessity. The size and the shape of the matting agent are not particularly limited, and one having an arbitrary particle diameter may be used. Upon practicing the invention, a matting agent having a particle diameter of from 0.1 to 30 μm is preferably used, more preferably from 0.3 to 20 μm, and further preferably from 0.5 to 10 μm. The particle diameter distribution of the matting agent may be narrow or broad. The variation coefficient of the particle diameter distribution is preferably 50% or less, more preferably 40% or less, and further preferably 30% or less. The variation coefficient herein is a value expressed by ((standard deviation of particle diameter)/(average value of particle diameter))× 100. It is also preferred that such two kinds of matting agents having small particle diameters are used in combination that have a ratio of the average particle diameters of 3 or more.

Since the matting agent exerts great influence on the haze and the surface gloss of the coated film, it is preferred that the particle diameter, the shape and the particle diameter distribution of the matting agent are adjusted to the necessary conditions by modifying the production conditions of the matting agent or by mixing plural matting agents.

Examples of the matting agent used in the invention are shown below, but the invention is not limited to these compounds.

M-1: polyethylene particles (specific gravity: 0.90, FLOBEADS LE-1080, produced by Sumitomo Seika Chemicals Co., Ltd.)

M-2: polyethylene particles (specific gravity: 0.93, FLOBEADS EA-209, produced by Sumitomo Seika Chemicals Co., Ltd.)

M-3: polyethylene particles (specific gravity: 0.96, FLOBEADS HE-3040, produced by Sumitomo Seika Chemicals Co., Ltd.)

M-4: silicone particles (specific gravity: 0.97)

M-5: silicone particles (specific gravity: 1.00, E701, produced by Toray Dow Coning Silicone Co., Ltd.)

M-6: silicone particles (specific gravity: 1.03)

M-7: polystyrene particles (specific gravity: 1.05, SB-6, produced by Sekisui Plastics Co., Ltd.)

M-8: poly(St/MAA=97/3) copolymer particles (specific gravity: 1.05)

M-9: poly(St/MAA=90/10) copolymer particles (specific gravity: 1.06)

M-10: poly(St/MMA/MAA=50/40/10) copolymer particles (specific gravity: 1.09)

M-11: crosslinked polyethylene particles (specific gravity: 0.92)

M-12: crosslinked polyethylene particles (specific gravity: 0.95)

M-13: crosslinked polyethylene particles (specific gravity: 0.98)

M-14: crosslinked silicone particles (specific gravity: 0.99)

M-15: crosslinked silicone particles (specific gravity: 1.02)

M-16: crosslinked silicone particles (specific gravity: 1.04)

M-17: poly(St/DVB=90/10) copolymer particles (specific gravity: 1.06, SX-713, produced by Soken Chemical Co., Ltd.)

M-18: poly(St/DVB=80/20) copolymer particles (specific gravity: 1.06, SX-713, produced by Soken Chemical Co., Ltd.)

M-19: poly(St/DVB=70/30) copolymer particles (specific gravity: 1.07, SX-713, produced by Soken Chemical Co., Ltd.)

M-20: poly(St/MAA/DVB=87/3/10) copolymer particles (specific gravity: 1.06, SX-713α, produced by Soken Chemical Co., Ltd.)

M-21: poly(St/MAA/DVB=80/10/10) copolymer particles (specific gravity: 1.07, SX-713α, produced by Soken Chemical Co., Ltd.)

M-22: poly(St/MMA/MAA/DVB=40/40/10/10) copolymer particles (specific gravity: 1.10)

The content of the matting agent is in such a range that the desired effect of the invention is exerted, and the function of the layer containing the matting agent is not excessively impaired. The amount of the matting agent in terms of a coated amount per 1 $m^2$ of the photosensitive material is preferably from 1 to 400 $mg/m^2$, and more preferably from 5 to 300 $mg/m^2$.

In the case where the matting agent is contained on the side where the image forming layer is formed, the content of the matting agent is generally such an amount that does not cause stardust contamination, preferably such an amount that provides a Beck smoothness of from 500 to 10,000 seconds, and more preferably from 500 to 2,000 seconds. In the case where the matting agent is contained in the back layer, the amount thereof is preferably such an amount that provides a Beck smoothness of from 10 to 2,000 seconds, and more preferably from 50 to 1,500 seconds. The Beck smoothness herein can be obtained according to JIS P8119 and TAPPI T479.

The matting agent contained in the outermost layer on the side of the image forming layer and the layer adjacent to the outermost layer may be used as a matting agent particle dispersion formed by dispersing with a water soluble polymer that is not derived from an animal protein. The dispersing method includes two methods, i.e., (a) a polymer to be a matting agent is formed into a solution (for example, by dissolved in an organic solvent having a low boiling point), and the solution is emulsion-dispersed in an aqueous medium to obtain liquid droplets of the polymer, followed by removing the low boiling point solvent from the emulsion, to prepare the matting agent dispersion, and (b) fine particles of a polymer or the like to be a matting agent are previously prepared, and the fine particles are uniformly dispersed in an aqueous solution to prepare a dispersion. In the invention, the method (b) is preferred from the standpoint of environment protection since it does not discharge a low boiling point organic solvent.

The dispersion method of the matting agent may be carried out in such a manner that a water soluble polymer that is not derived from an animal protein is dissolved in an aqueous medium as a dispersion aid, and the matting agent is mechanically dispersed therein by using a known high-speed agitation means (such as a disper emulsifier, a homomixer, a turbine mixer and a homogenizer) or an ultrasonic wave emulsifier. Upon dispersing, means for dispersing under a reduced pressure lower than the atmospheric pressure may be used in combination to suppress foaming. In general, the dispersion aid used is previously dissolved in the aqueous medium, and then the matting agent is added thereto, but the matting agent may be added to an aqueous dispersion obtained through polymerization of the matting agent (i.e., without drying process). The dispersion aid may be added to the dispersion during the dispersing process. The matting agent may be added to the dispersion solution in order to stabilize the property after dispersion. In any case, it is general that a solvent (such as water and an alcohol) is used in combination. The pH of the dispersion may be controlled with an appropriate pH adjusting agent before or after dispersing or during dispersing.

In addition the means for mechanically dispersing, the stability of the matting agent dispersion after dispersing may be improved by controlling the pH. A slight amount of a low boiling point organic solvent may be auxiliary used upon dispersing, and the organic solvent is generally removed after forming the fine particles.

The dispersion thus produced may be stored under stirring, and may be stored in a state of high viscosity with a hydrophilic colloid (for example a jelly state by using gelatin), so as to suppress sedimentation of the matting agent during storage. An antiseptic is preferably added thereto for preventing growth of saprophytic bacteria during storage.

The water soluble polymer that is not derived from an animal protein is preferably added for dispersing in an amount of from 5 to 300% by mass, and more preferably from 10 to 200% by mass, based on the amount of the matting agent.

The matting agent dispersion in the invention preferably contains a surface active agent since the dispersion state is stabilized by containing a surface active agent. The surface active agent used herein is not particularly limited, and known products may be used. Preferred examples of the dispersion aid having been known in the art include an anionic dispersing agent, such as an alkylphenoxyethoxyethanesulfonate salt, a polyoxyethylenealkylphenylethersulfonate salt, an alkylbenzenesulfonate salt, an alkylnaphthalenesulfonate salt, an alkylsulfate salt, an alkylsulfosuccinate salt, sodium oleylmethyltauride, a formaldehyde polycondensation product of naphthalenesulfonic acid, polyacrylic acid, polymethacrylic acid, a maleic acid-acrylic acid copolymer, carboxymethylcellulose and cellulose sulfate, a nonionic dispersing agent, such as polyoxyethylene alkyl ether, sorbitan fatty acid ester, polyoxyethylene sorbitan fatty acid ester and a block copolymer of polyalkyleneoxide, a cationic dispersing agent, and a betaine dispersing agent. In particular, an anionic surface active agent, such as sodium triisopropylnaphthalenesulfonate (a mixture of isomers having different substitution positions of the three isopropyl groups), is preferred.

Examples of the antiseptic that can be added to the dispersion include a benzoisothazolinone sodium salt and a p-hydroxybenzoate ester (such as a methyl ester and a butyl ester). The addition amount thereof is preferably in a range of from 0.005 to 0.1% by mass based on the amount of the dispersion.

(Description of Fluorine Compound)

The photothermographic material of the invention contains a fluorine compound having a fluoroalkyl group having 2 or more carbon atoms and 13 or less fluorine atoms. The fluorine compound in the invention can be used as a surface active agent.

The fluorine compound used in the invention is not particularly limited in structure as far as it has the fluoroalkyl group (hereinafter, the alkyl group substituted with fluorine atoms is represented by Rf). The fluorine compound may have at leastoning agentf and may have two or more thereof.

Specific examples of Rf include the following groups, but the invention is not limited thereto.

Examples of Rf include a $—C_2F_5$ group, a $—C_3F_7$ group, a $—C_4F_7$ group, a $—C_5F_{11}$ group, a $—CH_2—C_4F_9$ group, a $—C_4F_8—H$ group, a $C_2H_4—C_4F_9$ group, a $—C_4H_8—C_4F_9$ group, a $—C_6H_{12}—C_4F_9$ group, a $—C_8H_{16}—C_4F_9$ group, a $—C_4H_8—C_2F_5$ group, a $—C_4H_8—C_3F_7$ group, a $—C_4H_8—C_5F_{11}$ group, a $—C_8H_{16}—C_2F_5$ group, a $—C_2H_4—C_4F_8—H$ group, a $—C_4H_8—C_4F_8—H$ group, a $—C_6H_{12}—C_4F_8—H$ group, a $—C_6H_{12}—C_2F_4—H$ group, a $C_8H_{16}—C_2F_4—H$ group, a $—C_6H_{12}—C_4F_8—CH_3$ group, a $—C_2H_4—C_3F_7$ group, a $—C_2H_4—C_5F_{11}$ group, a $—C_4H_8—CF(CF_3)_2$ group, a $—CH_2CF_3$ group, a $—C_4H_8—CH(C_2F_5)_2$ group, a $—C_4H_8—CH(CF_3)_2$ group, a $—C_4H_8—C(CF_3)_3$ group, a $—CH_2—C_4F_8—H$ group, a $—CH_2—C_6F_{12}—H$ group, a $—CH_2—C_6F_{13}$ group, a $—C_2H_4—C_6F_{13}$ group, a $—C_4H_8—C_6F_{13}$ group, a $—C_6H_{12}—C_6F_{13}$ group and a $—C_8H_{16}—C_6F_{13}$ group.

Rf has 13 or less fluorine atoms, preferably 12 or less fluorine atoms, and more preferably from 3 to 11 fluorine atoms further preferably from 5 to 9 fluorine atoms. Rf has 2 or more carbon atoms, preferably from 4 to 16 carbon atoms, and more preferably from 5 to 12 carbon atoms.

Rf is not particularly limited as far as it has 2 or more carbon atoms and 13 or less fluorine atoms, and a group represented by the following general formula (A) is preferred.

General formula (A)

-Rc-Re—W

The fluorine compound in the invention preferably has two or more fluoroalkyl group represented by the general formula (A).

In the general formula (A), Rc represents an alkylene group having from 1 to 4 carbon atoms, preferably from 1 to 3 carbon atoms, and more preferably from 1 to 2 carbon atoms. The alkylene group represented by Rc may be linear or branched.

Re represents a perfluoroalkylene group having from 2 to 6 carbon atoms, and preferably a perfluoroalkylene group having from 2 to 4 carbon atoms. The perfluoroalkylene group herein means an alkylene group, all hydrogen atoms of which are substituted with fluorine atoms. The perfluoroalkylene group may be linear or branched, or may have a cyclic structure.

W represents a hydrogen atom, a fluorine atom or an alkyl group, preferably a hydrogen atom or a fluorine atom, and particularly preferably a fluorine atom.

The fluorine compound in the invention may have a cationic hydrophilic group.

The cationic hydrophilic group herein means a group becoming a cation upon dissolving in water. Specific examples thereof include a quaternary ammonium, an alkylpyridinium, an alkylimidazolinium and a primary to tertiary aliphatic amine.

The cation is preferably an organic cationic substituent, more preferably an organic cationic group containing a nitrogen atom or a phosphorous atom, and further preferably a pyridinium cation or an ammonium cation.

The species of an anion forming a salt may be an inorganic anion or an organic anion. Preferred examples of the inorganic anion include a iodide ion, a bromide ion and a chloride ion, and preferred examples of the organic anion include a p-toluenesulfonate ion, a benzenesulfonate ion, a methanesulfonate ion and a trifluoromethanesulfonate ion.

Preferred examples of the cationic fluorine compound in the invention include a compound represented by the following general formula (1).

General formula (1)

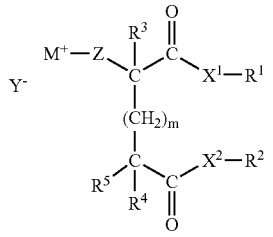

In the general formula (1), $R^1$ and $R^2$ each independently represents a substituted or unsubstituted alkyl group, provided that at least one of $R^1$ and $R^2$ represents the fluoroalkyl group (Rf). It is preferred that both $R^1$ and $R^2$ represent Rf. $R^3$, $R^4$ and $R^5$ each independently represents a hydrogen atom or a substituent, $X^1$, $X^2$ and Z each independently represents a divalent linking group or a single bond, $M^+$ represents a cationic substituent. $Y^-$ represents a counter anion, provided that in the case where the electric charge is neutralized within the molecule, there may be no anion represented by $Y^-$. m represents 0 or 1.

In the case where $R^1$ and $R^2$ in the general formula (1) each independently represents a substituted or unsubstituted alkyl group other than Rf, the alkyl group contains 1 or more carbon atoms and may be linear, branched or cyclic. Examples of the substituent include a halogen atom, an alkenyl group, an aryl group, an alkoxy group, a halogen atom other than a fluorine atom, a carboxylate ester group, a carbonamide group, a carbamoyl group, an oxycarbonyl group or a phosphate ester group.

In the case where $R^1$ and $R^2$ each represents an alkyl group other than Rf, i.e., an alkyl group that is not substituted with a fluorine atom, the alkyl group is preferably a substituted or unsubstituted alkyl group having from 1 to 24 carbon atoms, and more preferably a substituted or unsubstituted alkyl group having from 6 to 24 carbon atoms. Preferred examples of the unsubstituted alkyl group having from 6 to 24 carbon atoms include an n-hexyl group, an n-heptyl group, an n-octyl group, a tert-octyl group, a 2-ethylhexyl group, an n-nonyl group, a 1,1,3-trimethylhexyl group, an n-decyl group, an n-dodecyl group, a cetyl group, a hexadecyl group, a 2-hexyldecyl group, an octadecyl group, an eicosyl group, a 2-octyldodecyl group, a docosyl group, a tetracosyl group, a 2-decyltetradecyl group, a tricosyl group, a cyclohexyl group and a cycloheptyl group. Examples of an alkyl group having a substituent having from 6 to 24 carbon atoms in total include a 2-hexyenyl group, an oleyl group, a linoleyl group, a linolenyl group, a benzyl group, a β-phenethyl group, a 2-methoxyethyl group, a 4-phenylbutyl group, a 4-acetoxyethyl group, a 6-phenoxyhexyl group, a 12-phenyldodecyl group, a 18-phenyloctadecyl group, a 12-(p-chlorophenyl)dodecyl group and a 2-(diphenyl phosphate)ethyl group.

The alkyl group independently represented by $R^1$ and $R^2$ other than Rf is more preferably a substituted or unsubstituted alkyl group having from 6 to 18 carbon atoms. Preferred examples of the unsubstituted alkyl group having from 6 to 18 carbon atoms include an n-hexyl group, a cyclohexyl group, an n-heptyl group, an n-octyl group, a 2-ethylhexyl group, an n-nonyl group, a 1,1,3-trimethylhexyl group, an n-decyl group, an n-dodecyl group, a cetyl group, a hexadecyl group, a 2-hexyldecyl group, an octadecyl group and a 4-tert-butylcyclohexyl group. Preferred examples of the substituted alkyl group having a substituent and having from 6 to 18 carbon atoms in total include a phenethyl group, a 6-phenoxyhexyl group, a 12-phenyldodecyl group, an oleyl group, a linoleyl group and a linolenyl group.

The alkyl group independently represented by $R^1$ and $R^2$ other than Rf is particularly preferably an n-hexyl group, a cyclohexyl group, an n-heptyl group, an n-octyl group, a 2-ethylhexyl group, an n-nonyl group, a 1,1,3-trimethylhexyl group, an n-decyl group, an n-dodecyl group, a cetyl group, a hexadecyl group, a 2-hexyldecyl group, an octadecyl group, an oleyl group, a linoleyl group and a linolenyl group, and most preferably a linear, branched or cyclic unsubstituted alkyl group having from 8 to 16 carbon atoms.

In the general formula (1), $R^3$, $R^4$ and $R^5$ each independently represents a hydrogen atom or a substituent. Examples of the substituent include an alkyl group (preferably an alkyl group having from 1 to 20 carbon atoms, more preferably from 1 to 12 carbon atoms, and particularly preferably from 1 to 8 carbon atoms, examples of which include a methyl group, an ethyl group, an isopropyl group, a tert-butyl group, an n-octyl group, an n-decyl group, an n-hexadecyl group, a cyclopropyl group, a cyclopentyl group and a cyclohexyl group), an alkenyl group (preferably an alkenyl group having from 2 to 20 carbon atoms, more preferably from 2 to 12 carbon atoms, and particularly preferably from 2 to 8 carbon atoms, examples of which include a vinyl group, an allyl group, a 2-butenyl group and a 3-pentenyl group), an alkynyl group (preferably an alkynyl group having from 2 to 20 carbon atoms, more preferably from 2 to 12 carbon atoms, and particularly preferably from 2 to 8 carbon atoms, examples of which include a propargyl group and a 3-pentynyl group), an aryl group (preferably an aryl group having from 6 to 30 carbon atoms, more preferably from 6 to 20 carbon atoms, and particularly preferably from 6 to 12 carbon atoms, examples of which include a phenyl group, a p-methylphenyl group and a naphthyl group), a substituted or unsubstituted amino group (preferably, an amino group having from 0 to 20 carbon atoms, more preferably from 0 to 10 carbon atoms, and particularly preferably from 0 to 6 carbon atoms, examples of which include an unsubstituted amino group, a methylamino group, a dimethylamino group, a diethylamino group and a dibenzylamino group), an alkoxy group (preferably an alkoxy group having from 1 to 20 carbon atoms, more preferably from 1 to 12 carbon atoms, and particularly preferably from 1 to 8 carbon atoms, examples of which include a methoxy group, an ethoxy group and a butoxy group), an aryloxy group (preferably an aryloxy group having from 6 to 20 carbon atoms, more preferably from 6 to 16 carbon atoms, and particularly preferably from 6 to 12 carbon atoms, examples of which include a phenyloxy group and a 2-naphthyloxy group), an acyl group (preferably an acyl group having from 1 to 20 carbon atoms, more preferably from 1 to 16 carbon atoms, and particularly preferably from 1 to 12 carbon atoms, examples of which include an acetyl group, a benzoyl group, a formyl group and a pivaloyl group), an alkoxycarbonyl group (preferably an alkoxycarbonyl group having from 2 to 20 carbon atoms, more preferably from 2 to 16 carbon atoms, and particularly preferably from 2 to 12 carbon atoms, examples of which include a methoxycarbonyl group and an ethoxycarbonyl group), an aryloxycarbonyl group (preferably an aryloxycarbonyl group having from 7 to 20 carbon atoms, more preferably from 7 to 16 carbon atoms, and particularly preferably from 7 to 10 carbon atoms, examples of which include a phenyloxycarbonyl group), an acyloxy group (preferably an acyloxy group having from 2 to 20 carbon atoms, more preferably from 2 to 16 carbon atoms, and particularly preferably from 2 to 10 carbon atoms, examples of which include an acetoxy group and benzoyloxy group), an acylamino group (preferably an acylamino group having from 2 to 20 carbon atoms, more preferably from 2 to 16 carbon atoms, and particularly preferably from 2 to 10 carbon atoms, examples of which include an acetylamino group and a benzoylamino group), an alkoxycarbonylamino group (preferably an alkoxycarbonylamino group having from 2 to 20 carbon atoms, more preferably from 2 to 16 carbon atoms, and particularly preferably from 2 to 12 carbon atoms, examples of which include a methoxycarbonylamino group), an aryloxycarbonylamino group (preferably an aryloxycarbonylamino group having from 7 to 20 carbon atoms, more preferably from 7 to 16 carbon atoms, and particularly preferably from 7 to 12 carbon atoms, examples of which include a phenyloxycarbonylamino group), a sulfonylamino group (preferably a sulfonylamino group having form 1 to 20 carbon atoms, more preferably from 1 to 16 carbon atoms, and particularly preferably from 1 to 12 carbon atoms, examples of which include a methanesulfonylamino group and a benzenesulfonylamino group), a sulfamoyl group (preferably a sulfamoyl group having from 0 to 20 carbon atoms, more preferably from 0 to 16 carbon atoms, and particularly preferably from 0 to 12 carbon atoms, examples of which include a sulfamoyl group, a methylsulfamoyl group, a dimethylsulfamoyl group and a phenylsulfamoyl group), a carbamoyl group (preferably a carbamoly group having from 1 to 20 carbon atoms, more preferably from 1 to 16 carbon atoms, and particularly preferably from 1 to 12 carbon atoms, examples of which include an unsubstituted carbamoyl group, a methylcarbamoyl group, a diethylcarbamoyl group and a phenylcarbamoyl group), an alkylthio group (preferably an alkylthio group having from 1 to 20 carbon atoms, more preferably from 1 to 16 carbon atoms, and particularly preferably from 1 to 12 carbon atoms, examples of which include a methylthio group and an ethylthio group), an arylthio group (preferably an arylthio group having from 6 to 20 carbon atoms, more preferably from 6 to 16 carbon atoms, and particularly preferably from 6 to 12 carbon atoms, examples of which include a phenylthio group), a sulfonyl group (preferably a sulfonyl group having from 1 to 20 carbon atoms, more preferably from 1 to 16 carbon atoms, and particularly preferably from 1 to 12 carbon atoms, examples of which include a mesyl group and a tosyl group), a sulfinyl group (preferably a sulfinyl group having from 1 to 20 carbon atoms, more preferably from 1 to 16 carbon atoms, and particularly preferably from 1 to 12 carbon atoms, examples of which include a methanesulfinyl group and a benzenesulfinyl group), an ureido group (preferably an ureido group having from 1 to 20 carbon atoms, more preferably from 1 to 16 carbon atoms, and particularly preferably from 1 to 12 carbon atoms, examples of which include an unsubstituted ureido group, a methylureido group and a phenylureido group), a phosphoamide group (preferably a phosphoamide group having from 1 to 20 carbon atoms, more preferably from 1 to 16 carbon atoms, and particularly preferably from 1 to 12 carbon atoms, examples of which include a diethylphosphoamide group and a phenylphosphoamide group), a hydroxyl group, a mercapto group, a halogen atom (such as a fluorine atom, a chlorine atom, a bromine atom and a iodine atom), a cyano group, a sulfo group, a carboxyl group, a nitro group, a hydroxam group, a sulfino group, a hydrazino group, an imino group, a heterocyclic group (preferably a heterocyclic group having from 1 to 30 carbon atoms, and more preferably from 1 to 12 carbon atoms, examples of which include a heterocyclic group having a hetero atom, e.g., a nitrogen atom, an oxygen atom and a sulfur atom, such as an imidazolyl group, a pyridyl group, a quinolyl group, a furyl group, a piperidyl group, a morpholino group, a benzoxazolyl group, a benzimidazolyl group and a benzthiazolyl group), and a silyl group (preferably a silyl group having from 3 to 40 carbon atoms, more preferably from 3 to 30 carbon atoms, and particularly preferably from 3 to 24 carbon atoms, examples of which include a trimethylsilyl group and a triphenylsilyl group). These substituents may be further substituted. In the case where two or more substituents are present, they may be the same or different, and they may form a ring by bonding to each other in case possible.

$R^3$, $R^4$ and $R^5$ each is preferably an alkyl group or a hydrogen atom, and more preferably a hydrogen atom.

In the general formula (1), $X^1$ and $X^2$ each independently represents a divalent linking group or a single bond. The divalent linking group is not particularly limited, and is preferably an arylene group, —O—, —S—, —$NR^{31}$— (wherein $R^{31}$ represents a hydrogen atom or a substituent, examples of the substituent include the examples for the substituent represented by $R^3$, $R^4$ and $R^5$, and $R^{31}$ is preferably an alkyl group, Rf or a hydrogen atom, and more preferably a hydrogen atom), and a group obtained by combining these groups, and more preferably —O—, —S—, —$NR^{31}$—. $X^1$ and $X^2$ each is more preferably —O— or —$NR^{31}$—, and particularly preferably —O—.

In the general formula (1), Z represents a divalent linking group or a single bond. The divalent linking group is not particularly limited, and is preferably an alkylene group, an arylene group, —C(=O)—, —O—, —S—, —S(=O)—, —$S(=O)_2$— or —$NR^{32}$— (wherein $R^{32}$ represents a hydrogen atom or a substituent, examples of the substituent include the examples for the substituent represented by $R^3$, $R^4$ and $R^5$, and $R^{32}$ is preferably an alkyl group or a hydrogen atom, and more preferably a hydrogen atom), and a group obtained by combining these groups, and more preferably an alkylene group having from 1 to 12 carbon atoms, an arylene group having from 6 to 12 carbon atoms, —C(=O)—, —O—, —S—, —S(=O)—, —$S(=O)_2$— or —$NR^{32}$— and a group obtained by combining these groups. Z is further preferably an alkylene group having from 1 to 8 carbon atoms, —C(=O)—, —O—, —S—, —S(=O)—, —$S(=O)_2$— or —$NR^{32}$— and a group obtained by combining these groups. Specific examples of Z include the following.

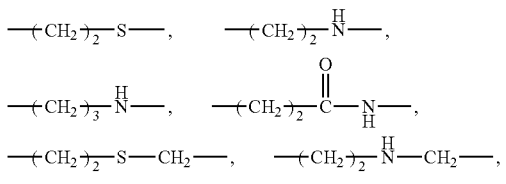

-continued

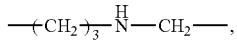

In the general formula (1), M+ represents a cationic substituent. M+ is preferably an organic cationic substituent, more preferably an organic cationic substituent containing a nitrogen atom or a phosphorous atom, further preferably a pyridinium cation or an ammonium cation, and still further preferably a trialkylammonium cation represented by the following general formula (2).

General formula (2)

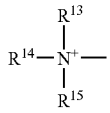

In the general formula (2), $R^{13}$, $R^{14}$ and $R^{15}$ each independently represents a substituted or unsubstituted alkyl group. Examples of the substituent include those described for the substituent for $R^3$, $R^4$ and $R^5$. $R^{13}$, $R^{14}$ and $R^{15}$ may form a ring by bonding to each other in case possible. $R^{13}$, $R^{14}$ and $R^{15}$ each is preferably an alkyl group having from 1 to 12 carbon atoms, more preferably an alkyl group having from 1 to 6 carbon atoms, further preferably a methyl group, an ethyl group or a methylcarboxyl group, and particularly preferably a methyl group.

In the general formula (2), $Y^-$ represents a counter anion, which may be an inorganic anion or an organic anion, provided that in the case where the electric charge is neutralized within the molecule, there may be no anion represented by $Y^-$. Preferred examples of the inorganic anion include an iodide ion, a bromide ion and a chloride ion, and preferred examples of the organic anion include a p-toluenesulfonate ion, a benzenesulfonate ion, a methanesulfonate ion and a trifluoromethanesulfonate ion. $Y^-$ is more preferably an iodide ion, a p-toluenesulfonate ion or a benzenesulfonate ion, and further preferably a p-toluenesulfonate ion.

In the general formula (2), m is 0 or 1, and preferably 0.

Among the compounds represented by the general formula (1), a compound represented by the following general formula (1-a) is preferred.

General formula (1-a)

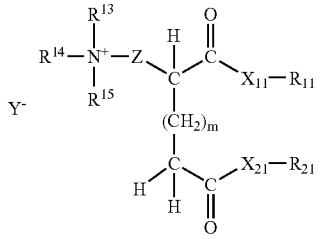

In the general formula (1-a), $R^{11}$ and $R^{21}$ each independently represents a substituted or unsubstituted alkyl group, provided that at least one of $R^{11}$ and $R^{21}$ represents Rf, and $R^{11}$ and $R^{21}$ have 19 or less carbon atoms in total. $R^{13}$, $R^{14}$ and $R^{15}$ each independently represents a substituted or unsubstituted alkyl group, which may form a ring by bonding to each other. $X^{11}$ and $X^{21}$ each independently represents —O—, —S— or —$NR^{31}$—, wherein $R^{31}$ represents a hydrogen atom or a substituent, and Z represents a divalent linking group or a single bond. $Y^-$ represents a counter anion, provided that in the case where the electric charge is neutralized within the molecule, there may be no anion represented by $Y^-$.

m represents 0 or 1. In the general formula (1-a), Z and $Y^-$ each independently represents the same meanings as those in the general formula (1), with the preferred ranges thereof being the same. $R^{13}$, $R^{14}$ and $R^{15}$ each independently represents the same meanings as those in the general formula (1), with the preferred ranges thereof being the same.

In the general formula (1-a), $X^{11}$ and $X^{21}$ each independently represents —O—, —S— or —$NR^{31}$— (wherein $R^{31}$ represents a hydrogen atom or a substituent, examples of the substituent include the examples for the substituent represented by $R^3$, $R^4$ and $R^5$, and $R^{31}$ is preferably an alkyl group, Rf or a hydrogen atom, and more preferably a hydrogen atom). $X^{11}$ and $X^{21}$ each is more preferably —O— or —$NH^{31}$—, and particularly preferably —O—.

In the general formula (1-a), $R^{11}$ and $R^{21}$ each independently represents the same meanings as those in the general formula (1), with the preferred ranges thereof being the same, provided that the $R^{11}$ and $R^{21}$ have 19 or less carbon atoms in total. m is 0 or 1.

Specific examples of the compound represented by the general formula (1) are shown below, but the invention is not limited to the example compounds. In the following structural formulae of the example compounds, all the alkyl groups and perfluoroalkyl groups have linear structure unless otherwise indicated. In the following structural formulae, symbol 2EH represents a 2-ethylhexyl group.

FS-1

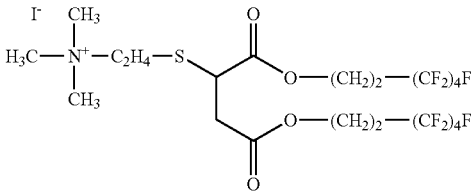

FS-2

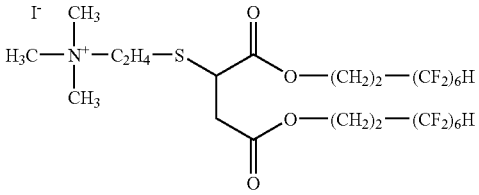

FS-3

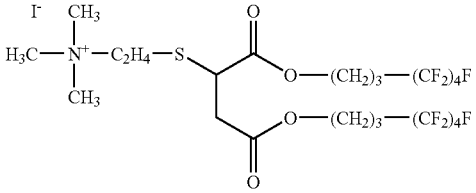

-continued

FS-4

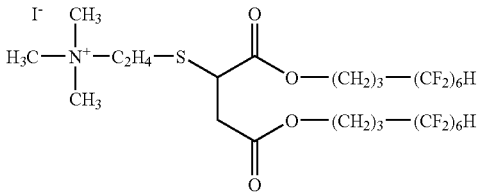

FS-5

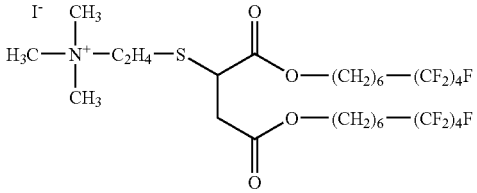

FS-6

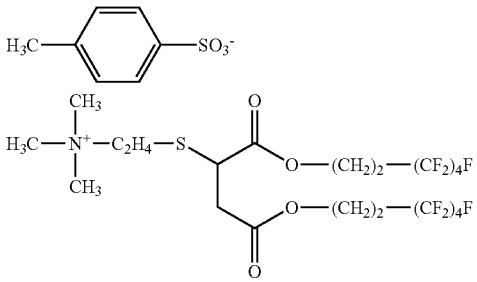

FS-7

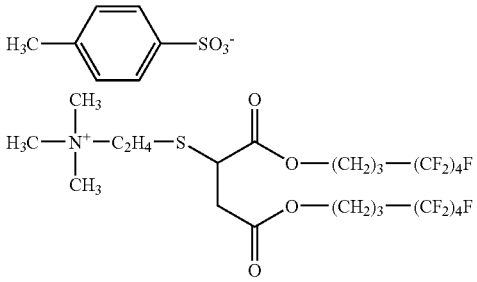

FS-8

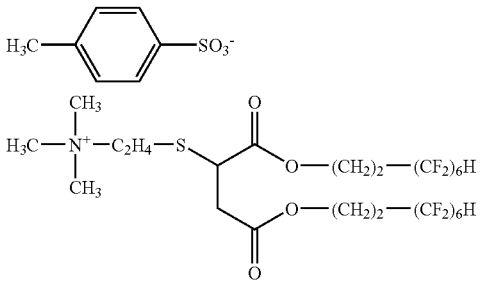

FS-9

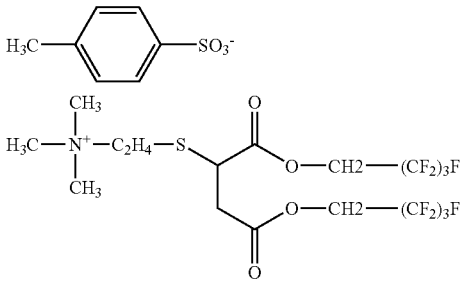

-continued
FS-10
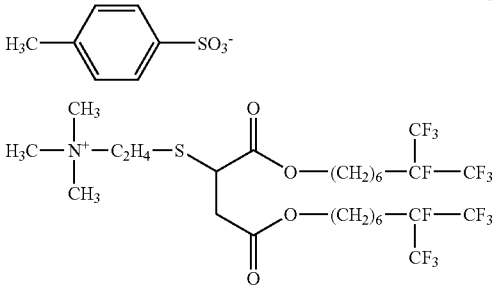
FS-11
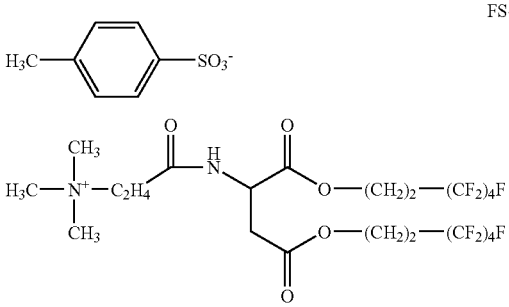
FS-12
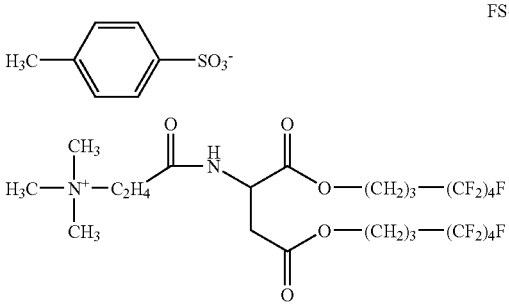
FS-13
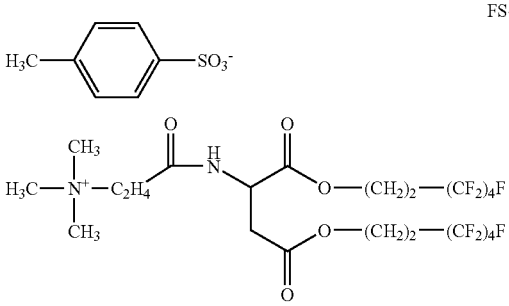
FS-14
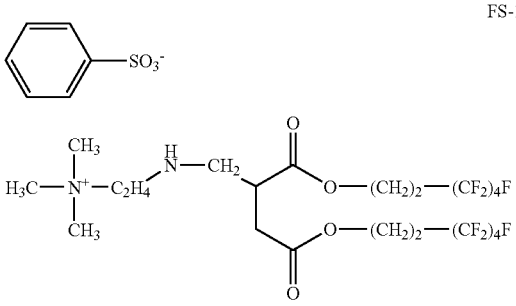
FS-15
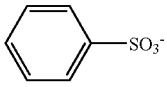
-continued
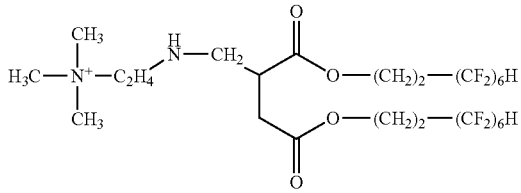
FS-16
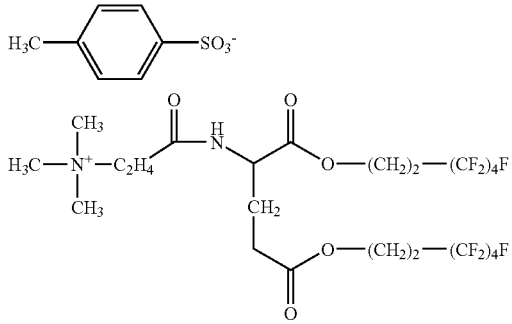
FS-17
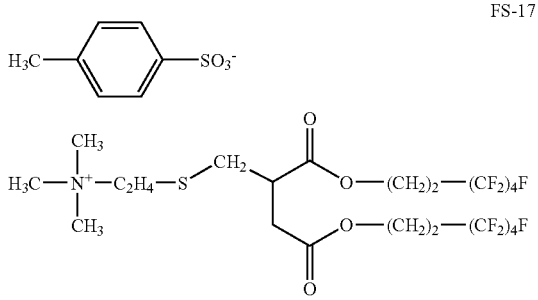
FS-18
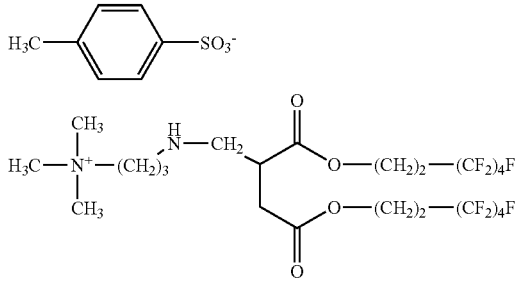
FS-19
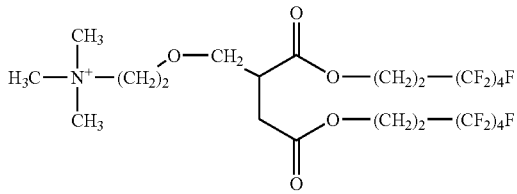
FS-20
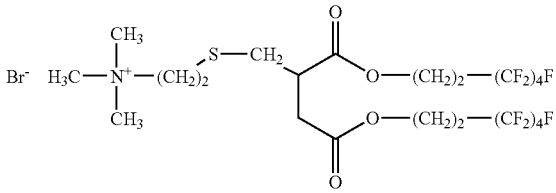

-continued
FS-21
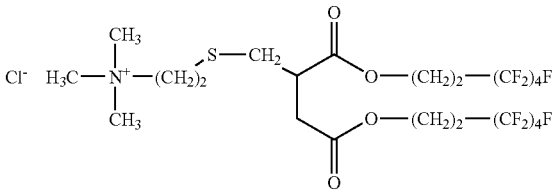
FS-22
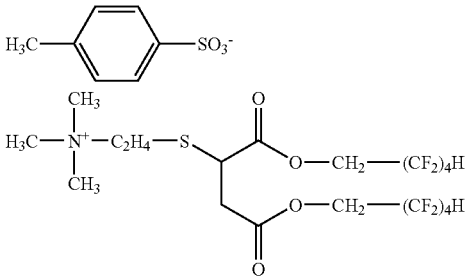
FS-23
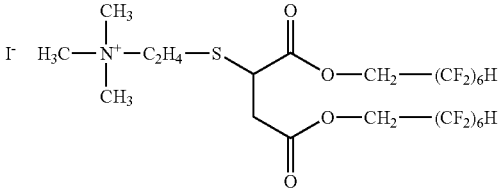
FS-24
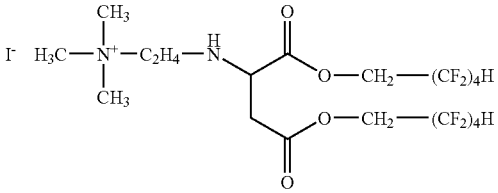
FS-25
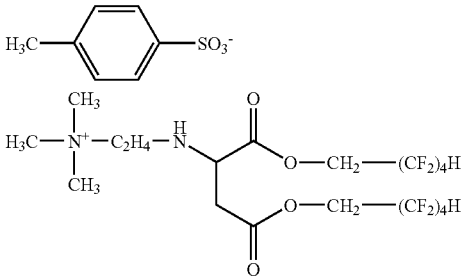
FS-26
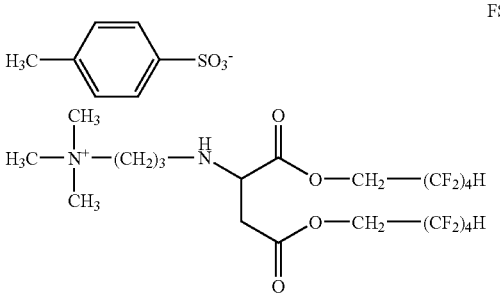
FS-27
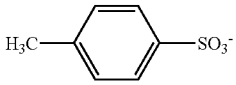
-continued
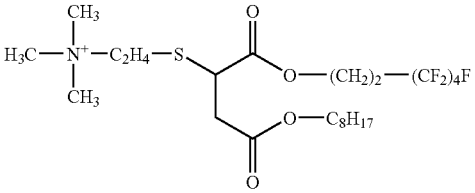
FS-28
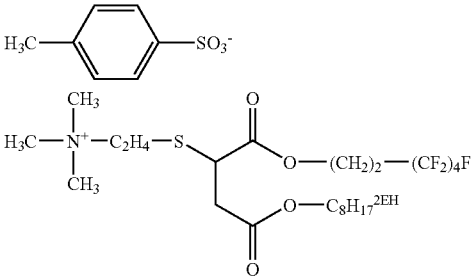
FS-29
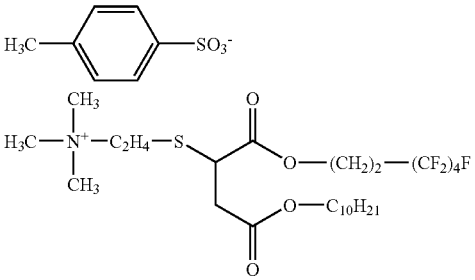
FS-30
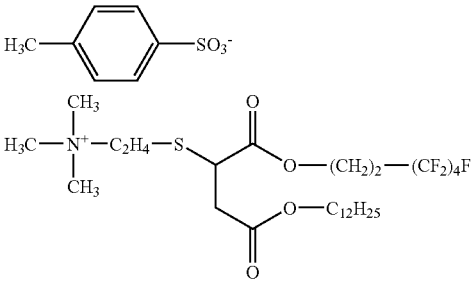
FS-31
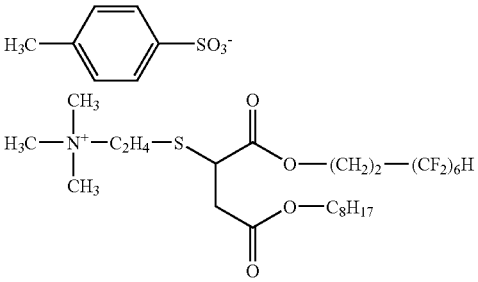
FS-32
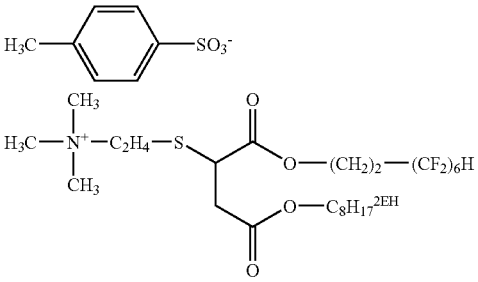

-continued
FS-33
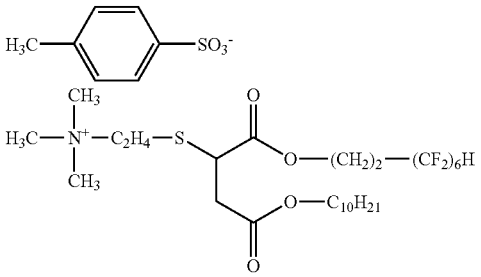
FS-34
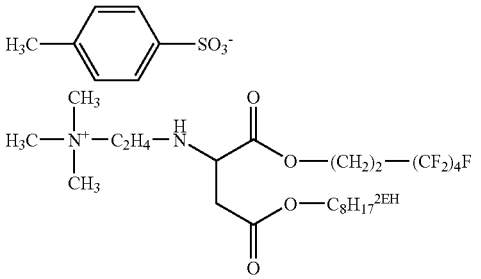
FS-35
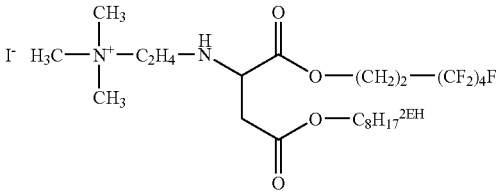
FS-36
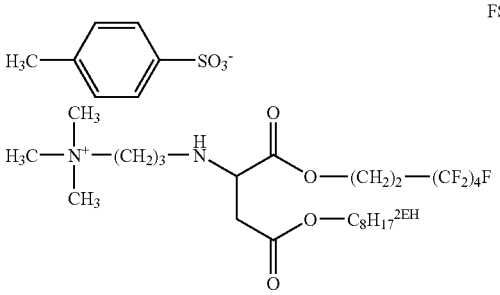
FS-37
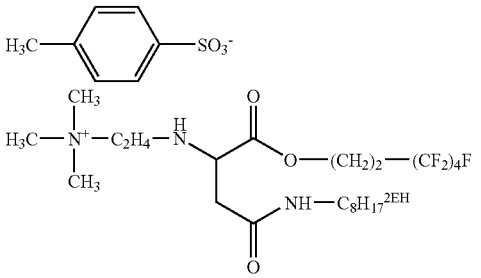
FS-38
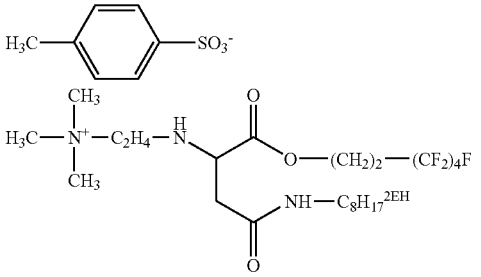
-continued
FS-39
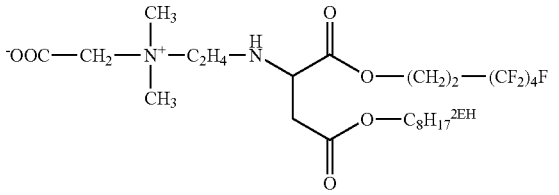
FS-40
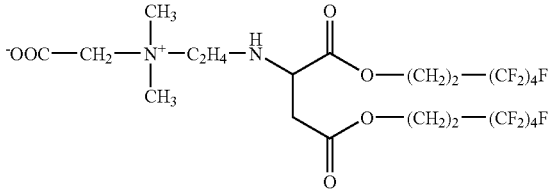
FS-41
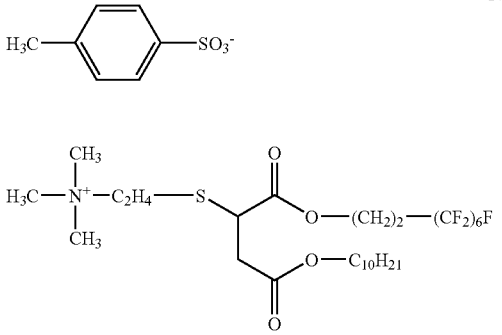
FS-42
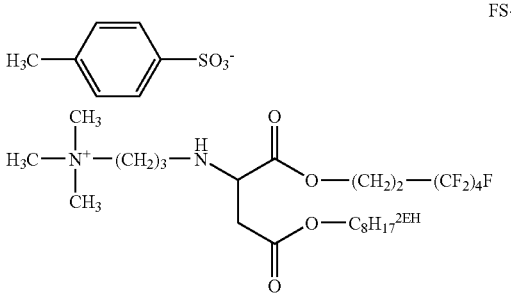
FS-43
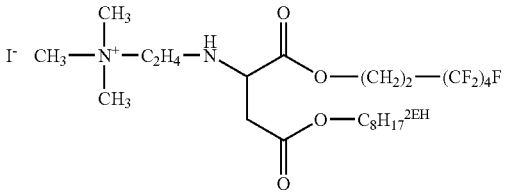
FS-44
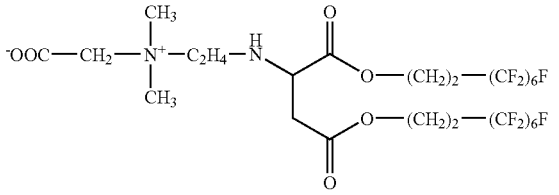

-continued
FS-45
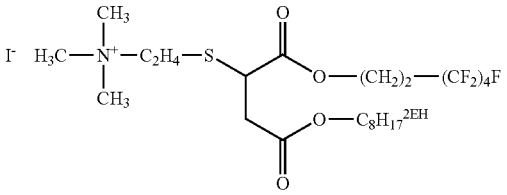
FS-46
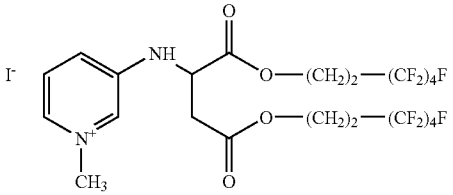
FS-47
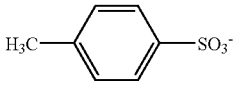
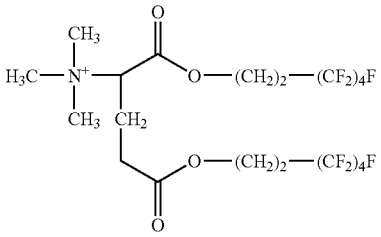
FS-48
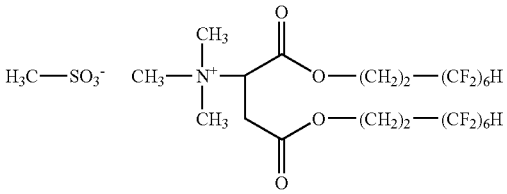
FS-49
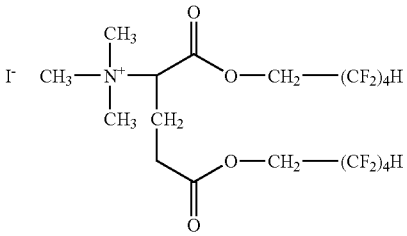
FS-50
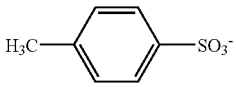
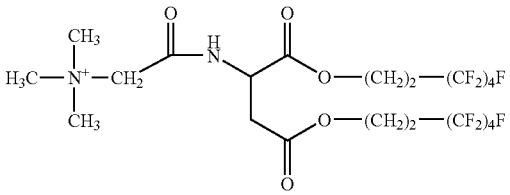
FS-51
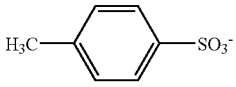
-continued
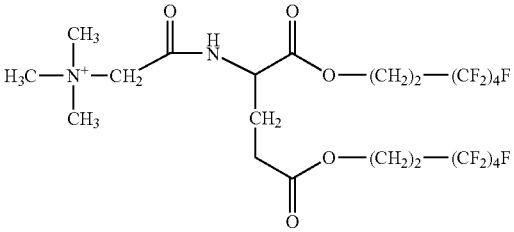
FS-52
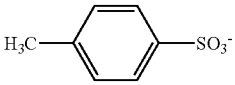
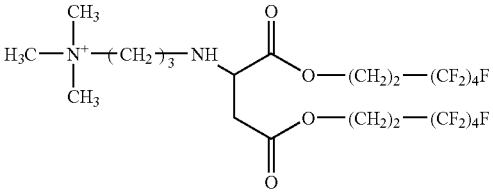
FS-53
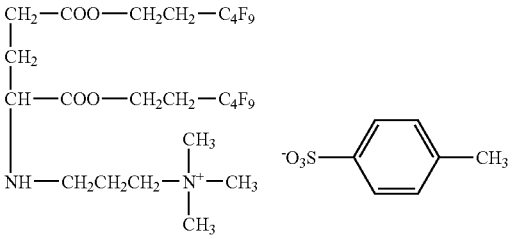
FS-54
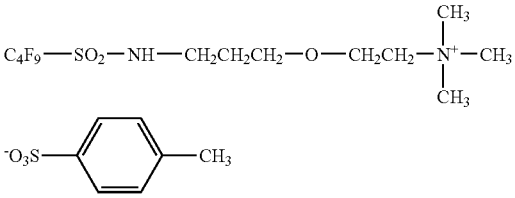
FS-55
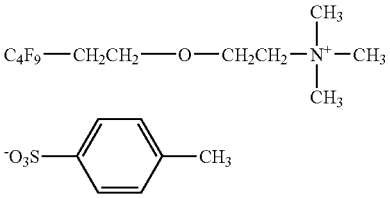
FS-56
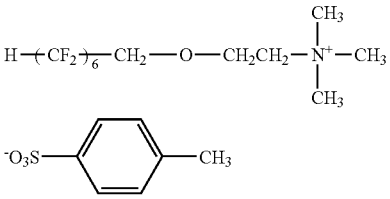
FS-57
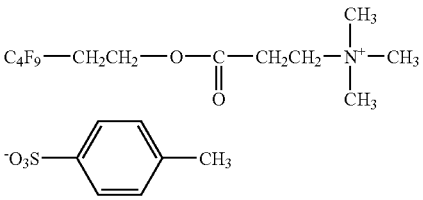

-continued

FS-58

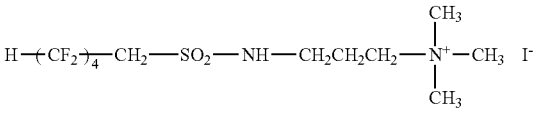

FS-59

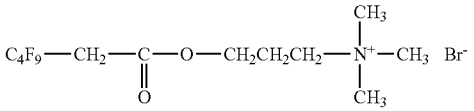

FS-60

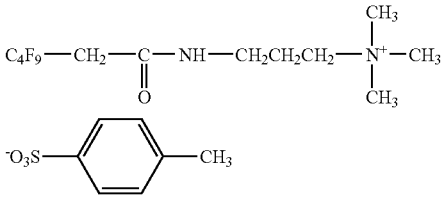

FS-61

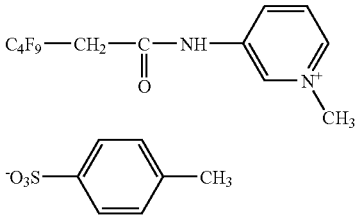

FS-62

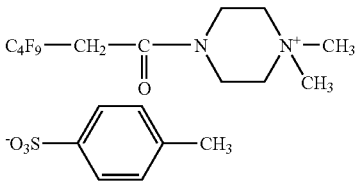

FS-63

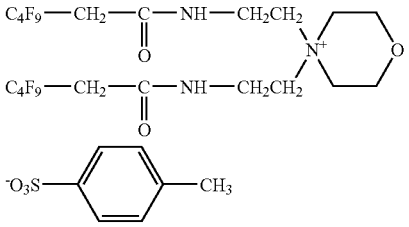

FS-64

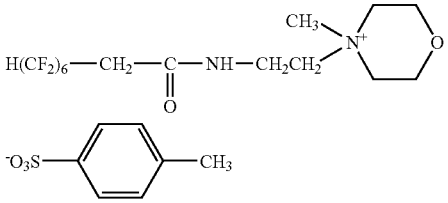

FS-65

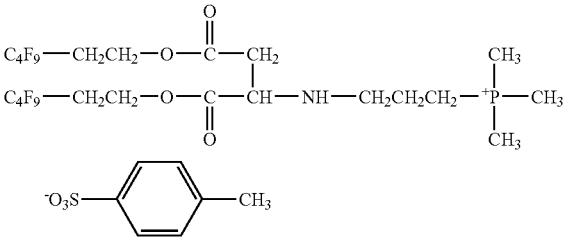

-continued

FS-66

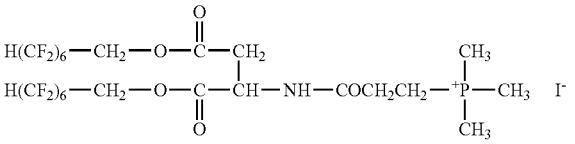

FS-67

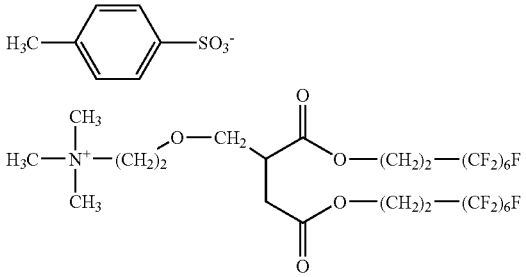

FS-68

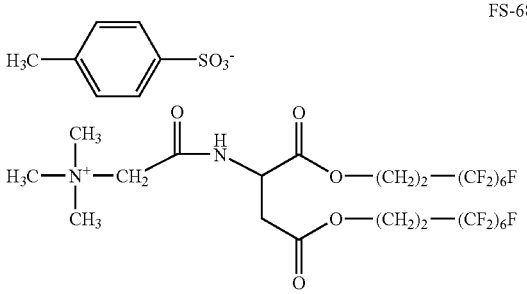

FS-69

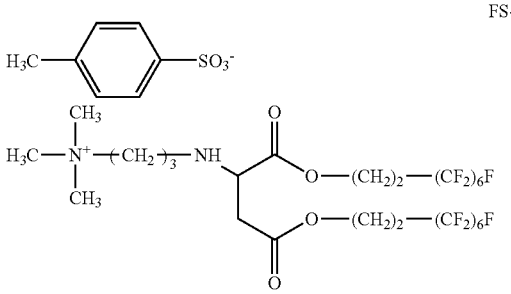

Examples of a general synthesis method for the compounds represented by the general formulae (1) and (1-a) are shown below, but the invention is not limited thereto.

The compound of the invention can be synthesized by using a fumaric acid derivative, a maleic acid derivative, an itaconic acid derivative, a glutamic acid derivative or an aspartic acid derivative as a raw material. For example, in the case where a fumaric acid derivative, a maleic acid derivative or an itaconic acid derivative is used as a raw material, it can be synthesized in such a manner that the double bond thereof is subjected to a Michel's addition reaction with a nucleophilic species, and then cationized with an alkylating agent.

The fluorine compound of the invention may have an anionic hydrophilic group.

The anionic hydrophilic group herein means an acidic group having pKa of 7 or less, and an alkali metal salt and an ammonium salt thereof. Specific examples thereof include a sulfo group, a carboxyl group, a phosphonic acid group, a carbamoylsulfamoyl group, a sulfamoylsulfamoyl group, an acylsulfamoyl group, and salts thereof. Among these, a sulfo group, a carboxyl group, a phosphonic acid group and salts thereof are preferred, and a sulfo group and a salt thereof are more preferred. Examples of a cationic species for forming the salt include lithium, sodium, potassium, cesium, ammonium, tetramethylammonium, tetrabutylammonium and methylpyridinium, and preferably lithium, sodium, potassium and ammonium.

Preferred examples of the fluorine compound having an anionic hydrophilic group in the invention include a compound represented by the following general formula (3).

General formula (3)

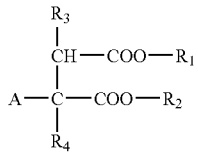

In the general formula (3), $R^1$ and $R^2$ each independently represents an alkyl group, provided that at least one of them represents Rf. In the case where $R^1$ and $R^2$ each represents an alkyl group other than a fluoroalkyl group, they are preferably an alkyl group having from 2 to 18 carbon atoms, and more preferably an alkyl group having from 4 to 12 carbon atoms. $R^3$ and $R^4$ each independently represents a hydrogen atom or a substituted or unsubstituted alkyl group.

Specific examples of the fluoroalkyl group represented by $R^1$ and $R^2$ include the aforementioned fluoroalkyl groups, preferred structures of which similarly include those represented by the general formula (A). Further preferred structures thereof among these are also the same as those described for the aforementioned fluoroalkyl groups. It is preferred that both the alkyl groups represented by $R^1$ and $R^2$ are the aforementioned fluoroalkyl groups.

The substituted or unsubstituted alkyl group represented by $R^3$ and $R^4$ may be linear or branched, or may have a cyclic structure. The substituent is not particularly limited, and preferred examples thereof include an alkenyl group, an aryl group, an alkoxy group, a halogen atom (preferably Cl), a carboxylate ester group, a carbonamide group, a carbamoyl group, an oxycarbonyl group and a phosphate ester group.

A represents $—L_b—SO_3M$, wherein M represents a cation. Preferred examples of the cation represented by M include an alkali metal ion (such as a lithium ion, a sodium ion and a potassium ion), an alkaline earth metal ion (such as a barium ion and a calcium ion), and an ammonium ion. Among these, a lithium ion, a sodium ion, a potassium ion and an ammonium ion are preferred, and a lithium ion, a sodium ion and a potassium ion are more preferred, which may be appropriately selected depending on the total carbon number, the substituents and the extent of branch of the alkyl group of the compound represented by the general formula (3). In the case where the total carbon number of $R^1$, $R^2$, $R^3$ and $R^4$ is 16 or more, M is preferably a lithium ion from the standpoint of fulfillment of the solubility (particularly solubility in water), the antistatic property and the coating uniformity.

$L_b$ represents a single bond or a substituted or unsubstituted alkylene group. The substituent is preferably those described for $R^3$. In the case where $L_b$ is an alkylene group, the carbon number thereof is preferably 2 or less. $L_b$ is preferably a single bond or a $—CH_2—$ group, and most preferably a $—CH_2—$ group.

In the general formula (3), it is preferred that the aforementioned preferred embodiments are combined.

Specific examples of the fluorine compound having an anionic hydrophilic group are shown below, but the invention is not limited to the example compounds.

In the following structural formulae of the example compounds, all the alkyl groups and perfluoroalkyl groups have linear structure unless otherwise indicated.

(F-1)

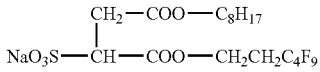

(F-2)

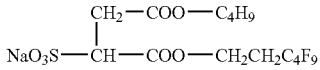

(F-3)

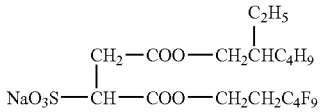

(F-4)

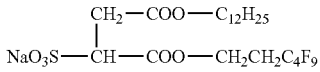

(F-5)

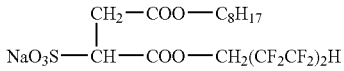

(F-6)

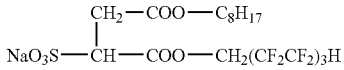

(F-7)

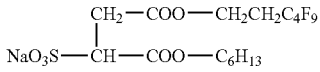

(F-8)

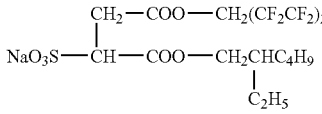

(F-9)

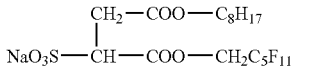

(F-10)

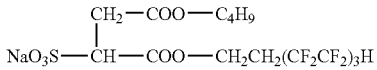

(F-11)

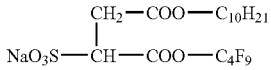

(F-12)

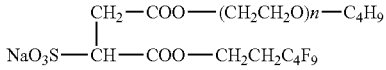

n = 5 ~ 15

(F-13)

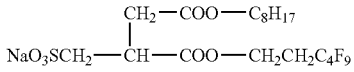

(F-14)

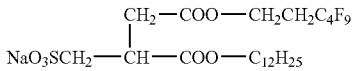

(F-15)

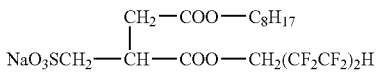

-continued
(F-16)
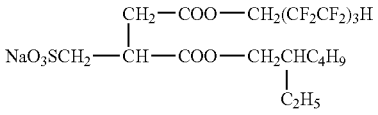
(F-17)
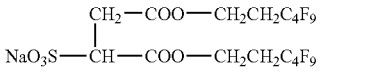
(F-18)
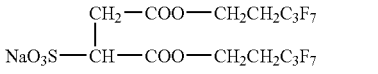
(F-19)
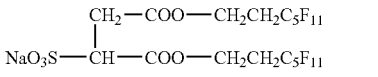
(F-20)
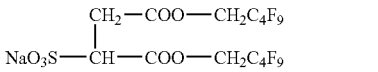
(F-21)
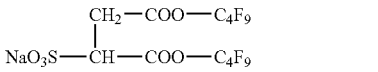
(F-22)
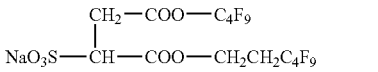
(F-23)
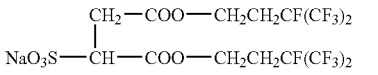
(F-24)
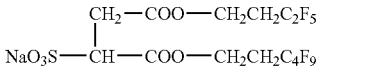
(F-25)
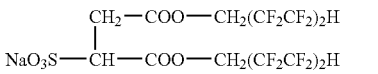
(F-26)
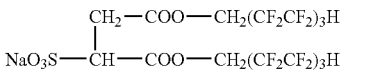
(F-27)
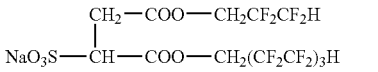
(F-28)
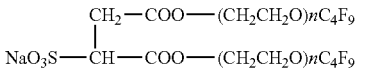
n = 5 ~ 15
(F-29)
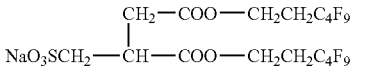
(F-30)
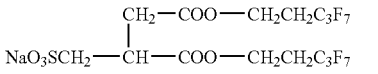
(F-31)
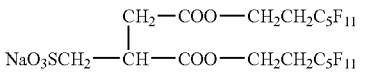
(F-32)
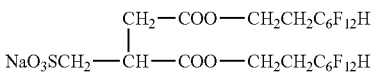
(F-33)
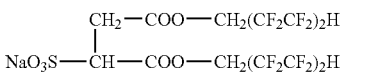
-continued
(F-34)
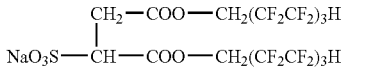
(F-35)
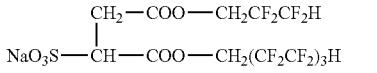
(F-36)
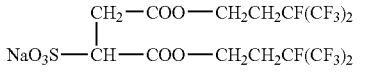
(F-37)
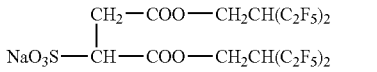
(F-38)
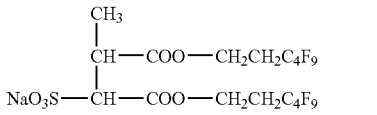
(F-39)
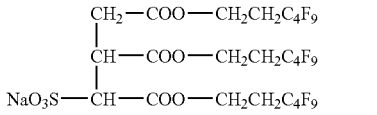
(F-40)
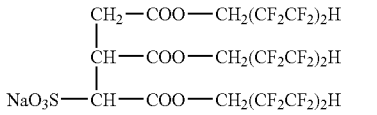
(F-41)
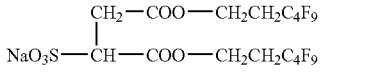
(F-42)
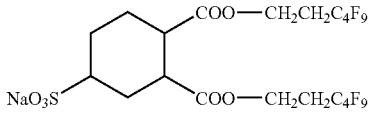
(F-43)
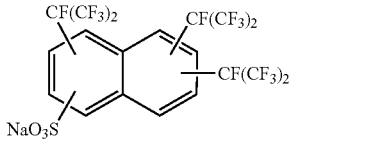
(F-44)
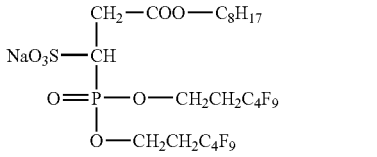
(F-45)
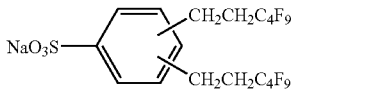
(F-46)
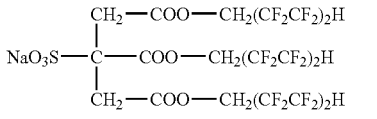
(F-47)
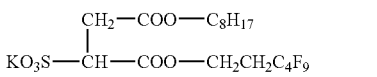

-continued (F-48)

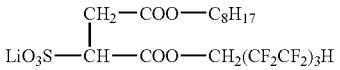

(F-49)

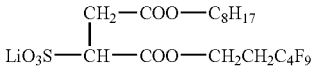

(F-50)

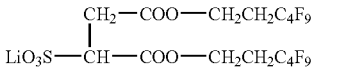

(F-51)

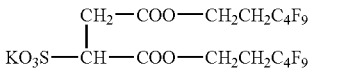

(F-52)

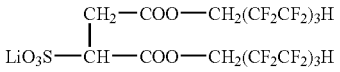

(F-53)

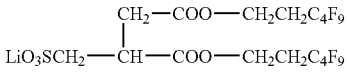

(F-54)

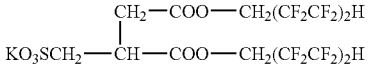

(F-55)

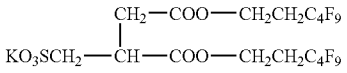

(F-56)

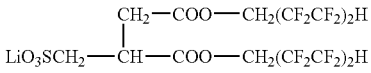

(F-57)

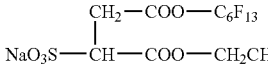

(F-58)

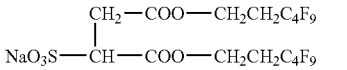

(F-59)

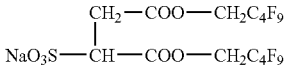

(F-60)

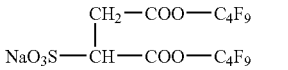

(F-61)

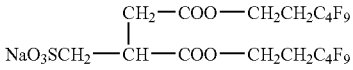

The fluorine compound of the invention may have a nonionic hydrophilic group.

The nonionic hydrophilic group herein means such a group that is dissolved without dissociation into an ion. Specific examples thereof include a poly(oxyethylene)alkyl ether and a polyhydric alcohol, but the invention is not limited thereto.

Preferred examples of the fluorine compound having a nonionic nature include a compound represented by the following general formula (4).

General formula (4).

In the general formula (4), Rf represents the aforementioned fluoroalkyl group, specific examples of which include those described in the foregoing, and preferred structures thereof are similarly those represented by the general formula (A). Preferred examples of the structure include those described for Rf.

In the general formula (4), X represents a divalent linking group, which is not particularly limited, and examples thereof include the following groups.

—O— —S—

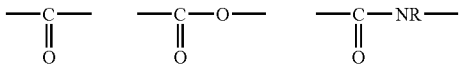

—$SO_2$NR—

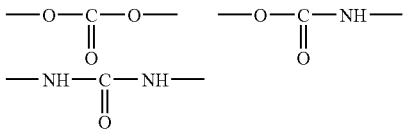

—$SO_2$— —SO—

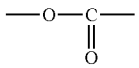

—NR—$SO_2$— —NR—CO—

In the general formula (4), n is 2 or 3, and m represents an integer of from 1 to 30. R represents a hydrogen atom, an alkyl group, an aryl group, a heterocyclic group, Rf or a group having at leastoning agentf as a substituent.

Specific examples of the fluorine compound having a nonionic nature are shown below, but the invention is not limited to the example compounds.

FN-1 $C_4F_9CH_2CH_2O—(CH_2CH_2O)_n—H$ n=5~15

FN-2 $H(CF_2)_6CH_2O—(CH_2CH_2O)_n—H$ n=5~15

FN-3 $C_4F_9CH_2COO—(CH_2CH_2O)_n—H$ n=5~15

FN-4 $C_4F_9CH_2CONH—(CH_2CH_2O)_n—H$ n=5~15

FN-5 $C_4F_9CH_2SO_2NH—(CH_2CH_2O)_n—H$ n=5~15

FN-6 $C_4F_9CH_2CH_2NHCOO—(CH_2CH_2O)_n—H$ n=5~15

FN-7

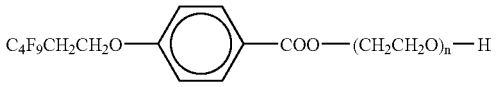

n = 5 ~ 15

FN-8 $H(CF_2)_4CH_2O—(CH_2CH_2CH_2O)_n—H$ n=5~15

FN-9

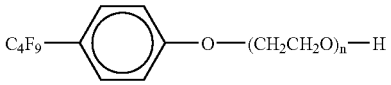

n = 5 ~ 15

FN-10 $C_4F_9CH_2CH_2O—(CH_2CH_2O)_{n1}—(CH_2CH_2CH_2O)_{n2}—(CH_2CH_2O)_{n3}—H$ n1=5~10 n2=5~10 n3=5~10

FN-11 $C_4F_9CH_2CH_2O—(CH_2CH_2O)_n—CH_3$ n=10~20

FN-12 $C_4F_9CH_2CH_2O—(CH_2CH_2O)_n—C_4H_9$ n=10~20

FN-13 $C_4F_9CH_2CH_2O—(CH_2CH_2O)_n—CH_2CH_2C_4F_9$ n=10~20

FN-14

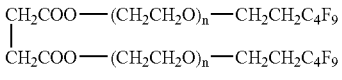

n = 5 ~ 10

FN-15

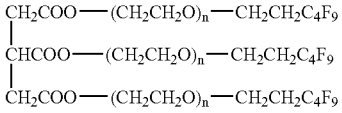

n = 5 ~ 10

FN-16

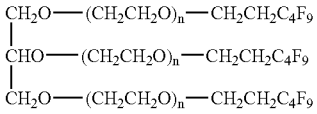

n = 5 ~ 10

FN-17 $H—C_6F_{12}CH_2O—(CH_2CH_2O)_n—CH_2C_6F_{12}—H$ n=5~10

FN-18

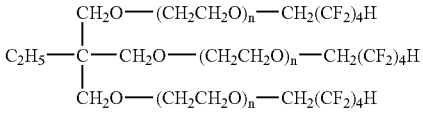

n = 5 ~ 10

FN-21 $C_6F_{13}CH_2CH_2O—(CH_2CH_2O)_n—CH_2CH_2C_6F_{13}$ n=10~20

FN-19 $C_6F_{13}CH_2CH_2O—(CH_2CH_2O)_n—H$ n=5~15

FN-20

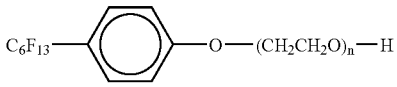

n = 5 ~ 15

The compound having the particular fluoroalkyl group used in the invention can be preferably used as a surface active agent in a coating composition for forming layers constituting the photosensitive material (particularly, a protective layer, an undercoating layer and a back layer). It is particularly preferred that the compound is used as the outermost layer among these of the photosensitive material since antistatic property and coating uniformity can be effectively obtained. Furthermore, it has been found that the structure according to the invention is effective for improvements of the storage stability and the environment dependency, which are the objects of the invention. In order to obtain the effects, it is preferred that the fluorine compound of the invention is used in the outermost layer of the side of the image forming layer or the side of the back layer. The same effects can also be obtained by using the compound in the undercoating layer on the support.

The using amount of the particular fluorine compound in the invention is not particularly limited, and it can be arbitrarily determined depending on the structure and the addition position of the fluorine compound, and the species and the amounts of the other components contained in the composition. For example, the coating amount of the fluorine compound in the coating composition is preferably from 0.1 to 100 $mg/m^2$, and more preferably from 0.5 to 20 $mg/m^2$.

In the invention, the particular fluorine compound may be used solely or may be used as a mixture of two or more thereof.

(Description of Photosensitive Silver Halide)

(1) Halogen Composition

It is important that the photosensitive silver halide used in the invention has a high silver iodide content of from 40 to 100% by mole. The balance thereof is not particularly limited, and can be appropriately selected from silver chloride, silver bromide and an organic silver salt, such as silver thiocyanate and silver phosphate, with silver bromide and silver chloride being preferred. By using the silver halide having a high silver iodide content, such a preferred photothermographic material can be designed that is excellent in storage stability after development, particularly that is significantly small in increase of fogging due to irradiation with light.

The silver iodide content is preferably from 80 to 100% by mole, further preferably from 85 to 100% by mole, and particularly preferably from 90 to 100% by mole, from the standpoint of image storage stability under irradiation of light after processing.

The distribution of the halogen composition inside the particle may be uniform, may be changed stepwise, or may be continuously changed. Silver halide particles having a core/shell structure are also preferably used. Examples of the preferred structure of the core/shell particles include two- to five-layer structures, and more preferably two- to four-layer structures. A high silver iodide core structure where the core has a high silver iodide content and a high silver iodide shell structure where the shell has a high silver iodide content can be preferably used. Such a technique is also preferably used in that silver chloride or silver bromide is localized as an epitaxial part on the surface of the particles.

(2) Particle Size

The particle size of the silver halide having a high silver halide content used in the invention is particularly important. In the case where the size of the silver halide is too large, the coating amount of the silver halide that is necessary for attaining the maximum optical density is increased. The inventors have found that in the case where the coating amount of the silver halide having a high silver iodide content preferably used in the invention is large, it is not preferred since the development is significantly inhibited to be desensitized, and the optical density is deteriorated in stability with respect to the development time, whereby the maximum optical density cannot be obtained with a prescribed development time by using a particle size that is larger than a certain value. It is also found that in the case where the addition amount thereof is suppressed, on the other hand, a sufficient development property can be obtained even with silver iodide.

Accordingly, in the case where a silver halide having a high silver iodide content is used, it is necessary that the size of the silver halide particles is sufficiently small to attain a sufficient optical density, in comparison to the conventional silver bromide and silver iodobromide having a low silver iodide content. The particle size of the silver halide is preferably from 5 to 70 nm, more preferably from 5 to 55 nm, and particularly preferably from 10 to 45 nm. The particle size herein means an average value of diameters of circles having the same areas as projected areas obtained by observation with an electron microscope.

(3) Coating Amount

The coating amount of the silver halide particles is generally from 0.5 to 15% by mole, preferably from 0.5 to 12% by mole, more preferably from 0.5 to 10% by mole, further preferably from 1 to 9% by mole, and particularly preferably from 1 to 7% by mole, per 1 mole of the non-photosensitive organic silver salt described later. In order to suppress the significant development inhibition due to silver halide having a high silver iodide content, which is found by the inventors, the selection of the addition amount is a vital factor.

(4) Method for forming Particles

The method for forming photosensitive silver halide has been well known in this field of art, and for example, methods described in Research Disclosure, No. 17029, June of 1978 and U.S. Pat. No. 3,700,458 can be used. Specifically, such a method may be employed in that a silver supplying compound and a halogen supplying compound are added to a polymer solution, such as gelatin, to prepare a photosensitive silver halide, which is then mixed with an organic silver salt. Preferred examples of the method also include a method described in paragraphs 0217 to 0224 of JP-A No. 11-119374 and methods described in JP-A Nos. 11-352627 and 2000-347335.

(5) Shape of Particles

Examples of the shape of the silver halide particles in the invention include a cuboidal shape, an octahedral shape, a dodecahedral shape, a tetradecahedral shape, a tabular shape, a spherical shape, a rod shape and a potato-like shape, and a dodecahedral shape and a tetradecahedral shape are preferred in the invention. The dodecahedral particle herein means a particle having (001), {1(−1)0} and {101} planes, and the tetradecahedral particle herein means a particle having (001), {100} and {101} planes. The expression {100} herein means a group of crystalline planes having plane indices that are equivalent to the (100) plane. The silver iodide in the invention may have arbitrary β-phase and γ-phase contents. The β-phase herein means a high silver iodide structure having a wurtzite structure of a hexagonal crystal system, and the γ-phase herein means a high silver iodide structure having a zinc blende structure of a cubic crystal system.

The average γ-phase proportion herein is determined by the method proposed by C. R. Berry. The method determines the proportion based on a peak ratio of β-phase (100), (101) and (002) and the γ-phase (111) of the silver iodide in the powder X-ray diffraction method, and details thereof are found in Physical Review, vol. 161, No. 3, p. 848 to 851 (1967).

As a method for forming tabular particles of silver iodide, methods described in JP-A Nos. 59-119350 and 59-119344 are preferably employed.

The silver halide having a high silver iodide content in the invention may have a complex conformation, and preferred examples of the conformation include a junction particle shown in R. L. Jenkins, et al., J. of Phot. Sci., vol. 28, p. 164 and FIG. 1 (1980). Tabular particles shown in FIG. 1 of the literature are also preferably used. Silver halide particles having rounded corners can also be preferably used. The plane indices of the outer surface of the photosensitive silver halide particles (Miller's indices) are not particularly limited, and the proportion of the [100] plane is preferably high since it exerts a high spectral sensitization efficiency upon absorption of a spectral sensitizing dye. The proportion thereof is preferably 50% or more, more preferably 65% or more, and further preferably 80% or more. The Miller's indices and the proportion of the [100] plane can be obtained by the method utilizing the adsorption dependency of the [111] plane and the [100] plane described in T. Tani, J. Imaging Sci., vol. 29, p. 165 (1985).

(6) Heavy Metal

The photosensitive silver halide particles in the invention may contain a metal of Groups 8 to 10 in the periodic table (showing Groups 1 to 18) or a metallic complex. Preferred examples of the metal of Groups 8 to 10 and the central metal of the metallic complex include rhodium, ruthenium and iridium. The metallic complex may be used solely or in combination of two or more kinds of complexes having the same metallic species or different metallic species. The content thereof is preferably in a range of from $1\times10^{-9}$ to $1\times10^{-3}$ mole per 1 mole of silver. The heavy metal, the metallic complex and the addition method thereof are described in JP-A No. 7-225449, paragraphs 0018 to 0024 of JP-A No. 11-65021 and paragraphs 0227 to 0240 of JP-A No. 11-119374.

In the invention, silver halide particles having a hexacyano metallic complex present on the outermost surface of the particles are preferred. Examples of the hexacyano metallic complex include $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$ and $[Re(CN)_6]^{3-}$. In the invention, a hexacyano Fe complex is preferred.

A counter cation is not so important because the hexacyano metallic complex is present in the form of ion in an aqueous solution, but is preferably those miscible with water and suitable for precipitation operation of a silver halide emulsion, examples of which include an alkali metal ion, such as a sodium ion, a potassium ion, a rubidium ion, a cesium ion and a lithium ion, an ammonium ion, and an alkylammonium ion (such as a tetramethylammonium ion, a tetraethylammonium ion, a tetrapropylammonium ion and a tetra(n-butyl)ammonium ion).

The hexacyano metallic complex may be added after mixing with water, a mixed solvent of water with a suitable water miscible organic solvent (such as an alcohol compound, an ether compound, a glycol compound, a ketone compound, an ester compound and an amide compound), or gelatin.

The addition amount of the hexacyano metallic complex is preferably from $1\times10^{-5}$ to $1\times10^{-2}$ mole, and more preferably from $1\times10^{-4}$ to $1\times10^{-3}$ mole, per 1 mole of silver.

In order to make the hexacyano metallic complex present on the outermost surface of the silver halide particles, the hexacyano metallic complex is directly added before completing the preparing step, which is after completing the addition of a silver nitrate aqueous solution used for forming particles but before the chemical sensitization step for attaining chalcogen sensitization, such as sulfur sensitization, selenium sensitization and tellurium sensitization, and noble metal sensitization, such as gold sensitization, or is directly added during the water washing step, during the dispersing step or before the chemical sensitizing step. The hexacyano metallic complex is preferably added immediately after forming the particles in order to prevent the silver halide particles from growing, and it is preferably added before completing the preparing step.

The addition of the hexacyano metallic complex may be started after adding 96% by mass of the total amount of silver nitrate added for forming the particles, and is preferably started after adding 98% by mass thereof, and more preferably after adding 99% by mass thereof.

In the case where the hexacyano metallic complex is added after adding a silver nitrate aqueous solution that is added immediately before completing the particle formation, the complex can be adsorbed on the outermost surface of the silver halide particles, and the most proportion thereof forms an hardly soluble salt with silver ions on the surface of the particles. Because the silver salt of hexacyano iron(II) is hardly soluble in comparison to AgI, redissolution due to fine particles can be prepvented, and thus silver halide fine particles having a small particle diameter can be produced.

A metallic atom (for example, $[Fe(CN)_6]^{4-}$) that may be contained in the silver halide particles used in the invention, a desalting method and a chemical sensitization method for the silver halide particles are described in paragraphs 0046 to 0050 of JP-A No. 11-84574, paragraphs 0025 to 0031 of JP-A No. 11-65021, and paragraphs 0242 to 0250 of JP-A No. 11-119374.

(7) Gelatin

Gelatin contained in the photosensitive silver halide emulsion used in the invention may be various kinds of gelatin. In order to maintain good dispersion conditions of the photosensitive silver halide emulsion in a coating composition containing an organic silver salt, gelatin having a low molecular weight of from 500 to 60,000 is preferably used. The low molecular weight gelatin may be used upon forming the particles or upon dispersing after the desalting treatment, and is preferably used upon dispersion after the desalting treatment.

(8) Chemical Sensitization

The photosensitive silver halide used in the invention may not be chemically sensitized but is preferably chemically sensitized by at least one method of a chalcogen sensitization method, a gold sensitization method and a reduction sensitization method. Examples of the chalcogen sensitization method include a sulfur sensitization method, a selenium sensitization method and a tellurium sensitization method.

In the sulfur sensitization method, an unstable sulfur compound is used, and unstable sulfur compounds described in P. Grafkides, Chimie et Physique Photographique, 5th edition (published by Paul Momtel Inc. (1987)) and Research Disclosure, vol. 307, No. 307105 may be used.

Specific examples of the usable sulfur compounds include known sulfur compounds, such as a thiosulfate (such as hypo), a thiourea compound (such as diphenylthiourea, triethylthiourea, N-ethyl-N'-(4-methyl-2-thiazolyl)thiourea and carboxymethyltrimethylthiourea), a thioamide compound (such as thioacetamide), a rhodanine compound (such as diethylrhodanine and 5-benzylidene-N-ethylrhodanine), a phosphine sulfide compound (such as trimethylphosphine sulfide), a thiohydantoin compound, a 4-oxo-oxazolidine-2-thione compound, a disulfide compound and a polysulfide compound (such as dimorpholinedisulfide, cystine and hexathiocane-thione), a polythionic acid salt and elemental sulfur, and activated gelatin. In particular, a thiosulfate, a thiourea compound and a rhodanine compound are preferred.

In the selenium sensitization method, an unstable selenium compound is used, and selenium compounds described in JP-B Nos. 43-13489 and 44-15748, and JP-A Nos. 4-25832, 4-109340, 4-271341, 5-40324, 5-11385, 6-051415, 6-175258, 6-180478, 6-208186, 6-208184, 6-317867, 7-092599, 7-098483 and 7-140579 may be used.

Specific examples of the usable selenium compounds include colloidal metallic selenium, a selenourea (such as N,N-dimethylselenourea, trifluoromethylcarbonyl-trimethylselenourea and acetyl-trimethylselenourea), a selenoamide compound (such as selenoamide and N,N-diethylphenylselenoamide), a phosphine selenide compound (such as triphenylphosphine selenide and pentafluorophenyl-triphenylphosphine selenide), a selenophsphate compound (such as tri-p-tolyl selenophosphate and tri-n-butyl selenophosphate), a selenoketone compound (such as selenobenzophenone), an isoselenocyanate compound, a selenocarboxylic acid compound, a selenoester compound and a diacylselenide compound. Unstable selenium compounds described in JP-B Nos. 46-4553 and 52-34492, such as selenious acid, a selenocyanate salt, a selenazole compound and a selenide compound, may also be used. In particular, a phosphine selenide compound, a selenourea compound and a selenocyanate salt are preferred.

In the tellurium sensitization method, an unstable tellurium compound is used, and unstable tellurium compounds described in JP-A Nos. 4-224595, 4-271341, 4-333043, 5-303157, 6-27573, 6-175258, 6-180478, 6-208186, 6-208184, 6-317867, 7-140579, 7-301879 and 7-301880 may be used.

Specific examples of the usable tellurium compounds include a phosphine telluride compound (such as butyldiisopropylphosphine telluride, tributylphosphine telluride, tributoxyphosphine telluride and ethoxydiphenylphosphine telluride), a diacyl (di)telluride compound (such as bis(diphenylcarbamoyl)ditelluride, bis(N-phenyl-N-methylcarbamoyl)ditelluride, bis(N-phenyl-N-methylcarbamoyl)telluride, bis(N-phenyl-N-benzylcarbamoyl)telluride and bis(ethoxycarbonyl)telluride), a tellurourea compound (such as N,N'-dimethylethylenetellurourea and N,N'-diphenylethylenetellurourea), a telluroamide compound, and a telluroester compound. In particular, a diacyl (di)telluride compound and a phosphine telluride compound are preferred, and compounds described in the literatures shown in paragraph 0030 of JP-A No. 11-65021 and compounds shown by the general formulae (II), (III) and (IV) in JP-A No. 5-313284 are more preferred.

In the chalcogen sensitization method in the invention, a selenium sensitization method and a tellurium sensitization method are preferred, and a tellurium sensitization method is particularly preferred.

In the gold sensitization method, gold sensitizers described in P. Grafkides, Chimie et Physique Photographique, 5th edition (published by Paul Momtel Inc. (1987)) and Research Disclosure, vol. 307, No. 307105 can be used. Specific examples thereof include chlorauric acid, potassium chloroaurate, potassium aurothiocyanate, gold sulfate and gold selenide, and in addition thereto, gold compounds described in U.S. Pat. Nos. 2,642,361, 5,049,484, 5,049,485, 5,169,751 and 5,252,455 and Belgian Patent No. 691,857 may also be used. Noble metallic salts other than gold, such as platinum, palladium and indium, described in P. Grafkides, Chimie et Physique Photographique, 5th edition (published by Paul Momtel Inc. (1987)) and Research Disclosure, vol. 307, No. 307105 can also be used.

The gold sensitization method may be used solely but is preferably used in combination with the chalcogen sensitization method. Specific examples thereof include gold-sulfur sensitization, gold-selenium sensitization, gold-tellurium sensitization, gold-sulfur-selenium sensitization, gold-sulfur-tellurium sensitization, gold-selenium-tellurium sensitization and gold-sulfur-selenium-tellurium sensitization.

In the invention, the chemical sensitization may be carried out on any occasion after forming the particles and before coating, and examples of the occasion include after desalting, (1) before spectral sensitization, (2) simultaneous with spectral sensitization, (3) after spectral sensitization and (4) immediately before coating.

The using amount of the chalcogen sensitizer used in the invention varies depending on the silver halide particles used and the chemical ripening conditions, and is generally from $10^{-8}$ to $10^{-1}$ mole, and preferably from $10^{-7}$ to $10^{-2}$ mole, per 1 mole of silver halide.

The addition amount of the gold sensitizing agent used in the invention similarly varies depending on various conditions, and is, as rough standard, preferably from $10^{-7}$ to $10^{-2}$ mole, and more preferably from $10^{-6}$ to $5\times10^{-3}$ mole, per 1 mole of silver halide. While the environmental conditions where the emulsion is chemically sensitized may be selected any condition, such conditions are preferred that pAg is 8 or less, preferably 7.0 or less, more preferably 6.5 or less, and particularly preferably 6.0 or less, and pAg is 1.5 or more, preferably 2.0 or more, and particularly preferably 2.5 or more. The pH is generally from 3 to 10, and preferably 4 to 9, and the temperature is generally from 20 to 95° C., and preferably from 25 to 80° C.

In the invention, reduction sensitization may be employed in addition to chalcogen sensitization and gold sensitization. In particular, it is preferably used in combination with chalcogen sensitization.

Preferred examples of the specific compound for the reduction sensitization method include ascorbic acid, thiourea dioxide and dimethylamine-borane, and additionally, stannous chloride, aminoiminomethanesulfinic acid, a hydrazine derivative, a borane compound, a silane compound and a polyamine compound may be preferably used. The reduction sensitizer may be added in any occasion in the production process of the photosensitive emulsion from crystal growth to immediately before coating. The reduction sensitization is preferably carried out by ripening the emulsion at the pH of the emulsion maintained at 8 or more or the pAg thereof maintained at 4 or less, and the reduction sensitization is also preferably carried out by introducing a single addition part of silver ion during the formation of the particles.

The addition amount of the reduction sensitizer varies depending on various conditions, and is generally from $10^{-7}$ to $10^{-1}$ mole, and preferably from $10^{-6}$ to $5\times10^{-2}$ mole, per 1 mole of silver halide.

A thiosulfonic acid compound may be added to the silver halide emulsion used in the invention according to a method described in EP-A No. 293,917.

The photosensitive silver halide particles in the invention is preferably chemically sensitized by at least one of gold sensitization and chalcogen sensitization from the standpoint for designing a photothermographic material having high sensitivity.

(9) Compound Forming One-electron Oxidant by One-electron Oxidation Capable of Releasing One or More Electron The photothermographic material of the invention preferably contains a compound forming a one-electron oxidant by one-electron oxidation capable of releasing one or more electron. The compound is used solely or in combination with the various kinds of chemical sensitizers described in the foregoing, so as to provide increase in sensitivity of the silver halide.

The compound forming a one-electron oxidant by one-electron oxidation capable of releasing one or more electron, contained in the photothermographic compound is selected from the following types 1 to 5 compounds.

(Type 1)

A compound forms a one-electron oxidant by one-electron oxidation capable of releasing two or more electrons associated with a subsequent bond cleavage reaction.

(Type 2)

A compound forms a one-electron oxidant by one-electron oxidation capable of releasing another one electron associated with a subsequent bond cleavage reaction, and has two or more adsorbing groups to silver halide in one molecule.

(Type 3)

A compound forms a one-electron oxidant by one-electron oxidation capable of releasing one or more electron after a subsequent bond forming process.

(Type 4)

A compound forms a one-electron oxidant by one-electron oxidation capable of releasing one or more electron after a subsequent ring cleavage reaction inside the molecule.

(Type 5)

A compound represented by X—Y, wherein X represents a reductive group and Y represents a releasing group, forms a one-electron oxidant by one-electron oxidation of the reductive group represented by X capable of forming an X radical through release of Y associated with a subsequent bond cleavage reaction of the X—Y bond and releasing another one electron therefrom.

Among the compounds of types 1 and 3 to 5, a compound having an adsorbing group to silver halide inside the molecule and a compound having a partial structure of a spectral sensitizing dye inside the molecule are preferred. A compound having an adsorbing group to silver halide inside the molecule is more preferred. The compounds of types 1 to 4 are preferably a compound having, as an adsorbing group, a nitrogen-containing heterocyclic group having two or more mercapto groups substituted thereon.

The compounds of types 1 to 5 will be described in detail below.

In the compound of type 1, the bond cleavage reaction specifically means cleavage of a carbon-carbon bond, a carbon-silicon bond, a carbon-hydrogen bond, a carbon-boron bond, a carbon-tin bond and a carbon-germanium bond, and cleavage of a carbon-hydrogen bond may be further accompanied therewith. After the compound of type 1 becomes a one-electron oxidant through one-electron oxidation, the one-electron oxidant is then capable of releasing two or more (preferably three or more) electrons associated with a bond cleavage reaction.

Preferred examples of the compound of type 1 include those represented by the following general formulae (A), (B), (1), (2) and (3).

General formula (A)

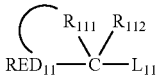

General formula (B)

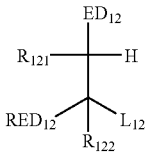

In the general formula (A), $RED_{11}$, represents a reductive group capable of being one-electron-oxidized, $L_{11}$ represents a releasing group, $R_{112}$ represents a hydrogen atom or a substituent, and $R_{111}$ represents a non-metallic atomic group capable of forming, with a carbon atom (C) and $RED_{11}$, a cyclic structure corresponding to a tetrahydro body, a hexahydro body or an octahydro body of a 5- or 6-membered aromatic ring (including an aromatic heterocyclic ring).

In the general formula (B), $RED_{12}$ represents a reductive group capable of being one-electron-oxidized, $L_{12}$ represents a releasing group, $R_{121}$ and $R_{122}$ each represents a hydrogen atom or a substituent, and $ED_{12}$ represents an electron donating group. In the general formula (B), $R_{121}$, and $RED_{12}$, $R_{121}$, and $R_{122}$, or $ED_{12}$ and $RED_{12}$ may be bonded to each other to form a cyclic structure.

The compound represented by the general formula (A) or (B), after one-electron oxidation of the reductive group represented by $RED_{11}$ or $RED_{12}$, spontaneously releases $L_{11}$ or $L_{12}$ by a bond cleavage reaction, whereby two or more electrons, and preferably three or more electrons, can be released associated therewith.

General formula (1)

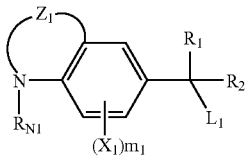

-continued

General formula (2)

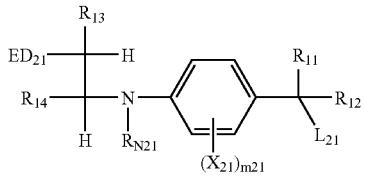

General formula (3)

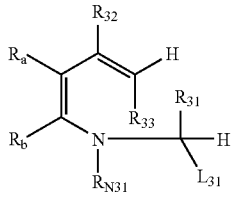

In the general formula (1), $Z_1$ represents an atomic group capable of forming a 6-membered ring with a nitrogen atom and two carbon atoms of a benzene ring, $R_1$, $R_2$ and $R_{N1}$ each represents a hydrogen atom or a substituent, $X_1$ represents a substituent capable of being substituted on a benzene ring, $m_1$ represents an integer of from 0 to 3, and $L_1$ represents a releasing group. In the general formula (2), $ED_{21}$ represents an electron donating group, $R_{11}$, $R_{12}$, $R_{N21}$, $R_{13}$ and $R_{14}$ each represents a hydrogen atom or a substituent, $X_{21}$ represents a substituent capable of being substituted on a benzene ring, $m_{21}$ represents an integer of from 0 to 3, and $L_{21}$ represents a releasing group. $R_{N21}$, $R_{13}$, $R_{14}$, $X_{21}$ and $ED_{21}$ may be bonded to each other to form a cyclic structure. In the general formula (3), $R_{32}$, $R_{33}$, $R_{31}$, $R_{N31}$, $R_a$ and $R_b$ each represents a hydrogen atom or a substituent, and $L_{31}$ represents a releasing group, provided that in the case where $R_{N31}$ represents a group other than an aryl group, $R_a$ and $R_b$ are bonded to each other to form an aromatic ring.

The compound represented by the general formula (1), (2) or (3) after one-electron oxidation, spontaneously releases $L_1$, $L_{21}$ or $L_{31}$ by a bond cleavage reaction, whereby two or more electrons, and preferably three or more electrons, can be released associated therewith.

The compound represented by the general formula (A) will be described in detail.

In the general formula (A), the reductive group capable of being one-electron-oxidized represented by $RED_{11}$ is a group capable of forming a particular ring by bonding to $R_{111}$ described later, and specific examples thereof include divalent groups obtained by removing one hydrogen atom from the following monovalent groups at a position that is appropriate for forming a ring. Examples of the monovalent group include an alkylamino group, an arylamino group (such as an anilino group and a naphthylamino group), a heterocyclic amino group (such as a benzthiazolyl group and a pyrrolylamono group), an alkylthio group, an arylthio group (such as a phenylthio group), a heterocyclic thio group, an alkoxy group, an aryloxy group (such as a phenoxy group), a heterocyclic oxy group, an aryl group (such as a phenyl group, a naphthyl group and an anthranyl group) and an aromatic or non-aromatic heterocyclic group (such as a from 5- to 7-membered monocyclic or polycondensed heterocyclic group containing at least one hetero atom selected from a nitrogen atom, a sulfur atom, an oxygen atom and a selenium atom, specific examples of which include a tetrahydroquinoline ring, a tetrahydroisoquinoline ring, a tetrahydroquinoxaline ring, a tetrahydroquinazoline ring, an indoline ring, an indole ring, an indazole ring, a carbazole ring, a phenoxazine ring, a phenothiazine ring, a benzothiazoline ring, a pyrrole ring, an imidazole ring, a thiazoline ring, a piperidine ring, a pyrrolidine ring, a morpholine ring, a benzimidazole ring, a benzimidazoline ring, a benzoxazoline ring and a methylenedioxyphenyl ring). (Hereinafter, $RED_{11}$ will be described with the name of the monovalent group for convenience.) $RED_{11}$ may have a substituent.

The substituent herein means one selected form the following groups unless otherwise indicated. Examples of the substituent include a halogen atom, an alkyl group (including an aralkyl group, a cycloalkyl group and an active methine group), an alkenyl group, an alkynyl group, an aryl group, a heterocyclic group (the position where the group is substituted is not limited), a heterocyclic group containing a quaternarized nitrogen atom (such as a pyridinio group, an imidazolio group, a quinolinio group and an isoquinolinio group), an acyl group, an alkoxycarbonyl group, an aryloxycarbonyl group, a carbamoyl group, a carboxyl group or a salt thereof, a sulfonylcarbamoyl group, an acylcarbamoyl group, a sulfamoylcarbamoyl group, a carbazoyl group, an oxalyl group, an oxamoyl group, a cyano group, a carbonimidoyl group, a thiocarbamoyl group, a hydroxyl group, an alkoxy group (including a group containing ethyleneoxy group repeating units or propyleneoxy group repeating units), an aryloxy group, a heterocyclic oxy group, an acyloxy group, an (alkoxy or aryloxy)carbonyloxy group, a carbamoyloxy group, a sulfonyloxy group, an amino group, an (alkyl, aryl or hetrocyclic)amino group, an acylamino group, a sulfonamide group, an ureido group, a thioureido group, an imide group, an (alkoxy or aryloxy)carbonylamino group, a sulfamoylamino group, a semicarbazide group, a thiosemicarbazide group, a hydrazino group, an ammonio group, an oxamoylamino group, an (alkyl or aryl)sulfonylureido group, an acylureido group, an acylsulfamoylamino group, a nitro group, a mercapto group, an (alkyl, aryl or heterocyclic)thio group, an (alkyl or aryl)sulfonyl group, an (alkyl or aryl)sulfinyl group, a sulfo group or a salt thereof, a sulfamoyl group, an acylsulfamoyl group, a sulfonylsulfamoyl group or a salt thereof, and a group containing a phosphoamide or phosphate ester structure. These substituents may further be substituted with these substituents.

$RED_{11}$ preferably represents an alkylamino group, an arylamino group, a heterocyclic amino group, an aryl group or an aromatic or non-aromatic heterocyclic group, and more preferably an arylamino group (particularly an anilino group) or an aryl group (particularly a phenyl group). In the case where these groups have a substituent, the substituent is preferably a halogen atom, an alkyl group, an alkoxy group, a carbamoyl group, a sulfamoyl group, an acylamino group or a sulfonamide group.

In the case where $RED_{11}$ represents an aryl group, the aryl group preferably has at least one electron donating group. The electron donating group herein a 5-membered monocyclic or polycondensed electron-excessive aromatic heterocyclic group containing a hydroxyl group, an alkoxy group, a mercapto group, a sulfonamide group, an acylamino group, an alkylamino group, an arylamino group, a heterocyclic amino group, an active methine group or a nitrogen atom in the ring (such as an indolyl group, a pyrrolyl group, an imodazolyl group, a benzimidazolyl group, a thiazolyl group, a benzthiazolyl group and an indazolyl group), or a non-aromatic nitrogen-containing hetecocyclic group substituted with a nitrogen atom (such as a group that may be referred to as a cyclic amino group, e.g., a pyrrolidinyl group, an indolinyl group, a piperidinyl group, a piperadinyl group and a morphlino group). The active methine group herein means a methine group substituted with two electron attracting groups, and the electron attracting group herein means an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group or a carbonimidoyl group. The two electron attracting groups may be bonded to each other to form a cyclic structure.

In the general formula (A), $L_{11}$ specifically represents a carboxyl group or a salt thereof, a silyl group, a hydrogen atom, a triarylboron anion, a trialkylstannyl group, a trialkylgermyl group or a $—CR_{c1}R_{c2}R_{c3}$ group. The silyl group herein specifically represents a trialkylsilyl group, an aryldialkylsilyl group, a triarylsilyl group or the like, which may have an arbitrary substituent.

In the case where $L_{11}$ represents a salt of a carboxyl group, examples of a counter ion for forming the salt include an alkali metal ion, an alkaline earth metal ion, a heavy metal ion, an ammonium ion and a phosphonium ion, and an alkali metal ion and an ammonium ion are preferred, with an alkali metal ion (particularly, $Li^+$, $Na^+$ and $K^+$ ions) being most preferred.

In the case where $L_{11}$ represents a $—CR_{c1}R_{c2}R_{c3}$ group, $R_{c1}$, $R_{c2}$ and $R_{c3}$ each independently represents a hydrogen atom, an alkyl group, an aryl group, a heterocyclic group, an alkylthio group, an arylthio group, an alkylamino group, an arylamino group, a heterocyclic amino group, an alkoxy group, an aryloxy group or a hydroxyl group, which may be bonded to each other to form a cyclic structure, and may have an arbitrary substituent. In the case where one of $R_{c1}$, $R_{c2}$ and $R_{c3}$ represents a hydrogen atom or an alkyl group, the remaining two groups do not represent a hydrogen atom or an alkyl group. $R_{c1}$, $R_{c2}$ and $R_{c3}$ each preferably independently represents an alkyl group, an aryl group (particularly a phenyl group), an alkylthio group, an arylthio group, an alkylamino group, an arylamino group, a heterocyclic group, an alkoxy group or a hydroxyl group, and specific examples thereof include a phenyl group, a p-dimethylaminophenyl group, a p-methoxyphenyl group, a 2,4-dimethoxyphenyl group, a p-hydroxyphenyl group, a methylthio group, a phenylthio group, a phenoxy group, a methoxy group, an ethoxy group, a dimethylamino group, an N-methylanilino group, a diphenylamino group, a morpholino group, a thiomorpholino group and a hydroxyl group. Examples of the case where these are bonded to each other to form a cyclic structure include a 1,3-dithiolan-2-yl group, a 1,3-dithian-2-yl group, a N-methyl-1,3-dithazolidin-2-yl group and an N-benzylbenzothazolidin-2-yl group.

It is also preferred that the $—CR_{c1}R_{c2}R_{c3}$ group represents the same group as a residual group obtained by removing $L_{11}$ from the compound represented by the general formula (A), as a result of selection of $R_{c1}$, $R_{c2}$ and $R_{c3}$ from the aforementioned range.

In the general formula (A), $L_{11}$ preferably represents a carboxyl group or a salt thereof, or a hydrogen atom, and more preferably a carboxyl group or a salt thereof.

In the case where $L_{11}$ represents a hydrogen atom, the compound represented by the general formula (A) preferably has a basic part inside the molecule. According to the function of the basic part, the hydrogen atom represented by $L_{11}$ is deprotonated after oxidization of the compound represented by the general formula (A), and an electron is then released therefrom.

The base herein is specifically a conjugate base of an acid having pKa of about from 1 to 10. Examples thereof include a nitrogen-containing heterocyclic compound (such as a pyridine compound, an imidazole compound, a benzimidazole compound and a thiazole compound), an aniline compound, a trialkylamine compound, an amino compound, a carbon acid compound (such as an active methylene anion), a thioacetate anion, a carboxylate (—$COO^-$), a sulfate (—$SO_3^-$) or an amineoxide (>$N^+(O^-)$—). It is preferably a conjugate base of an acid having pKa of about from 1 to 8, and preferably a carboxylate, a sulfate or an amineoxide, with a carboxylate being particularly preferred. In the case where the base has an anion, it may have a counter cation, and examples thereof include an alkali metal ion, an alkaline earth metal ion, a heavy metal ion, an ammonium ion and a phosphonium ion. The base is bonded to the compound represented by the general formula (A) at an arbitrary position. The position where the basic part is bonded may be any of $RED_{11}$, $R_{111}$ and $R_{112}$ in the general formula (A), and may be bonded to a substituent on these groups.

In the general formula (A), $R_{112}$ represents a hydrogen atom or a substituent capable of being substituted on a carbon atom, provided that $R_{112}$ does not represent the same group as $L_{11}$.

$R_{112}$ preferably represents a hydrogen atom, an alkyl group, an aryl group (such as a phenyl group), an alkoxy group (such as a methoxy group, an ethoxy group and a benzyloxy group), a hydroxyl group, an alkylthio group (such as a methylthio group and a butylthio group), an amino group, an alkylamino group, an arylamino group or a heterocyclic amino group, and more preferably represents a hydrogen atom, an alkyl group, an alkoxy group, a hydroxyl group, a phenyl group or an alkylamino group.

In the general formula (A), the cyclic structure formed by $R_{111}$ is such a cyclic structure that corresponds to a tetrahydro body, a hexahydro body or an octahydro body of a 5- or 6-membered aromatic ring (including an aromatic heterocyclic ring). The hydro body herein means such a cyclic structure in that the carbon-carbon double bond (or a carbon-nitrogen double bond) contained in the aromatic ring (including the aromatic heterocyclic ring) is partially hydrogenated. The tetrahydro body means such a structure in that two carbon-carbon double bonds (or carbon-nitrogen double bonds) are hydrogenated, the hexahydro body means such a structure in that three double bonds are hydrogenated, and the octahydro body means such a structure in that four double bonds are hydrogenated. The aromatic ring is converted to a non-aromatic cyclic structure having been partially hydrogenated through hydrogenation.

Specific examples thereof include a pyrrolidine ring, an imidazolidine ring, a thiazolidine ring, a pyrazolidine ring, an oxazolidine ring, a piperidine ring, a tetrahydropyridine ring, a tetrahydropyrimidine ring, a piperazine ring, a tetralin ring, a tetrahydroquinoline ring, a tetrahydroisoquinoline ring, a tetrahydroquinazoline ring, a tetrahydroquinoxaline ring, a tetrahydrocarbazole ring and an octahydrophenanthridine ring. These cyclic structures may have an arbitrary substituent.

The cyclic structure formed by $R_{111}$ is more preferably a pyrrolidine ring, an imidazolidine ring, a piperidine ring, a tetrahydropyridine ring, a tetrahydropyrimidine ring, a piperazine ring, a tetrahydroquinoline ring, a tetrahydroisoquinoline ring, a tetrahydroquinazoline ring, a tetrahydroquinoxaline ring or a tetrahydrocarbazole ring, particularly preferably a pyrrolidine ring, a piperidine ring, a piperazine ring, a tetrahydropyridine ring, a tetrahydroquinoline ring, a tetrahydroisoquinoline ring, a tetrahydroquinazoline ring or a tetrahydroquinoxaline ring, and most preferably a pyrrolidine ring, a piperidine ring, a tetrahydropyridine ring, a tetrahydroquinoline ring or a tetrahydroisoquinoline ring.

In the general formula (B), $RED_{12}$ and $L_{12}$ are groups having the same meanings as $RED_{11}$ and $L_{11}$ in the general formula (A), respectively, and the preferred ranges thereof are also the same. However, $RED_{12}$ is a monovalent group other than the case where the following cyclic structure is formed, and specific examples thereof include the monovalent group described for $RED_{11}$. $R_{121}$ and $R_{122}$ are groups having the same meanings as $R_{112}$ in the general formula (A), and the preferred ranges thereof are the same. $ED_{12}$ represents an electron donating group. $R_{121}$ and $RED_{12}$, $R_{121}$ and $R_{122}$, or $ED_{12}$ and $RED_{12}$ may be bonded to each other to form a cyclic structure.

In the general formula (B), the electron donating group represented by $ED_{12}$ is the same groups as the electron donating group described as the substituent in the case where $RED_{11}$ represents an aryl group. $ED_{12}$ preferably represents a hydroxyl group, an alkoxy group, a mercapto group, a sulfonamide group, an alkylamino group, an arylamino group, an active methine group, a 5-membered monocyclic or polycondensed electron-excessive aromatic heterocyclic group, a non-aromatic nitrogen-containing heterocyclic group substituted with a nitrogen atom or a phenyl group substituted with these electron donating group, and a hydroxyl group, a mercapto group, a sulfonamide group, an alkylamino group, an arylamino group, an active methine group, a non-aromatic nitrogen-containing heterocyclic group substituted with a nitrogen atom and a phenyl group substituted with these electron donating group (such as a p-hydroxyphenyl group, a p-dialkylaminophenyl group and an o,p-dialkoxyphenyl group) are more preferred.

In the general formula (B), $R_{121}$ and $RED_{12}$, $R_{122}$ and $R_{121}$, or $ED_{12}$ and $RED_{12}$ may be bonded to each other to form a cyclic structure. The cyclic structure formed herein is a non-aromatic carbon ring or heterocyclic ring, which is a 5- to 7-membered monocyclic or polycondensed ring with a substituted or unsubstituted cyclic structure. In the case where $R_{121}$ and $RED_{12}$ form a cyclic structure, specific examples thereof include, in addition to the examples described for the cyclic structure formed by $R_{111}$ in the general formula (A), a pyrroline ring, an imidazoline ring, a thiazoline ring, a pyrazoline ring, an oxazoline ring, an indane ring, a morpholine ring, an indoline ring, a tetrahydro-1,4-oxazine ring, a 2,3-dihydrobenzo-1,4-oxazine ring, a tetrahydro-1,4-thiazine ring, a 2,3-dihydrobenzo-1,4-thiazine ring, a 2,3-dihydrobenzofuran ring and a 2,3-dihydrobenzothiophene ring. In the case where $ED_{12}$ and $RED_{12}$ form a cyclic structure, $ED_{12}$ preferably represents an amino group, an alkylamino group or an arylamino group, and specific examples of the cyclic structure thus formed include a tetrahydropyrazine ring, a piperazine ring, a tetrahydroquinoxaline ring and a tetrahydroisoquinoline ring. In the case where $R_{122}$ and $R_{121}$ form a cyclic structure, specific examples of the cyclic structure include a cyclohexane ring and a cyclopentane ring.

The general formulae (1) to (3) will be described below.

In the general formulae (1) to (3), $R_1$, $R_2$, $R_{11}$, $R_{12}$ and $R_{31}$ each has the same meaning as $R_{112}$ in the general formula (A), with the preferred ranges thereof being the same. $L_1$, $L_{21}$ and $L_{31}$ each represents the same releasing groups described as the specific examples for $L_{11}$ in the general formula (A), with preferred ranges thereof being the same. The substituents represented by $X_1$ and $X_{21}$ are the same as the examples for the substituent substituted on $RED_{11}$ in the general formula (A) in the case where $RED_{11}$ has the substituent, with preferred ranges thereof being the same. $m_1$ and $m_{21}$ each preferably represents an integer of from 0 to 2, and more preferably 0 or 1.

In the cease where $R_{N1}$, $R_{N21}$ and $R_{N31}$ each represents a substituent, the substituent is preferably an alkyl group, an aryl group or a heterocyclic group, which may have an arbitrary substituent. $R_{N1}$, $R_{N21}$ and $R_{N31}$ each is preferably a hydrogen atom, an alkyl group or an aryl group, and more preferably a hydrogen atom or an alkyl group.

In the case where $R_{13}$, $R_{14}$, $R_{33}$, $R_a$ and $R_b$ each represents a substituent, preferred examples of the substituent include an alkyl group, an aryl group, an acyl group, an alkoxycarbonyl group, a carbamoyl group, a cyano group, an alkoxy group, an acylamino group, a sulfonamide group, an ureido group, a thioureido group, an alkylthio group, an arylthio group, an alkylsulfonyl group, an arylsulfonyl group and a sulfamoyl group.

The 6-membered ring formed by $Z_1$ in the general formula (1) is a non-aromatic heterocyclic ring condensed with the benzene ring in the general formula (1), and specific examples of the cyclic structure including the benzene ring thus condensed include a tetrahydroquinoline ring, a tetrahydroquinoxaline ring and a tetrahydroquinazoline ring, and preferably a tetrahydroquinoline ring and a tetrahydroquinoxaline ring. These rings may have a substituent.

In the general formula (2), $ED_{21}$ represents a group having the same meaning as $ED_{12}$ in the general formula (B), with a preferred range thereof being the same.

In the general formula (2), two of $R_{N21}$, $R_{13}$, $R_{14}$, $X_{21}$ and $ED_{21}$ may be bonded to each other to form a cyclic structure. Examples of the cyclic structure formed by bonding $R_{N21}$ and $X_{21}$ include a non-aromatic carbon ring or heterocyclic ring, and specific examples thereof include a tetrahydroquinoline ring, a tetrahydroquinoxaline ring, an indoline ring and a 2,3-dihydro-5,6-benzo-1,4-thiazine ring, and preferably a tetrahydroquinoline ring, a tetrahydroquinoxaline ring and an indoline ring.

In the general formula (3), in the case where $R_{N31}$ represents a group other than an aryl group, $R_a$ and $R_b$ are bonded to each other to form an aromatic ring. Examples of the aromatic ring include an aryl group (such as a phenyl group and a naphthyl group) and an aromatic heterocyclic group (such as a pyridine ring group, a pyrrole ring group, a quinoline ring group and an indole ring group), and an aryl group is preferred. The aromatic ring groups may have a substituent.

In the general formula (3), it is preferred that $R_a$ and $R_b$ are bonded to each other to form an aromatic ring (particularly, a phenyl group).

In the general formula (3), $R_{32}$ preferably represents a hydrogen atom, an alkyl group, an aryl group, a hydroxyl group, an alkoxy group, a mercapto group and an amino group, and in the case where $R_{32}$ represents a hydroxyl group, it is a preferred example that $R_{33}$ simultaneously represents an electron attracting group. The electron attracting group herein has the same meaning as described in the foregoing, and preferred examples thereof include an acyl group, an alkoxycarbonyl group, a carbamoyl group and a cyano group.

The compound of type 2 will be described.

In the compound of type 2, the bond cleavage reaction means cleavage of a carbon-carbon bond, a carbon-silicon bond, a carbon-hydrogen bond, a carbon-boron bond, a carbon-tin bond and a carbon-germanium bond, and cleavage of a carbon-hydrogen bond may be further accompanied therewith.

The compound of type 2 has two or more (preferably from 2 to 6, and more preferably from 2 to 4) adsorbing groups to silver halide in the molecule. It is more preferably a compound having a nitrogen-containing heterocyclic group having two or more mercapto groups substituted thereon as the adsorbing groups. The number of adsorbing groups is preferably from 2 to 6, and more preferably from 2 to 4. The adsorbing group will be described later.

Preferred examples of the compound of type 2 include a compound represented by the following general formula (C).

General formula (C)

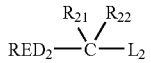

The compound represented by the general formula (C) is a compound, after one-electron oxidation of the reductive group represented by $RED_2$, spontaneously releases $L_2$ by a bond cleavage reaction, whereby one electron can be released associated therewith.

In the general formula (C), $RED_2$ represents a group having the same meaning as $RED_{12}$ in the general formula (B), with a preferred range thereof being the same. $L_2$ represents a group having the same meaning as $L_{11}$ in the general formula (A), with a preferred range thereof being the same. In the case where $L_2$ represents a silyl group, the compound has a nitrogen-containing heterocyclic group having two or more mercapto groups substituted thereon. $R_{21}$ and $R_{22}$ each represents a hydrogen atom or a substituent, which has the same meaning as $R_{112}$ in the general formula (A), with preferred ranges thereof being the same. $RED_2$ and $R_{21}$ may be bonded to each other to form a cyclic structure.

The cyclic structure formed herein is a 5- to 7-membered monocyclic or polycondensed non-aromatic carbon ring or heterocyclic ring, which may have a substituent, provided that the cyclic structure is not such a cyclic structure that corresponds to a tetrahydro body, a hexahydro body or an octahydro body of an aromatic ring or an aromatic heterocyclic ring. The cyclic structure is preferably a cyclic structure corresponding to a dihydro body of an aromatic ring or an aromatic heterocyclic ring, and specific examples thereof include a 2-pyrroline ring, a 2-imidazoline ring, a 2-thiazoline ring, a 1,2-dihydropyridine ring, a 1,4-dihydropyridine ring, an indoline ring, a benzimodazoline ring, a benzothiazoline ring, a benzoxazoline ring, a 2,3-dihydrobenzothiophene ring, a 2,3-dihydrobenzofuran ring, a benz-α-pyran ring, a 1,2-dihydroquinoline ring, a 1,2-dihydroquinazoline ring and a 1,2-dihydroquinoxaline ring, preferably a 2-imidazoline ring, a 2-thiazoline ring, an indoline ring, a benzimodazoline ring, a benzothiazoline ring, a benzoxazoline ring, a 1,2-dihydropyridine ring, a 1,2-dihydroquinoline ring, a 1,2-dihydroquinazoline ring and a 1,2-dihydroquinoxaline ring, more preferably an indoline ring, a benzimodazoline ring, a benzothiazoline ring and a 1,2-dihydroquinoline ring, and particularly preferably an indoline ring.

The compound of type 3 will be described.

In the compound of type 3, the bond forming process means formation of a bond between atoms, such as a carbon-carbon bond, a carbon-nitrogen bond, a carbon-sulfur bond and a carbon-oxygen bond.

The compound of type 3 preferably forms a one-electron oxidant by one-electron oxidation capable of releasing one or more electron after a subsequent bond forming process, in which a bond is formed by reacting with a reactive group part coexisting in the molecule (such as a carbon-carbon double bond part, a carbon-carbon triple bond part, an aromatic group part or a non-aromatic heterocyclic ring part of benzo ring condensation).

In more detail, the compound of type 3 forms a one-electron oxidant (such as a cationic radical species or a neutral radical species formed by elimination of a proton therefrom) by one-electron oxidation, which reacts with the reactive group coexisting in the molecule to form a bond, whereby another radical species having a cyclic structure is formed inside the molecule. The radical species then releases a second electron directly or associated with elimination of a proton.

In the compound of type 3, there are such cases that the two-electron oxidant thus formed receives a hydrolysis reaction in some cases, or directly causes a mutual isomerization reaction associated with migration of a proton in other cases, so as to release one or more electron, generally two or more electrons. The compound of type 3 also includes such a compound that the two-electron oxidant directly releases one or more electron, generally two or more electrons, without involvement of the mutual isomerization reaction.

The compound of type 3 preferably represents the following general formula (D).

General formula (D)

$$RED_3\text{-}L_3\text{-}Y_3$$

In the general formula (D), $RED_3$ represents a reductive group capable of being subjected to one-electron oxidation, $Y_3$ represents a reactive group part that reacts after one-electron oxidation of $RED_3$, which specifically represents a carbon-carbon double bond part, a carbon-carbon triple bond part, an aromatic group part or a non-aromatic heterocyclic ring part of benzo ring condensation, and $L_3$ represents a linking group connecting $RED_3$ and $Y_3$.

$RED_3$ represents a group having the same meaning as $RED_{12}$ in the general formula (B), preferably an arylamino group, a heterocyclic amino group, an aryloxy group, an arylthio group, an aryl group or an aromatic or non-aromatic heterocyclic group (with a nitrogen-containing heterocyclic group being particularly preferred), and more preferably an arylamino group, a heterocyclic amino group, an aryl group or an aromatic or non-aromatic heterocyclic group. Preferred examples of the heterocyclic group include a tetrahydroquinoline ring, a tetrahydroquinoxaline ring, a tetrahydroquinazoline ring, an indoline ring, an indole ring, a carbazole ring, a phenoxazine ring, a phenothiazine ring, a benzothiazoline ring, a pyrrole ring, an imidazole ring, a thiazole ring, a benzimidazole ring, an benzimidazoline ring, a benzothiazoline ring, and a 3,4-methylenedioxyphenyl-1-yl.

$RED_3$ particularly preferably represents an arylamino group (particularly, an anilino group), an aryl group (particularly, a phenyl group) or an aromatic or non-aromatic heterocyclic group.

In the case where $RED_3$ represents an aryl group, the aryl group preferably has at least one electron donating group. The electron donating group has the same meaning as described in the foregoing.

In the case where $RED_3$ represents an aryl group, more preferred examples of the substituent thereon include an alkylamino group, a hydroxyl group, an alkoxy group, a mercapto group, a sulfonamide group, an active methine group or a non-aromatic nitrogen-containing heterocyclic group having a nitrogen atom substituted thereon, further preferably an alkylamino group, a hydroxyl group, an active methine group or a non-aromatic nitrogen-containing heterocyclic group having a nitrogen atom substituted thereon, and most preferably an alkylamino group or a non-aromatic nitrogen-containing heterocyclic group having a nitrogen atom substituted thereon.

In the case where the organic group having a carbon-carbon double bond part represented by $Y_3$ (such as a vinyl) group has a substituent, preferred examples of the substituent include an alkyl group, a phenyl group, an acyl group, a cyano group an alkoxycarbonyl group, a carbamoyl group and an electron donating group, and preferred examples of the electron donating group include an alkoxy group, a hydroxyl group (which may be protected with a silyl group, for example, a trimethylsilyloxy group, a t-butyldmethylsilyloxy group, a triphenylsilyloxy group, a triethylsilyloxy group and a phenyldimethylsilyloxy group), an amino group, an alkylamino group, an arylamino group, a sulfonamide group, an active methine group, a mercapto group, an alkylthio group and a phenyl group having the electron attracting group as a substituent.

In the case where the organic group containing a carbon-carbon double bond part has a hydroxyl group as a substituent, $Y_3$ contains the structure $>C_1{=}C_2(\text{—}OH)\text{—}$, which may be mutually isomerized to be another structure $>C_1H\text{—}C_2(\text{=}O)\text{—}$. In this case, such a case is also preferred that a substituent substituted on the carbon atom $C_1$ is an electron attracting group, and $Y_3$ in this case contains a partial structure of an active methylene group or an active methine group. The electron attracting group providing the partial structure of an active methylene group or an active methine group is the same as that referred in the aforementioned description for the active methine group.

In the case where the organic group containing a carbon-carbon triple bond part (for example, an ethylnyl group) represented by $Y_3$ has a substituent, preferred examples of the substituent include an alkyl group, a phenyl group, an alkoxycarbonyl group, a carbamoyl group and an electron donating group.

In the case where $Y_3$ represents an organic group containing an aromatic group part, the aromatic group is preferably an aryl group (particularly preferably a phenyl group) having an electron donating group as a substituent or an indole ring group, and preferred examples of the electron donating group include a hydroxyl group (which may be protected with a silyl group), an alkoxy group, an amino group, an alkylamino group, an active methine group, a sulfonamide group and a mercapto group.

In the case where $Y_3$ represents an organic group containing a non-aromatic heterocyclic ring part of benzo ring condensation, the non-aromatic heterocyclic ring part of benzo ring condensation is preferably those having an aniline structure as a partial structure contained therein, and examples thereof include an indoline ring group, a 1,2,3,4-tetrahydroquinoline ring group, a 1,2,3,4-tetrahydroquinoxaline ring group and a 4-quinolone ring group.

The reactive group represented by $Y_3$ is more preferably an organic group containing a carbon-carbon double bond part, an aromatic group part or a non-aromatic heterocyclic ring part of benzo ring condensation, and more preferably an organic group containing a carbon-carbon double bond part, a phenyl group having an electron donating group as a substituent, an indole ring group or a non-aromatic heterocyclic ring part of benzo ring condensation having an aniline structure as a partial structure contained therein. Here, the carbon-carbon double bond part more preferably includes at least one electron donative group as a substituent.

It is also a preferred example of the compound of the general formula (D) in which the reactive group represented by $Y_3$ has the same partial structure as the reductive group represented by $RED_3$ as a result of selection of $Y_3$ from the aforementioned ranges.

$L_3$ represents a linking group connecting $RED_3$ and $Y_3$, and specifically may represents a single bond, a sole group of an alkylene group, an arylene group, a heterocyclic ring group, —O—, —S—, —$NR_N$—, —C(═O)—, —$SO_2$—, —SO— and —P(═O)—, and a group containing a combination of these groups, in which $R_N$ represents a hydrogen atom, an alkyl group, an aryl group or a heterocyclic group. The linking group represented by $L_3$ may have an arbitrary substituent. The linking group represented by $L_3$ may be connected to arbitrarily positions of $RED_3$ and $Y_3$ by substituting with an arbitrary hydrogen atom of each group at the position.

Preferred examples of the linking group represented by $L_3$ include a single bond, an alkylene group (particularly, a methylene group, an ethylene group and a propylene group), an arylene group (particularly, a phenylene group), a —C(═O)— group, an —O— group, an —NH— group, an —N(alkyl)-group and a divalent group containing a combination of these groups.

The group represented by $L_3$ is preferably such a group that in the case where a cationic radical species ($X^+$.) formed by oxidation of $RED_3$ or a radical species (X.) formed by associated with elimination of a proton therefrom is reacted with the reactive group represented by $Y_3$ to form a bond, the atomic group concerning thereto forms a 3- to 7-membered cyclic structure including $L_3$. In order to attain the conformation, it is preferred that the radical species ($X^+$. or X.), the reactive group represented by Y and L are connected with an atomic group having from 3 to 7 atoms.

The compound of type 4 will be described.

The compound of type 4 is a compound having a cyclic structure having a reductive group substituted thereon, and after one-electron oxidation of the reductive group, the compound is capable of releasing one or more electron associated with a cleavage reaction of the cyclic structure. The cleavage reaction of the cyclic structure herein means a reaction shown by the following general scheme.

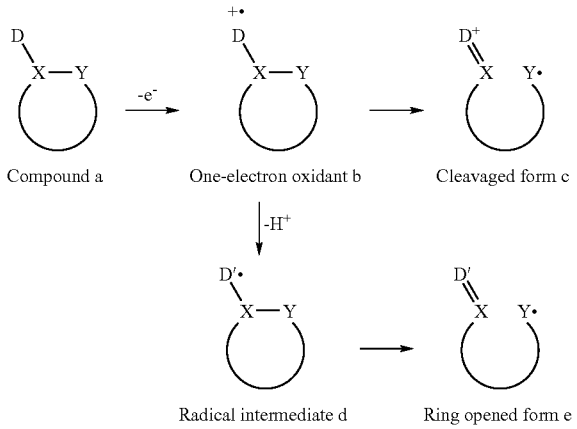

In the scheme, the compound a represents the compound of type 4. In the compound a, D represents a reductive group, X and Y represent atoms forming a bond in the cyclic structure that is cleaved after the one-electron oxidation. The compound a is one-electron-oxidized to form a one-electron oxidant b, from which the single bond D-X is changed to a double bond, and simultaneously, the bond X—Y is cut, so as to form a ring-opening body c. In alternative, there are cases where a radical intermediate body d is formed from the one-electron oxidant b associated with elimination of a proton, from which a ring-opening body e in the similar manner. One of the characteristic features of the compound resides in that one or more electron is subsequently released from the ring-opening body c or e thus formed.

The cyclic structure contained in the compound of type 4 is a 3- to 7-membered carbon ring or heterocyclic ring, which is a monocyclic or polycondensed, saturated or unsaturated non-aromatic ring. It is preferably a saturated cyclic structure, and more preferably a 3-membered or 4-membered ring. Preferred examples of the cyclic structure include a cyclopropane ring, a cyclobutane ring, an oxirane ring, an oxetane ring, an aziridine ring, an azetidine ring, an episulfide ring and a thietane ring, more preferably a cyclopropane ring, a cyclobutane ring, an oxirane ring, an oxetane ring and an azetidine ring, and particularly preferably a cyclopropane ring, a cyclobutane ring and an azetidine ring. The cyclic structure may have an arbitrary substituent.

The compound of type 4 is preferably represented by the following general formulae (E) and (F).

General formula (E)

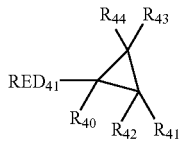

General formula (F)

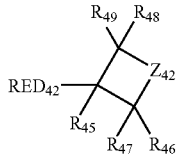

In the general formulae (E) and (F), $RED_{41}$ and $RED_{42}$ each represents a group having the same meaning as $RED_{12}$ in the general formula (B), with preferred ranges thereof being the same. $R_{40}$ to $R_{44}$ and $R_{45}$ to $R_{49}$ each represents a hydrogen atom or a substituent. In the general formula (F), $Z_{42}$ represents —$CR_{420}R_{421}$—, —$NR_{423}$ or —O—, wherein $R_{420}$ and $R_{421}$ each represents a hydrogen atom or a substituent, and $R_{423}$ represents a hydrogen atom, an alkyl group, an aryl group or a heterocyclic group.

In the general formulae (E) and (F), $R_{40}$ and $R_{45}$ each preferably represents a hydrogen atom, an alkyl group, an aryl group or a heterocyclic group, and more preferably a hydrogen atom, an alkyl group or an aryl group. Preferred examples of $R_{41}$ to $R_{44}$ and $R_{46}$ to $R_{49}$ include a hydrogen atom, an alkyl group, an alkenyl group, an aryl group, a heterocyclic group, an arylthio group, an alkylthio group, an acylamino group and a sulfonamide group, and more preferably a hydrogen atom, an alkyl group, an aryl group and a heterocyclic group.

It is preferred that at least one of $R_{41}$ to $R_{44}$ is a donative group, and it is also preferred that both $R_{41}$ and $R_{42}$, or both $R_{43}$ and $R_{44}$ are electron attracting groups. It is more preferred that at least one of $R_{41}$ to $R_{44}$ is a donative group. It is further preferred that at least one of $R_{41}$ to $R_{44}$ is a donative group, and a group among $R_{41}$ to $R_{44}$ that is not a donative group is a hydrogen atom or an alkyl group.

The donative group herein means an electron donative group or an aryl group having at least one electron donative group substituted thereon. The donative group is preferably an alkylamino group, an arylamino group, a heterocyclic amino group, a 5-membered monocyclic or polycondensed aromatic electron-excessive heterocyclic ring group having at least one nitrogen atom in the ring, a non-aromatic heterocyclic ring group having a nitrogen atom substituted thereon, and a phenyl group having at least one electron donative group substituted thereon, more preferably an alkylamino group, an arylamino group, a 5-membered monocyclic or polycondensed aromatic electron-excessive heterocyclic ring group having at least one nitrogen atom in the ring (such as an indol ring, a pyrrole ring and a carbazole ring), and a phenyl group having an electron donative group substituted thereon (such as a phenyl group having three or more alkoxy groups substituted thereon and a phenyl group having a hydroxyl group, an alkylamino group or an arylamino group substituted thereon), and particularly preferably an arylamino group, a 5-membered monocyclic or polycondensed aromatic electron-excessive heterocyclic ring group having at least one nitrogen atom in the ring (such as a 3-indolyl group), and a phenyl group having an electron donative group substituted thereon (such as a trialkoxyphenyl group and a phenyl group having an alkylamino group or an arylamino group substituted thereon).

$Z_{42}$ preferably represents —$CR_{420}R_{421}$—, —$NR_{423}$, and more preferably —$NR_{423}$, wherein $R_{420}$ and $R_{421}$ each preferably represents a hydrogen atom, an alkyl group, an aryl group, a heterocyclic group, an acylamino group or a sulfoamino group, and more preferably a hydrogen atom, an alkyl group, an aryl group or a heterocyclic group. $R_{423}$ preferably represents a hydrogen atom, an alkyl group, an aryl group or an aromatic heterocyclic group, and more preferably a hydrogen atom, an alkyl group or an aryl group.

In the case where $R_{40}$ to $R_{49}$, $R_{420}$, $R_{421}$ and $R_{423}$ each represents a substituent, the total carbon number thereof is 40 or less, more preferably 30 or less, and particularly preferably 15 or less. These substituents may be bonded to each other or bonded to other parts in the molecule (such as $RED_{41}$, $RED_{42}$ or $Z_{42}$) to form a ring.

In the compounds of types 1 to 4 in the invention, the adsorbing group to silver halide is a group that directly adsorbs silver halide or a group that accelerates adsorption of silver halide, and specific examples thereof include a mercapto group (or a salt thereof), a thione group (—C(═S)—), a heterocyclic group containing at least one atom selected from a nitrogen atom, a sulfur atom, a selenium atom and a tellurium atom, a sulfide group, a cationic group and an ethynyl group, provided that a sulfide group is not included in the adsorbing group in the compound of type 2 of the invention.

The mercapto group (or a salt thereof) as the adsorbing group means a mercapto group (or a salt thereof) itself, and simultaneously it preferably represents a heterocyclic group, an aryl group or an alkyl group having at least one mercapto group (or a salt thereof) substituted thereon. The heterocyclic group herein may be a 5- to 7-membered monocyclic or polycondensed aromatic or non-aromatic heterocyclic ring, and examples thereof include an imidazole ring group, a thiazole ring group, an oxazole ring group, a benzimidazole ring group, a benzthiazole ring group, a benzoxazole ring group, a triazole ring group, a thiadiazole ring group, an oxadiazole ring group, a tetrazole ring group, a purine ring group, a pyridine ring group, a quinoline ring group, an isoquinolie ring group, a pyrimidine ring group and a triazine ring group. It may also be a heterocyclic group containing a quaternarized nitrogen atom, and in this case, the substituted mercapto group may be dissociated to a mesoion. Examples of such a heterocyclic group include an imidazolium ring group, a pyrazolium ring group a thiazolium, ring group, a triazolium ring group, a tetrazolium ring group, a thiadiazolium ring group, a pyridinium ring group, a pyrimidinium ring group and a triazinium ring group, and among these a triazolium ring group (such as a 1,2,4-triazolium-3-thiolate ring group) is preferred. Examples of the aryl group include a phenyl group and a naphthyl group. Examples of the alkyl group include a linear, branched or cyclic alkyl group having from 1 to 30 carbon atoms. Examples of a counter ion in the case where the mercapto group forms a salt include a cation, such as an alkali metal, an alkaline earth metal and a heavy metal (such as $Li^+$, $Na^+$, $K^+$, $Mg^{2+}$, $Ag^+$ and $Zn^{2+}$), an ammonium ion, a heterocyclic group containing a quaternarized nitrogen atom and a phosphonium ion.

The mercapto group as the adsorbing group may be a thione group through mutual isomerization, and examples thereof include a thioamide group (which is a —C(═S)—NH— group herein) and a group containing a partial structure of the thioamide group, such as a linear or cyclic thioamide group, a thioureido group, a thiourethane group and a dithiocarbamate ester group. Examples of the cyclic group include a thiazolin-2-thione group, an oxazolin-2-thione group, a 2-thiohydantoin group, a rhodanine group, an isorhodanine group, a thio barbituric acid group and a 2-thioxo-oxazolin-4-one group.

The thione group as the adsorbing group includes, in addition to the aforementioned case where the mercapto group becomes a thione group through mutual isomerization, a linear or cyclic thioamide group, a thioureido group, a thiourethane group and a dithiocarbamate ester group, which cannot be mutually isomerized to a mercapto group (i.e., that does not have a hydrogen atom at the α-position of the thione group).

The heterocyclic group containing at least one atom selected from a nitrogen atom, a sulfur atom, a selenium atom and a tellurium atom may be a nitrogen-containing heterocyclic group having an —NH— group as a partial structure of the heterocyclic ring that is capable of forming imino silver (>NAg), or a heterocyclic group having an —S— group, an —Se— group, a —Te— group or an ═N— group as a partial structure of the heterocyclic ring that is capable of being coordinated to a silver ion through a coordinate bond. Examples of the former include a benzotriazole group, a triazole group, an indazole group, a pyrazole group, a tetrazole group, a benzimidazole group, an imidazole group and purine group, and examples of the later include a thiophene group, a thiazole group, an oxazole group, a benzthiazole group, a benzoxiazole group, a thiadiazole group, an oxadiazole group, a triazine group, a selenoazole group, a benzselenoazole group, a tellurazole group and a benztellurazole group, with the former being preferred.

Examples of the sulfide group as the adsorbing group include all groups that have an —S— structure as a partial structure, and preferred examples thereof include groups having an alkyl (or alkylene)-S-alkyl (or alkylene) structure, an aryl (or arylene)-S-alkyl (or alkylene) structure or an aryl (or arylene)-S-aryl (or arylene) structure as a partial structure. The sulfide group may form a cyclic structure and may be an —S—S— group. Specific examples thereof in the case where a cyclic structure is formed include groups containing a thiolane ring, a 1,3-dithiolane ring, a 1,2-dithiolane ring, a thiane ring, a dithiane ring and a tetrahydro-1,4-thiazine ring (a thiomorpholine ring). Particularly preferred examples of the sulfide group include a group having an alkyl (or alkylene)-S-alkyl (or alkylene) partial structure.

The cationic group as the adsorbing group means a group containing a quaternarized nitrogen atom, and specifically an ammonio group or a group containing a nitrogen-containing heterocyclic group containing a quaternarized nitrogen atom, provided that the cationic group does not become a part of an atomic group forming a dye structure (such as a cyanine chromophoric group). Examples of the ammonio group herein include a trialkylammonio group, a dialkylarylammonio group and an alkyldiarylammonio group, and specific examples thereof include a benzyldimethylammonio group, a trihexylammonio group and a phenyldiethylammonio group. Examples of the heterocyclic group containing a quaternarized nitrogen atom include a pyridinio group, a quinolinio group, an isoquinolinio group and an imidazolio group, and a pyridinio group and an imidazolinio group are preferred, with a pyridinio group being particularly preferred. The nitrogen-containing heterocyclic group containing a quaternarized nitrogen atom may have a substituent. Preferred examples of the substituent on a pyridinio group and an imidazolio group include an alkyl group, an aryl group, an acylamino group, a chlorine atom, an alkoxycarbonyl group and a carbamoyl group, and particularly preferred examples of the substituent on a pyridinio group include a phenyl group.

The ethynyl group as the adsorbing group means a —C≡CH group, and the hydrogen atom therein may be substituted.

The aforementioned adsorbing groups may have an arbitrary substituent.

Specific examples of the adsorbing group also include those described in JP-A No. 11-95355, p. 4 to 7.

Preferred examples of the adsorbing group in the invention include a mercapto group-substituted nitrogen-containing heterocyclic group (such as a 2-mercaptothiadiazole group, a 3-mercapto-1,2,4-triazole group, a 5-mercaptotetrazole group, a 2-mercapto-1,3,4-oxadiazole group, a 2-mercaptobenzoxazole group, a 2-mercaptobenzthiazole group and a 1,5-dimetyl-1,2,4-triazolium-3-thiolate group) and a nitrogen-containing heterocyclic group having an —NH— group as a partial structure of the heterocyclic ring that is capable of forming imino silver (>NAg) (such as a benztriazole group, a benzimidazole group and an indazole group), particularly preferred examples thereof include a 5-mercaptotetrazole group, a 3-mercapto-1,2,4-triazole group and a benztriazole group, and most preferred examples thereof include a 3-mercapto-1,2,4-triazole group and a 5-mercaptotetrazole group.

Among the compounds in the invention, a compound having two or more mercapto groups as a partial structure is also particularly preferred. The mercapto group herein may be a thione group in the case where it can exert mutual isomerization. Examples of such a compound include a compound having two or more of the adsorbing groups having a mercapto group or a thione group as a partial structure (such as a ring-forming thioamide group, an alkylmercapto group, an arylmercapto group and a heterocyclic mercapto group) in the molecule, and a compound having one or more adsorbing group having two or more mercapto groups or thione groups as a partial structure (such as a dimercapto-substituted nitrogen-containing heterocyclic group).

Examples of the adsorbing group having two or more mercapto groups as a partial structure (such as dimercapto-substituted nitrogen-containing heterocyclic group) include a 2,4-dimercaptopyrimidine group, a 2,4-dimercaptotriazine group, a 3,5-dimercapto-1,2,4-triazole group, a 2,5-dimercapto-1,3-thiazole group, a 2,5-dimercapto-1,3-oxazole group, 2,7-dimercapto-5-methyl-s-triazolo(1,5-A)-pyrimidine group, a 2,6,8-trimercaptopurine group, a 6,8-dimercaptopurine group, a 3,5,7-trimercapto-s-triazolotriazine group, a 4,6-dimercaptopyrazolopyrimidine group and a 2,5-dimercaptoimidazole group, and a 2,4-dimercaptopyrimidine group, a 2,4-dimercaptotriazine group and a 3,5-dimercapto-1,2,4-triazole group are particularly preferred.

While the adsorbing group may be substituted on any position in the general formulae (A) to (F) and the general formulae (1) to (3), it is preferred that the adsorbing group is substituted on $RED_{11}$, $RED_{12}$, $RED_2$ or $RED_3$ in the general formulae (A) to (D), $RED_{41}$, $R_{41}$, $RED_{42}$ or $R_{46}$ to $R_{48}$ in the general formulae (E) and (F), and an arbitrary position except for $R_1$, $R_2$, $R_{11}$, $R_{12}$, $R_{31}$, $L_1$, $L_{21}$ and $L_{31}$ in the general formulae (1) to (3), and it is preferred that the adsorbing group is substituted on $RED_{11}$ to $RED_{42}$ in all the general formulae (A) to (F).

The partial structure of a spectral sensitizing dye is a group containing a chromophoric group of the spectral sensitizing dye and is a residual group obtained by removing an arbitrary hydrogen atom or substituent from the spectral sensitizing dye. While the partial structure of a spectral sensitizing dye may be any position in the general formulae (A) to (F) and the general formulae (1) to (3), it is preferred that the partial structure is substituted on $RED_{11}$, $RED_{12}$, $RED_2$ or $RED_3$ in the general formulae (A) to (D), $RED_{41}$, $R_{41}$, $RED_{42}$ or $R_{46}$ to $R_{48}$ in the general formulae (E) and (F), and an arbitrary position except for $R_1$, $R_2$, $R_{11}$, $R_{12}$, $R_{31}$, $L_1$, $L_{21}$ and $L_{31}$ in the general formulae (1) to (3), and it is preferred that the partial structure is substituted on $RED_{11}$ to $RED_{42}$ in all the general formulae (A) to (F). Preferred examples of the spectral sensitizing dye include a spectral sensitizing dye used in a color sensitizing technique, such as a cyanine dye compound, a complex cyanine dye compound, a merocyanine dye compound, a complex merocyanine dye compound, a homopolar cyanine dye compound, a stylyl dye compound and a hemicyanine dye compound. Representative examples of the spectral sensitizing dye are described in Research Disclosure, item 36544 (September of 1994). These dyes can be synthesized by a skilled person in the art according to the aforementioned Research Disclosure, item 36544 or F. M. Hamer, The Cyanine Dyes and Related Compounds (Interscience Publishers, New York, 1964). Dyes described in JP-A No. 11-95355, p. 7 to 14 (U.S. Pat. No. 6,054,260) may also be used as they are.

The compound of types 1 to 4 in the invention preferably has a total carbon number in a range of from 10 to 60, more preferably from 15 to 50, further preferably from 18 to 40, and particularly preferably from 18 to 30.

The compound of types 1 to 4 in the invention is one-electron-oxidized triggered by exposure of a silver halide photosensitive material containing the compound, and after the subsequent reaction, one electron or two electrons in some types are released through oxidation. The oxidation potential of the first electron is preferably about 1.4 V or less, and more preferably 1.0 V or less. The oxidation potential is preferably 0 V or more, and more preferably 0.3 V or more. Accordingly, the oxidation potential is preferably about from 0 to 1.4 V, and more preferably about 0.3 to 1.0 V.

The oxidation potential can be measured by a cyclic voltammetry technique and specifically measured in the following manner. That is, a sample is dissolved in a solution of acetonitrile and water (containing 0.1 M of lithium perchlorate) (80/20 in terms of % by volume), and after nitrogen gas is bubbled therein for 10 minutes, the oxidation potential is measured by using a glassy carbon disk as an operating electrode, a platinum wire as a counter electrode and a calomel electrode (SCE) as a reference electrode at 25° C. with a potential scanning rate of 0.1 V per second. The oxidation potential with respect to the SCE is measured at the peak potential of the cyclic voltammetry wave.

In the case where the compound of types 1 to 4 in the invention is a compound that is one-electron-oxidized and after the subsequent reaction, releases another one electron, the oxidation potential of the later step is preferably from −0.5 to −2 V, more preferably from −0.7 to −2 V, and further preferably from −0.9 to −1.6 V.

In the case where the compound of types 1 to 4 in the invention is a compound that is one-electron-oxidized and after the subsequent reaction, releases two or more electrons through oxidation, the oxidation potential of the later step is not particularly limited. This is because the oxidation potential of the second electron and the oxidation potential of the third electron cannot be clearly distinguished from each other, and thus it is often difficult to accurately measure them separately.

The compound of type 5 will be described.

The compound of type 5 is represented by X-Y, wherein X represents a reductive group, and Y represents a releasing group, and it is such a compound that the reductive group represented by X is one-electron-oxidized to form a one-electron oxidant, which forms an X radical by releasing Y associated with a cleavage reaction of the X-Y bond, and another one electron can be released therefrom. The reaction where the compound of type 5 is oxidized can be expressed by the following scheme.

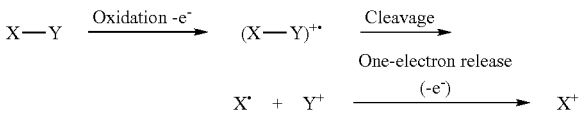

The compound of type 5 preferably has an oxidation potential of from 0 to 1.4 V, and more preferably from 0.3 to 1.0 V. The oxidation potential of the radical X. formed in the aforementioned reaction is preferably from −0.7 to −2.0 V, and more preferably from −0.9 to −1.6 V.

The compound of type 5 is preferably represented by the following general formula (G).

General formula (G)

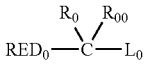

In the general formula (G), $RED_0$ represents a reductive group, $L_0$ represents a releasing group, and $R_0$ and $R_{00}$ each represents a hydrogen atom or a substituent. $RED_0$ and $R_0$, and $R_0$ and $R_{00}$ may be bonded to each other to form a cyclic structure. $RED_0$ represents a group having the same meaning as $RED_2$ in the general formula (C), with a preferred range thereof being the same. $R_0$ and $R_{00}$ each represents a group having the same meanings as $R_{21}$ and $R_{22}$ in the general formula (C), with preferred ranges thereof being the same, provided that $R_0$ and $R_{00}$ each does not represents the same group as $L_0$ except for a hydrogen atom. $RED_0$ and $R_0$ may be bonded to each other to form a cyclic structure, and examples of the cyclic structure include the examples described for the case where $RED_2$ and $R_{21}$ are bonded to each other to form a cyclic structure in the general formula (C), with a preferred range thereof being the same. Examples of the cyclic structure formed by bonding $R_0$ and $R_{00}$ include a cyclopentane ring and a tetrahydrofuran ring. In the general formula (G), $L_0$ represents a group having the same meaning as $L_2$ in the general formula (C), with a preferred range thereof being the same.

The compound represented by the general formula (G) preferably has a adsorbing group to silver halide or a partial structure of a spectral sensitizing dye in the molecule, provided that in the case where $L_0$ represents a group other than a silyl group, two or more adsorbing groups are not simultaneously contained in the molecule. However, two or more sulfide groups as the adsorbing group may be contained irrespective to $L_0$.

Examples of the adsorbing group to silver halide contained in the compound represented by the general formula (G) include the examples described for the adsorbing group that may be contained in the compound of types 1 to 4 in the invention, and in addition thereto, also include all the groups described in JP-A No. 11-95355, p. 4 to 7, under the name of silver halide adsorbing groups, with the preferred range thereof being applicable.

The partial structure of a spectral sensitizing dye that may be contained in the compound represented by the general formula (G) is the same as the partial structure of a spectral sensitizing dye that may be contained in the compound of types 1 to 4 in the invention, and in addition thereto, examples thereof also include all the groups described in JP-A No. 11-95355, p. 7 to 14, under the name of photoabsorbing groups, with the preferred range thereof being applicable.

Specific examples of the compound of types 1 to 5 in the invention are shown below, but the invention is not limited thereto.

1

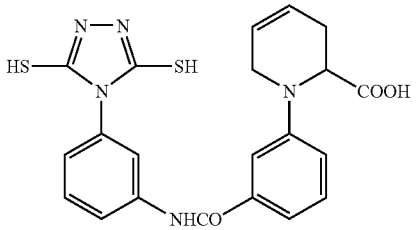

2

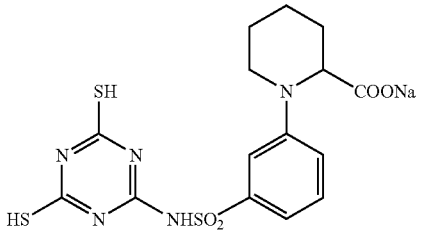

-continued
3
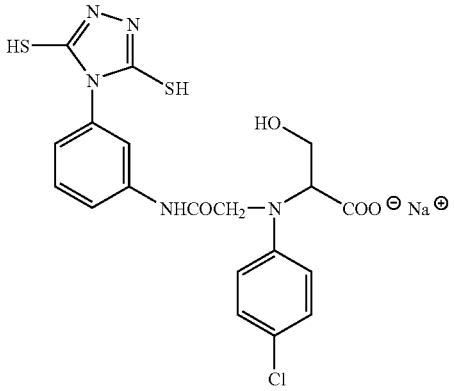
4
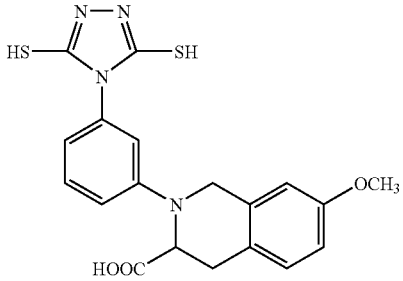
5
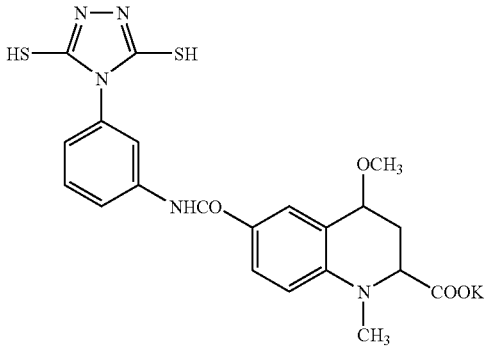
6
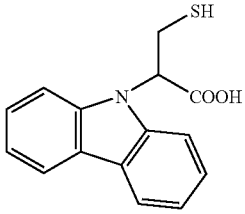
7
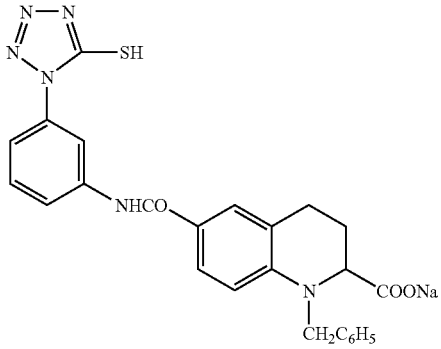
8
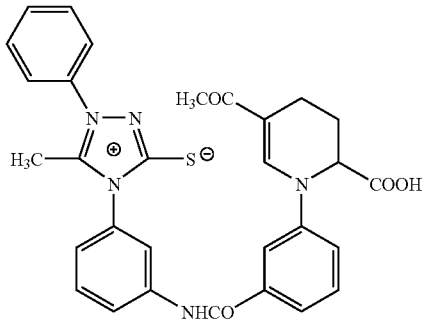
9
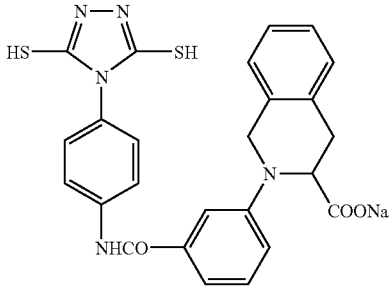
10
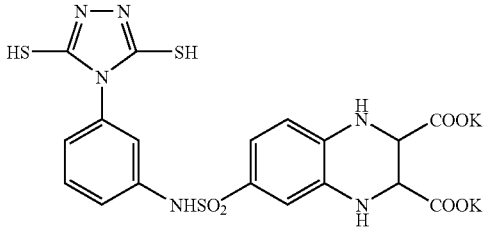

-continued
11
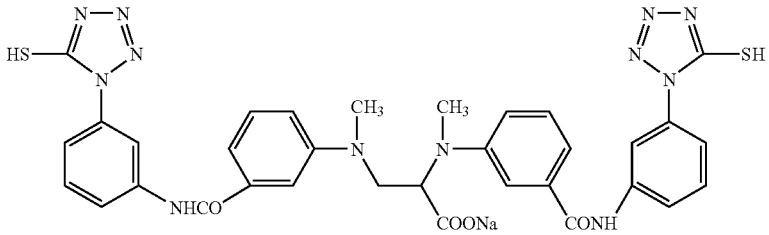
12
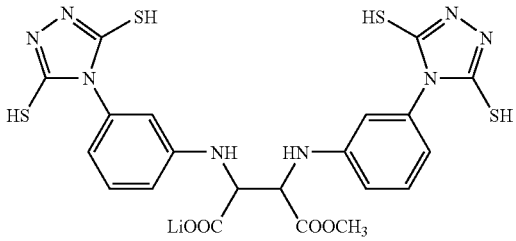
13
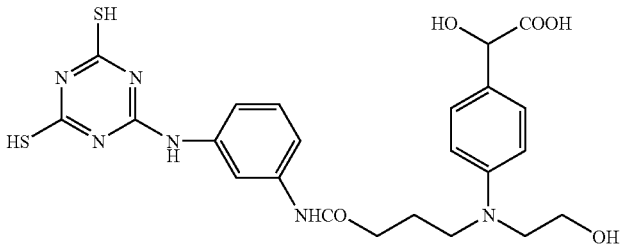
14
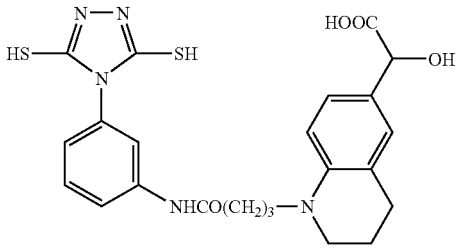
15
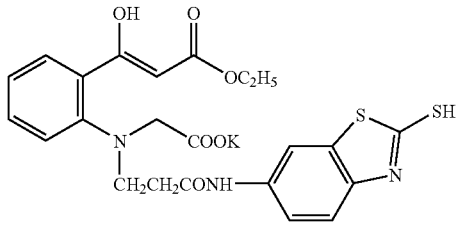
16
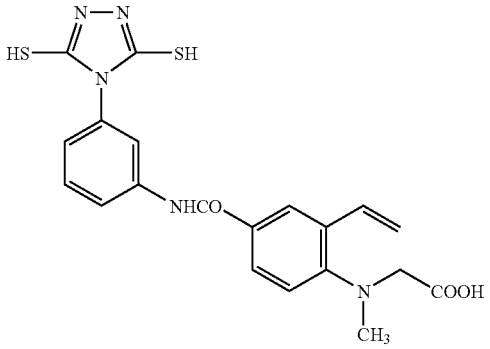

-continued
17
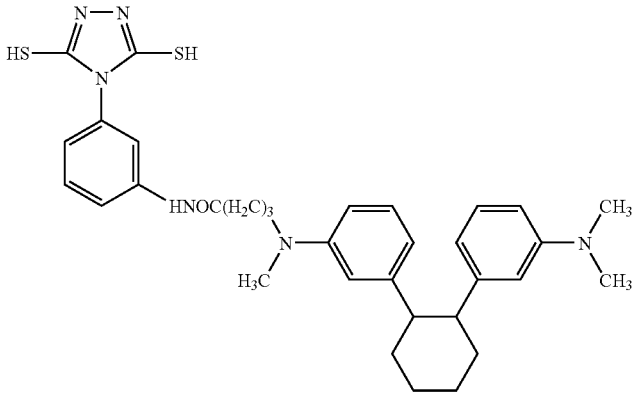
18
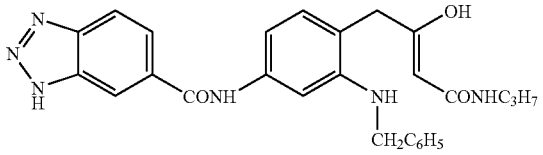
19
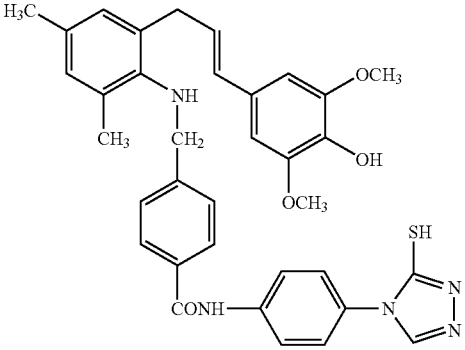
20
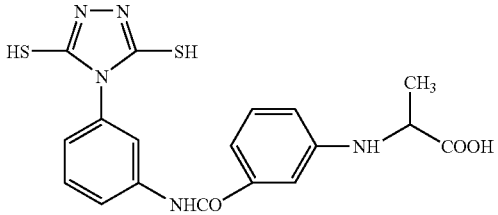
21
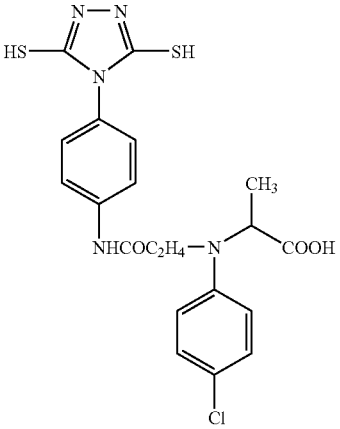
22
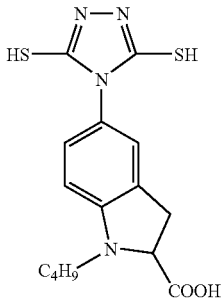

-continued
23
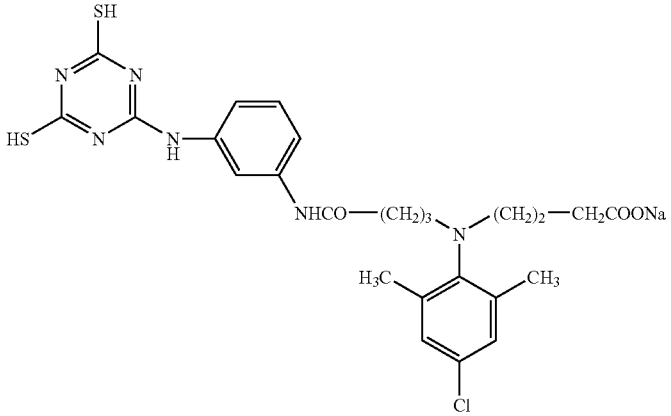
24
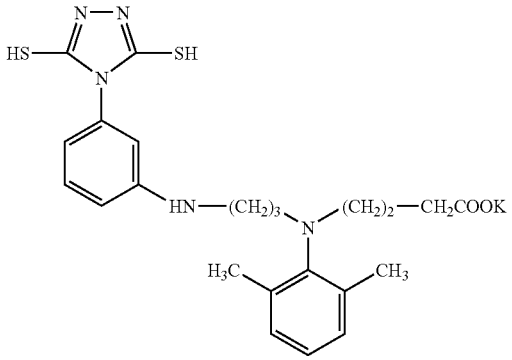
25
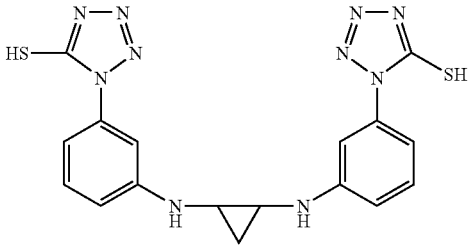
26
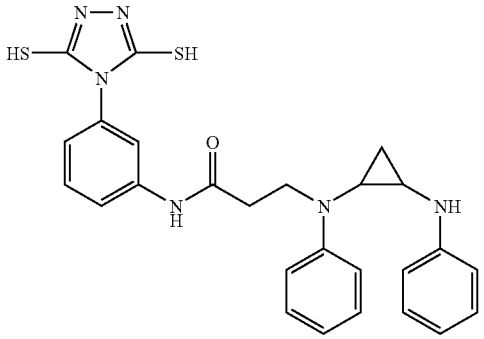
27
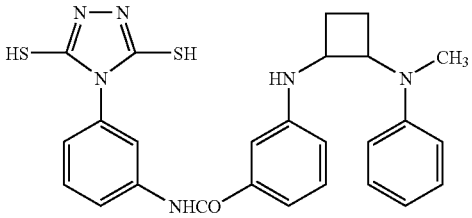
28
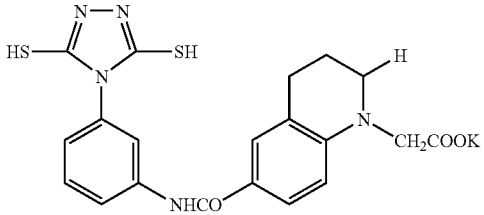
29
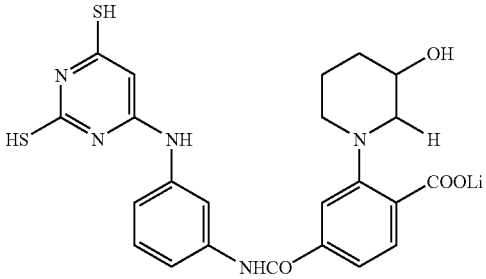

-continued
30
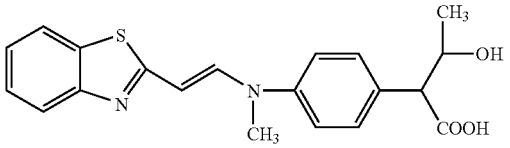
31
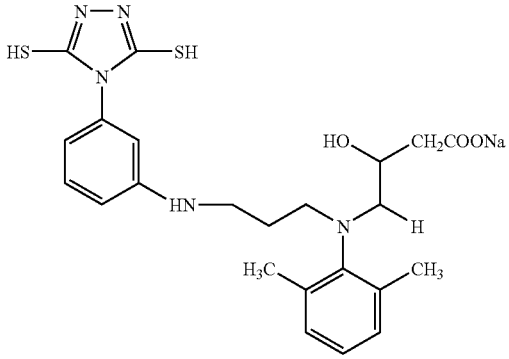
32
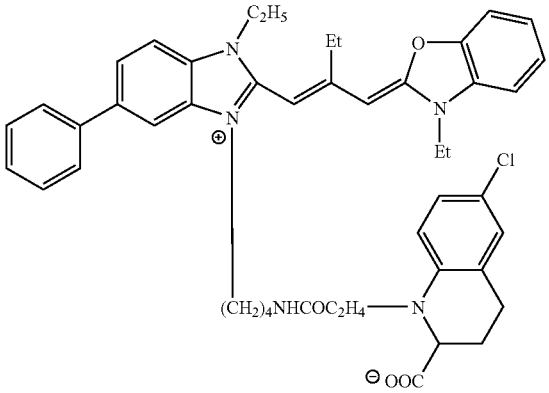
33
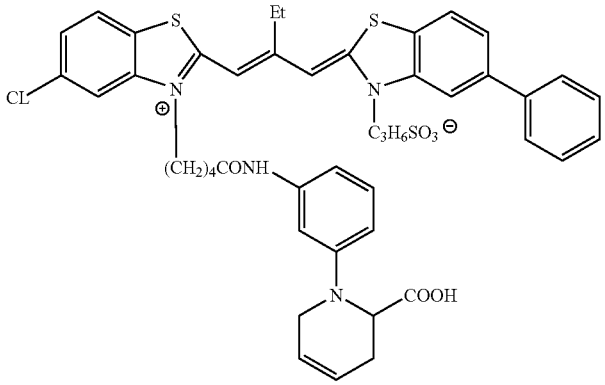
34
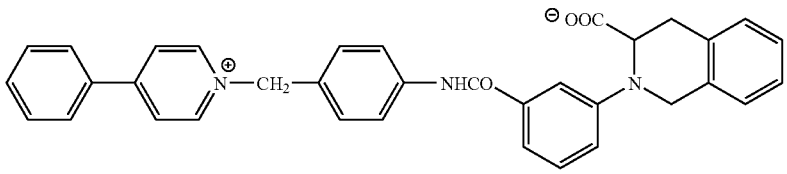

-continued

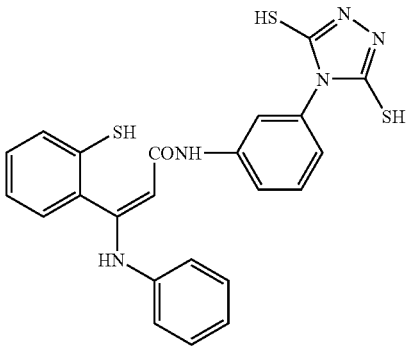

G-1

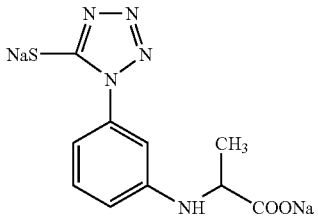

G-2

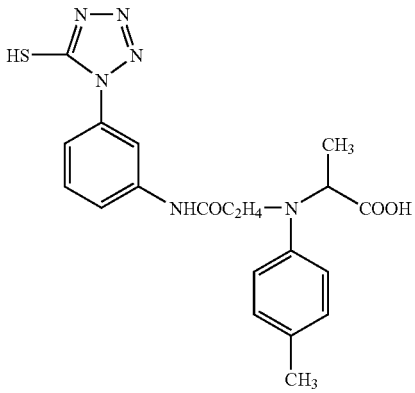

G-3

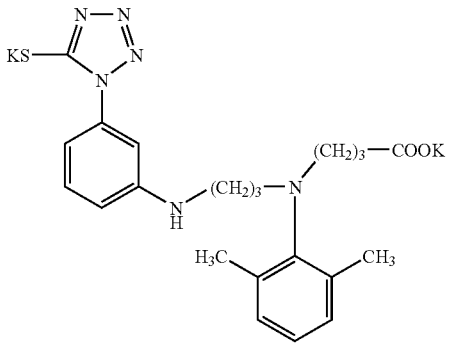

G-4

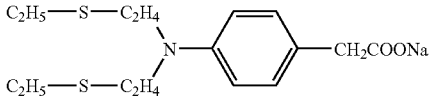

G-5

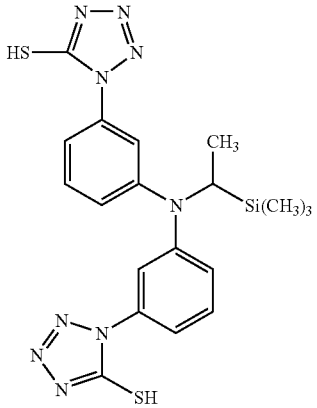

The compound of types 1 to 4 in the invention may be those described in detail in JP-A Nos. 2003-114487, 2003-114486, 2003-140287, 2003-075950 and 2003-114488. Specific example compounds described in these patent literatures are also included in specific examples of the compound of types 1 to 4 in the invention. Examples of synthesis of the compound of types 1 to 4 in the invention may be those described in these patent literatures.

Specific examples of the compound of type 5 in the invention further include examples of compounds referred to as a one-photon two-electron sensitizing agent and a deprotonation electron donating sensitizing agent described in JP-A No. 9-211769 (compounds PMT-1 to S-37 shown in Tables E and F at p. 28 to 32), JP-A No. 9-211774, JP-A No. 11-95355 (compound INV1 to 36), JP-W No. 2001-500996 (compounds 1 to 74, 80 to 87 and 92 to 122), U.S. Pat. Nos. 5,747,235 and 5,747,236, EP-A No. 786,692A1 (compounds INV1 to 35), EP-A No. 893,732A1, and U.S. Pat. Nos. 6,054,260 and 5,994,051.

The compound of types 1 to 5 in the invention may be used in any occasion upon preparation of a photosensitive silver halide emulsion and production of a photothermographic material. For example, it may be added upon forming photosensitive silver halide particles, in a desalting process, in a chemical sensitization process, and before coating. It may also be added in plural times separately in the process. The occasion of addition is preferably from completion of formation of photosensitive silver halide particles until before a desalting step, upon chemical sensitization (immediately before starting chemical sensitization and immediately after the same), and before coating, and more preferably from chemical sensitization until before mixing with a non-photosensitive organic silver salt.

The compound of types 1 to 5 in the invention is preferably added after dissolving in water, a water miscible solvent, such as methanol and ethanol, or a mixed solvent thereof. In the case where it is dissolved in water, the pH may be raised or lowered in the case of a compound that is increased in solubility upon raising or lowering the pH, followed by being added.

While the compound of types 1 to 5 in the invention is preferably used in the image forming layer containing the photosensitive silver halide and the non-photosensitive organic silver salt, it may be also added to a protective layer and an intermediate layer, in addition to the image forming layer containing the photosensitive silver halide and the non-photosensitive organic silver salt, and may be diffused upon coating. The occasion of addition of the compound to the silver halide emulsion layer may be determined irrespective to before or after the spectral sensitizing dye in an amount of preferably from $1\times10^{-9}$ to $5\times10^{-1}$ mole, and more preferably from $1\times10^{-8}$ to $5\times10^{-2}$ mole, per 1 mole of silver halide.

(10) Compound having Adsorbing Group and Reductive Group

The photothermographic material of the invention preferably contains a compound having an adsorbing group and a reductive group represented by the following general formula (I). The compound is used solely or in combination with the various kinds of chemical sensitizes described in the foregoing, so as to provide increase in sensitivity of the silver halide.

General formula (I)

$$A\text{-}(W)_n\text{—}B$$

In the general formula (I), A represents a group capable of being adsorbed on silver halide (hereinafter, referred to as an adsorbing group), W represents a divalent linking group, n represents 0 or 1, and B represents a reductive group.

The general formula (I) will be described in detail.

In the general formula (I), the adsorbing group represented by A is a group that is directly adsorbed to silver halide or a group that accelerates adsorption to silver halide, and specific examples thereof include a mercapto group (or a salt thereof), a thione group (—C(═S)—), a heterocyclic group containing at least one atom selected from a nitrogen atom, a sulfur atom, a selenium atom and a tellurium atom, a sulfide group, a disulfide group, a cationic group and an ethynyl group.

The mercapto group (or a salt thereof) as the adsorbing group means a mercapto group (or a salt thereof) itself, and simultaneously it preferably represents a heterocyclic group, an aryl group or an alkyl group having at least one mercapto group (or a salt thereof) substituted thereon. The heterocyclic group herein may be an at least 5- to 7-membered monocyclic or polycondensed aromatic or non-aromatic heterocyclic ring, and examples thereof include an imidazole ring group, a thiazole ring group, an oxazole ring group, a benzimidazole ring group, a benzthiazole ring group, a benzoxazole ring group, a triazole ring group, a thiadiazole ring group, an oxadiazole ring group, a tetrazole ring group, a purine ring group, a pyridine ring group, a quinoline ring group, an isoquinolie ring group, a pyrimidine ring group and a triazine ring group. It may also be a heterocyclic group containing a quaternarized nitrogen atom, and in this case, the substituted mercapto group may be dissociated to a mesoion. Examples of such a heterocyclic group include an imidazolium ring group, a pyrazolium ring group, a thiazolium ring group, a triazolium ring group, a tetrazolium ring group, a thiadiazolium ring group, a pyridinium ring group, a pyrimidinium ring group and a triazinium ring group, and among these a triazolium ring group (such as a 1,2,4-triazolium-3-thiolate ring group) is preferred. Examples of the aryl group include a phenyl group and a naphthyl group. Examples of the alkyl group include a linear, branched or cyclic alkyl group having from 1 to 30 carbon atoms. Examples of a counter ion in the case where the mercapto group forms a salt include a cation, such as an alkali metal, an alkaline earth metal and a heavy metal (such as $Li^+$, $Na^+$, $K^+$, $Mg^{2+}$, $Ag^+$ and $Zn^{2+}$), an ammonium ion, a heterocyclic group containing a quaternarized nitrogen atom and a phosphonium ion.

The mercapto group as the adsorbing group may be a thione group through mutual isomerization, and examples thereof include a thioamide group (which is a —C(═S)—NH— group herein) and a group containing a partial structure of the thioamide group, such as a linear or cyclic thioamide group, a thioureido group, a thiourethane group and a dithiocarbamate ester group. Examples of the cyclic group include a thiazolin-2-thione group, an oxazolin-2-thione group, a 2-thiohydantoin group, a rhodanine group, an isorhodanine group, a thio barbituric acid group and a 2-thioxo-oxazolin-4-one group.

The thione group as the adsorbing group includes, in addition to the aforementioned case where the mercapto group becomes a thione group through mutual isomerization, a linear or cyclic thioamide group, a thioureido group, a thiourethane group and a dithiocarbamate ester group, which cannot be mutually isomerized to a mercapto group (i.e., that does not have a hydrogen atom at the α-position of the thione group).

The heterocyclic group containing at least one atom selected from a nitrogen atom, a sulfur atom, a selenium atom and a tellurium atom may be a nitrogen-containing heterocyclic group having an —NH— group as a partial structure of the heterocyclic ring that is capable of forming imino silver (>NAg), or a heterocyclic group having an —S— group, an —Se— group, a —Te— group or an═N— group as a partial structure of the heterocyclic ring that is capable of being coordinated to a silver ion through a coordinate bond. Examples of the former include a benzotriazole group, a triazole group, an indazole group, a pyrazole group, a tetrazole group, a benzimidazole group, an imidazole group and purine group, and examples of the later include a thiophene group, a thiazole group, an oxazole group, a benzothiophene group, a benzthiazole group, a benzoxiazole group, a thiadiazole group, an oxadiazole group, a triazine group, a selenoazole group, a benzselenoazole group, a tellurazole group and a benztellurazole group, with the former being preferred.

Examples of the sulfide group or the disulfide group as the adsorbing group include all groups that have an —S— structure or an —S—S— structure as a partial structure, and preferred examples thereof include groups having an alkyl (or alkylene)-X-alkyl (or alkylene) structure, an aryl (or arylene)-X-alkyl (or alkylene) structure or an aryl (or arylene)-X-aryl (or arylene) structure as a partial structure, wherein X represents an —S— group or an —S—S— group. The sulfide group or the disulfide group may form a cyclic structure, and specific examples thereof in the case where a cyclic structure is formed include groups containing a thiolane ring, a 1,3-dithiolane ring, a 1,2-dithiolane ring, a thiane ring, a dithiane ring and a thiomorpholine ring. Particularly preferred examples of the sulfide group include a group having an alkyl (or alkylene)-S-alkyl (or alkylene)

partial structure, and particularly preferred examples of the disulfide group include a 1,2-dithiolen group.

The cationic group as the adsorbing group means a group containing a quaternarized nitrogen atom, and specifically an ammonio group or a group containing a nitrogen-containing heterocyclic group containing a quaternarized nitrogen atom. Examples of the ammonio group herein include a trialkylammonio group, a dialkylarylammonio group and an alkyldiarylammonio group, and specific examples thereof include a benzyldimethylammonio group, a trihexylammonio group and a phenyldiethylammonio group. Examples of the heterocyclic group containing a quaternarized nitrogen atom include a pyridinio group, a quinolinio group, an isoquinolinio group and an imidazolio group, and a pyridinio group and an imidazolinio group are preferred, with a pyridinio group being particularly preferred. The nitrogen-containing heterocyclic group containing a quaternarized nitrogen atom may have an arbitrary substituent. Preferred examples of the substituent on a pyridinio group and an imidazolio group include an alkyl group, an aryl group, an acylamino group, a chlorine atom, an alkoxycarbonyl group and a carbamoyl group, and particularly preferred examples of the substituent on a pyridinio group include a phenyl group.

The ethynyl group as the adsorbing group means a —C≡CH group, and the hydrogen atom therein may be substituted.

The aforementioned adsorbing groups may have an arbitrary substituent. Examples of the substituent include a halogen atom (such as a fluorine atom, a chlorine atom, a bromine atom and an iodine atom), an alkyl group (which may be a linear, branched or cyclic alkyl group including a bicycloalkyl group and an active methine group), an alkenyl group, an alkynyl group, an aryl group, a heterocyclic group (the substitution position is not limited), an acyl group, an alkoxycarbonyl group, an aryloxycarbonyl group, a heterocyclic carbonyl group, a carbamoyl group, an N-hydroxycarbamoyl group, an N-acylcarbamoyl group, an N-sulfonylcarbamoyl group, an N-carbamoylcarbamoyl group, a thiocarbamoyl group, an N-sulfamoylcarbamoyl group, a carbazoyl group, a carboxyl group or a salt thereof, an oxalyl group, an oxamoyl group, a cyano group, a carbonimidoyl group, a formyl group, a hydroxyl group, an alkoxy group (including a group containing ethyleneoxy group repeating units or propyleneoxy group repeating units), an aryloxy group, a heterocyclic oxy group, an acyloxy group, an (alkoxy or aryloxy)carbonyloxy group, a carbamoyloxy group, a sulfonyloxy group, an amino group, an (alkyl, aryl or hetrocyclic)amino group, an acylamino group, a sulfonamide group, an ureido group, a thioureido group, an N-hydroxyureido group an imide group, an (alkoxy or aryloxy) carbonylamino group, a sulfamoylamino group, a semicarbazide group, a thiosemicarbazide group, a hydrazino group, an ammonio group, an oxamoylamino group, an N-(alkyl or aryl)sulfonylureido group, an N-acylureido group, an N-acylsulfamoylamino group, a hydroxyamino group, a nitro group, a heterocyclic group having a quaternarized nitrogen atom (such as a pyridino group, an imidazolio group, an quinolinio group and an isoquinolinio group), an isocyano group, an imino group, a mercapto group, an (alkyl, aryl or heterocyclic)thio group, an (alkyl, aryl or heterocyclic)dithio group, an (alkyl or aryl)sulfonyl group, an (alkyl or aryl)sulfinyl group, a sulfo group or a salt thereof, a sulfamoyl group, an N-acylsulfamoyl group, a N-sulfonylsulfamoyl group or a salt thereof, a phosphino group, a phosphinyl group, a phosphinyloxy group, a phosphinylamino group and a silyl group. The active methine group herein means a methine group substituted with two electron attracting groups, and the electron attracting group herein means an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group or a carbonimidoyl group. The two electron attracting groups may be bonded to each other to form a cyclic structure. The salt herein means a cation, such as those of an alkali metal, an alkaline earth metal and a heavy metal, and an organic cation, such as an ammonium ion and a phosphonium ion.

Specific examples of the adsorbing group also include those described in JP-A No. 11-95355, p. 4 to 7.

Preferred examples of the adsorbing group represented by A in the general formula (I) include a mercapto group-substituted nitrogen-containing heterocyclic group (such as a 2-mercaptothiadiazole group, a 3-mercapto-1,2,4-triazole group, a 5-mercaptotetrazole group, a 2-mercapto-1,3,4-oxadizaole group, a 2-mercaptobenzoxazole group, a 2-mercaptobenzimidazole group and a 1,5-dimetyl-1,2,4-triazolium-3-thiolate group), a dimercapto-substituted heterocyclic group (such as a 2,4-dimercaptopyrimidine group, a 2,4-dimercaptotriazine group, a 3,5-dimercapto-1,2,4-triazole group and a 2,5-dimercapto-1,3-thiazole group), and a nitrogen-containing heterocyclic group having an —NH— group as a partial structure of the heterocyclic ring that is capable of forming imino silver (>NAg) (such as a benztriazole group, a benzimidazole group and an indazole group), particularly preferred examples thereof include a dimercapto-substituted heterocyclic group.

In the general formula (I), W represents a divalent linking group. The linking group is not particularly limited as far as it does not adversely affect the photographic property. Examples thereof include a divalent linking group constituted with a carbon atom, a hydrogen atom, an oxygen atom, a nitrogen atom and a sulfur atom. Specific examples thereof include an alkylene group having from 1 to 20 carbon atoms (such as a methylene group, an ethylene group, a trimethylene group, a tetramethylene group and a hexamethylene group), an arylene group having from 6 to 20 carbon atoms (such as a phenylene group and a naphthylene group), $—CONR_1—$, $SO_2NR_2—$, —O—, —S—, $—NR_3—$, $—NR_4CO—$, $—NR_5SO_2—$, $NR_6CONR_7—$, —COO—, —OCO— and combinations of these linking groups, wherein $R_1$, $R_2$, $R_3$, $R_4$, $R_5$, $R_6$ and $R_7$ each represents a hydrogen atom, an aliphatic group or an aryl group. Preferred examples of the aliphatic group represented by $R_1$, $R_2$, $R_3$, $R_4$, $R_5$, $R_6$ or $R_7$ include those having from 1 to 30 carbon atoms, and particularly, examples thereof include a linear, branched or cyclic alkyl group having from 1 to 20 carbon atoms, an alkenyl group, an alkynyl group and an aralkyl group (such as a methyl group, an ethyl group, an isopropyl group, a t-butyl group, an n-octyl group, an n-decyl group, an n-hexadecyl group, a cyclopropyl group, a cyclopentyl group, a cyclohexyl group, an allyl group, a 2-butenyl group, a 3-pentenyl group, a propargyl group, a 3-pentynyl group and a benzyl group). Preferred examples of the aryl group represented by $R_1$, $R_2$, $R_3$, $R_4$, $R_5$, $R_6$ or $R_7$ in the general formula (I) include those having from 6 to 30 carbon atoms, and more preferably a monocyclic or polycondensed aryl group having from 6 to 20 carbon atoms, such as a phenyl group and a naphthyl group.

The substituents represented by $R_1$, $R_2$, $R_3$, $R_4$, $R_5$, $R_6$ or $R_7$ may further have an arbitrary substituent, and the arbitrary substituent has the same meaning as the substituent on the adsorbing group.

The reductive group represented by B in the general formula (I) is a group capable of reducing a silver ion, and examples thereof include a formyl group, an amino group, a triple bond group, such as an acetylene group and a propargyl group, an alkylmercapto group, an arylmercapto group, and a residual group derived from a compound selected from a hydroxylamine compound, a hydroxamic acid compound, a hydroxyurea compound, a hydroxyurethane compound, a hydroxysemicarbazide compound, a reductone compound (including a reductone derivative), an aniline compound, a phenol compound (including a chroman-6-ol compound, a 2,3-dihydrobenzofuran-5-ol compound, an aminophenol compound, a sulfonamidophenol compound, and a polyphenol compound, such as a hydroquinone compound, a catechol compound, a resorcinol compound, a benzenetriol compound and a bisphenol compound), a hydrazine compound, a hydrazide compound and a phenydone compound.

The hydroxylamine compound is represented by the general formula (B1), the hydroxamic acid compound is represented by the general formula (B2), the hydroxyurea compound is represented by the general formula (B3), the hydroxyurethane compound is represented by the general formula (B4), the hydroxysemicarbazide compound is represented by the general formula (B5), the reductone compound is represented by the general formula (B6), the aniline compound is represented by the general formula (B7), the phenol compound is represented by the general formulae (B8), (B9) and (B10), the hydrazine compound is represented by the general formula (B11), the hydrazide compound is represented by the general formula (B12), and the phenydone compound is represented by the general formula (B13).

(B1)

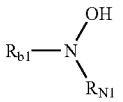

(B2)

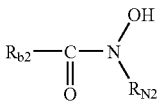

(B3)

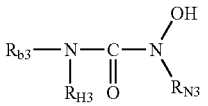

(B4)

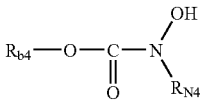

(B5)

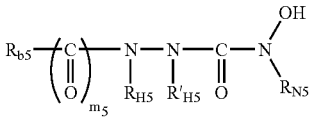

(B6)

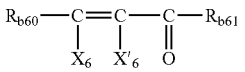

-continued (B7)

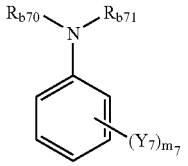

(B8)

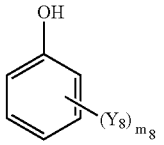

(B9)

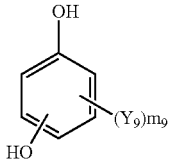

(B10)

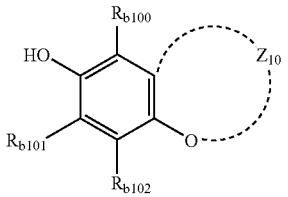

(B11)

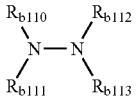

(B12)

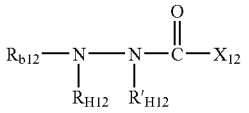

(B13)

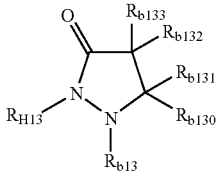

In the general formulae (B1) to (B13), $R_{b1}$, $R_{b2}$, $R_{b3}$, $R_{b4}$, $R_{b5}$, $R_{b70}$, $R_{b71}$, $R_{b110}$, $R_{b111}$, $R_{b112}$, $R_{b113}$, $R_{b12}$, $R_{b13}$, $R_{N1}$, $R_{N2}$, $R_{N3}$, $R_{N4}$ and $R_{N5}$ each independently represents a hydrogen atom, an alkyl group, an aryl group or a heterocyclic group, $R_{H3}$, $R_{H5}$, $R'_{H5}$, $R_{H12}$, $R'_{H12}$ and $R_{H13}$ each independently represents a hydrogen atom, an alkyl group, an aryl group, an acyl group, an alkylsulfonyl group or an arylsulfonyl group, and among these $R_{H3}$ may be a hydroxyl group. $R_{b100}$, $R_{b101}$, $R_{b102}$ and $R_{b130}$ to $R_{b133}$ each represents a hydrogen atom or a substituent. $Y_7$ and $Y_8$ each independently represents a substituent other than hydroxyl group, $Y_9$ represents a substituent, $m_5$ represents 0 or 1, $m_7$ represents an integer of from 0 to 5, $m_8$ represents an integer of from 1 to 5, and $m_9$ represents an integer of from 0 to 4. $Y_7$, $Y_8$ and $Y_9$ each may also be an aryl group condensed with a benzene ring (such as a benzene condensed ring), which may further have a substituent. $Z_{10}$ represents a non-metallic atomic group capable of forming a ring, and $X_{12}$ represents a hydrogen atom, an alkyl group, an aryl group, a heterocyclic group, an alkoxy group, an amino group (including an alkylamino group, an arylamino group, a heterocyclic amino group and a cyclic amino group) or a carbamoyl group.

In the general formula (B6), $X_6$ and $X'_6$ each independently represents a hydroxyl group, an alkoxy group, a mercapto group, an alkylthio group, an amino group (including an alkylamino group, an arylamino group, a heterocyclic amino group and a cyclic amino group), an acylamino group, a sulfonamide group, an alkoxycarbonylamino group, an ureido group, an acyloxy group, an acylthio group, an alkylaminocarbonyloxy group or an arylaminocarbonyloxy group, $R_{b60}$ and $R_{b61}$ each represents an alkyl group, an aryl group, an amino group, an alkoxy group or an aryloxy group, and $R_{b60}$ and $R_{b61}$ may be bonded to each other to form a cyclic structure.

In the aforementioned description for the general formulae (B1) to (B 13), the alkyl group means a linear, branched or cyclic substituted or unsubstituted alkyl group having from 1 to 30 carbon atoms, the aryl group means a monocyclic or polycondensed substituted or unsubstituted aromatic hydrocarbon ring, such as a phenyl group and a naphthyl group, and the heterocyclic group means an aromatic or non-aromatic monocyclic or polycondensed substituted or unsubstituted heterocyclic ring containing at least one hetero atom.

The substituent described in the aforementioned description for the general formulae (B1) to (B13) has the same meaning as the substituent on the adsorbing group. The substituent may be further substituted with the substituent.

In the general formulae (B1) to (B5), $R_{N1}$, $R_{N2}$, $R_{N3}$, $R_{N4}$ and $R_{N5}$ each is preferably a hydrogen atom or an alkyl group, and the alkyl group is preferably a linear, branched or cyclic substituted or unsubstituted alkyl group having from 1 to 12 carbon atoms, and more preferably a linear or branched substituted or unsubstituted alkyl group having from 1 to 6. Examples thereof include a methyl group, an ethyl group, a propyl group, and a benzyl group.

In the general formula (B1), $R_{b1}$ preferably represents an alkyl group or a heterocyclic group. The alkyl group is a linear, branched or cyclic substituted or unsubstituted alkyl group, which is preferably an alkyl group having from 1 to 30 carbon atoms, and more preferably an alkyl group having from 1 to 18 carbon atoms. The heterocyclic group is a 5-membered or 6-membered monocyclic or polycondensed aromatic or non-aromatic heterocyclic group, which may have a substituent. The heterocyclic group is preferably an aromatic heterocyclic group, such as a pyridine ring group, a pyrimidine ring group, a triazine ring group, a thiazole ring group, a benzothiazole ring group, an oxazole ring group, a benzoxazole ring group, an imidazole ring group, a benzimidazole ring group, a pyrazole ring group, an indazole ring group, an indole ring group, a purine ring group, a quinoline ring group, an isoquinoline ring group and a quinazoline ring group, with a triazine ring group and a benzothiazole ring group being preferred. The case where the alkyl group or the heterocyclic group represented by $R_{b1}$ has one or two or more —N($R_{N1}$)OH groups as substituents is a preferred example of the compound represented by the general formula (B1).

In the general formula (B2), $R_{b2}$ preferably represents an alkyl group, an aryl group or a heterocyclic group, and more preferably an alkyl group or an aryl group. A preferred range of the alkyl group is the same as in $R_{b1}$. The aryl group is preferably a phenyl group or a naphthyl group, and particularly preferably a phenyl group, which may have a substituent. The case where the alkyl group or the heterocyclic group represented by $R_{b2}$ has one or two or more —CON($R_{N2}$)OH groups as substituents is a preferred example of the compound represented by the general formula (B2).

In the general formula (B3), Rb3 preferably represents an alkyl group or an aryl group, and preferred ranges thereof are the same as $R_{b1}$ and $R_{b2}$. $R_{H3}$ preferably represents a hydrogen atom, an alkyl group or a hydroxyl group, and more preferably a hydrogen atom. The case where the group represented by $R_{b3}$ has one or two or more —N($R_{H3}$)CON($R_{N3}$)OH groups as substituents is a preferred example of the compound represented by the general formula (B3). $R_{b3}$ and $R_{N3}$ may be bonded to each other to form a cyclic structure (preferably, a 5-membered or 6-membered saturated heterocyclic ring).

In the general formula (B4), $R_{b4}$ preferably represents an alkyl group, and a preferred range thereof is the same as $R_{b1}$. The case where the group represented by $R_{b4}$ has one or two or more —OCON($R_{N4}$)OH groups as substituents is a preferred example of the compound represented by the general formula (B4).

In the general formula (B5), $R_{b5}$ preferably represents an alkyl group or an aryl group, and more preferably an aryl group, and preferred ranges thereof are the same as $R_{b1}$ and $R_{b2}$. $R_{H5}$ and $R'_{H5}$ each preferably represents a hydrogen atom or an alkyl group, and more preferably a hydrogen atom.

In the general formula (B6), $R_{b60}$ and $R_{b61}$ are preferably bonded to each other to form a cyclic structure. The cyclic structure formed herein is a 5- to 7-membered non-aromatic carbon ring or heterocyclic ring, which may be a monocyclic ring or a polycondensed ring. Specific preferred examples of the cyclic structure include a 2-cyclopenten-1-one ring, a 2,5-dihydrofuran-2-one ring, a 3-pyrroline-2-one ring, a 4-pyrazolin-3-one ring, a 2-cyclohexen-1-one ring, a 5,6-dihydro-2H-pyran-2-one ring, a 5,6-dihydro-2-pyridone ring, a 1,2-dihydronaphthalen-2-one ring, a coumarin ring (a benzo-α-pyran-2-one ring), a 2-quinolone ring, a 1,4-dihydronaphthalen-1-one ring, a chromone ring (a benzo-γ-pyran-4-one ring), a 4-quinolone ring, an inden-1-one ring, a 3-pyrrolin-2,4-dione ring, an uracil ring, a thiouracil ring and a dithiouracil ring, more preferred examples thereof include a 2-cyclopenten-1-one ring, a 2,5-dihydrofuran-2-one ring, a 3-pyrroline-2-one ring, a 4-pyrazolin-3-one ring, a 1,2-dihydronaphthalen-2-one ring, a coumarin ring (a benzo-α-pyran-2-one ring), a 2-quinolone ring, a 1,4-dihydronaphthalen-1-one ring, a chromone ring (a benzo-γ-pyran-4-one ring), a 4-quinolone ring, an inden-1-one ring and a dithiouracil ring, and further preferred examples thereof include a 2-cyclopenten-1-one ring, a 2,5-dihydrofuran-2-one ring, a 3-pyrroline-2-one ring, an inden-1-one ring and a 4-pyrazolin-3-one ring.

In the case where $X_6$ and $X'_6$ each represents a cyclic amino group, the cyclic amino group is a non-aromatic nitrogen-containing heterocyclic ring bonded through a nitrogen atom, and examples thereof include a pyrrolidino group, a piperidino group, a piperadino group, a morpholino group, a 1,4-thiazin-4-yl group, a 2,3,5,6-tetrahydro-1,4-thiazin-4-yl group and an indolyl group.

$X_6$ and $X'_6$ each preferably represents a hydroxyl group, a mercapto group, an amino group (including an alkylamino group, an arylamino group and a cyclic amino group), an acylamino group, a sulfonamide group, an acyloxy group or an acylthio group, more preferably a hydroxyl group, a mercapto group, an amino group, an alkylamino group, a cyclic amino group, a sulfonamide group, an acylamino group or an acyloxy group, and particularly preferably a hydroxyl group, an amino group, an alkylamino group or a cyclic amino group. At least one of $X_6$ and $X'_6$ is preferably a hydroxyl group.

In the general formula (B7), $R_{b70}$ and $R_{b71}$ each preferably represents a hydrogen atom, an alkyl group or an aryl group, and more preferably an alkyl group. A preferred range of the alkyl group is the same as $R_{b1}$. $R_{b70}$ and $R_{b71}$ may be bonded to each other to form a cyclic structure (such as a pyrrolidine ring, a piperidine ring, a morpholino ring and a thiomorpholino ring). Preferred examples of the substituent represented by $Y_7$ include an alkyl group (a preferred range thereof being the same as $R_{b1}$), an alkoxy group, an amino group, an acylamino group, a sulfonamide group, an ureido group, an acyl group, an alkoxycarbonyl group, a carbamoyl group, a sulfamoyl group, a chlorine atom, a sulfo group or a salt thereof, and a carboxyl group or a salt thereof, and $m_7$ preferably represents from 0 to 2.

In the general formula (B8), $m_8$ is preferably from 1 to 4, and plural groups represented by $Y_8$ may be the same or different. $Y_8$ the case where $m_8$ is 1, or at least one of plural $Y_8$ when $m_8$ is 2 or more is preferably an amino group (including an alkylamino group and an arylamino group), a sulfonamide group or an acylamino group. In the case where $m_8$ is 2 or more, remaining groups represented by $Y_8$ each preferably represents a sulfonamide group, an acylamino group, an ureido group, an alkyl group, an alkylthio group, an acyl group, an alkoxycarbonyl group, a carbamoyl group, a sulfo group or a salt thereof, a carboxyl group or a salt thereof, or a chlorine atom. In the case where o'-(or p')-hydroxyphenylmethyl group (which may further have a substituent) is substituted at an o-position or a p-position with respect to the hydroxyl group as the substituent represented by $Y_8$ it represents a group of compounds that are generally referred to as bisphenol compounds, which are also preferred examples of the compound represented by the general formula (B8). It is significantly preferred that $Y_8$ represents a benzene condensed ring, and as a result, the general formula (B8) represents a naphthol compound.

In the general formula (B9), the substitution position of the two hydroxyl groups may be an o-position (i.e., a catechol compound), a m-position (i.e., a resorcinol compound), or a p-position (i.e., a hydroquinone compound). $m_9$ is preferably from 1 to 2, and plural groups represented by $Y_9$ may be the same or different. Preferred examples of the substituent represented by $Y_9$ include a chlorine atom, an acylamino group, an ureido group, a sulfonamide group, an alkyl group, an alkylthio group, an alkoxy group, an acyl group, an alkoxycarbonyl group, a carbamoyl group, a sulfo group or a salt thereof, a carboxyl group or a salt thereof, a hydroxyl group, an alkylsulfonyl group and an arylsulfonyl group. Such a case is also preferred that $Y_9$ represents a benzene condensed ring, and as a result, the general formula (B9) represents a 1,4-naphthohydroquinone compound. In the case where the general formula (B9) represents a catechol compound, $Y_9$ particularly preferably represents a sulfo group or a salt thereof, or a hydroxyl group.

In the general formula (B10), in the case where $R_{b100}$, $R_{b101}$ and $R_{b102}$ each represents a substituent, preferred examples of the substituent are the same as the preferred examples of $Y_9$. Among these, an alkyl group (particularly a methyl group) is preferred. The cyclic structure formed by $Z_{10}$ is preferably a chroman ring or a 2,3-dihydrobenzofuran ring, and these cyclic structures may have a substituent and may form a spiro ring.

In the general formula (B11), $R_{b110}$, $R_{b111}$, $R_{b112}$ and $R_{b113}$ each preferably represents an alkyl group, an aryl group or a heterocyclic group, and preferred ranges thereof are the same as $R_{b1}$ and $R_{b2}$. Among these, an alkyl group is preferred, and two alkyl groups among $R_{b110}$ to $R_{b113}$ may be bonded to each other to form a cyclic structure. The cyclic structure herein is a 5-membered or 6-membered non-aromatic heterocyclic ring, and examples thereof include a pyrrolidine ring, a piperidine ring, a morpholino ring, a thiomorpholino ring and a hexahydropyridazine ring.

In the general formula (B12), $R_{b12}$ preferably represents an alkyl group, an aryl group or a heterocyclic group, and preferred ranges thereof are the same as $R_{b1}$ and $R_{b2}$. $X_{12}$ preferably represents an alkyl group, an aryl group (particularly a phenyl group), a heterocyclic group, an alkoxy group, an amino group (including an alkylamino group, an arylamino group, a heterocyclic amino group and a cyclic amino group) and a carbamoyl group, and more preferably an alkyl group (particularly preferably an alkyl group having from 1 to 8 carbon atoms), an aryl group (particularly preferably a phenyl group) and an amino group (including an alkylamino group, an arylamino group and a cyclic amino group). $R_{H12}$ and $R'_{H12}$ each preferably represents a hydrogen atom or an alkyl group, and more preferably a hydrogen atom.

In the general formula (B13), $R_{b13}$ preferably represents an alkyl group or an aryl group, and preferred ranges thereof are the same as $R_{b1}$ and $R_{b2}$. $R_{b130}$, $R_{b131}$, $R_{b132}$ and $R_{b133}$ each preferably represents a hydrogen atom, an alkyl group (particularly preferably an alkyl group having from 1 to 8 carbon atoms) or an aryl group (particularly preferably a phenyl group). $R_{H13}$ preferably represents a hydrogen atom or an acyl group, and more preferably a hydrogen atom.

Preferred examples of the reductive group represented by B in the general formula (I) include a hydroxylamine compound, a hydroxamic acid compound, a hydroxyurea compound, a hydroxysemicarbazide compound, a phenol compound, a hydrazine compound, a hydrazide compound and a phenidone compound, and particularly preferred examples thereof include a hydroxyurea compound, a hydroxysemicarbazide compound, a phenol compound, a hydrazide compound and a phenidone compound.

The reductive group represented by B in the general formula (I) can be measured for an oxidation potential thereof by measurement methods described in A. Fujishima, Denkikagaku Sokuteihou (Electrochemical Measurement Methods), p. 150 to 208 (Gihodou Publishing Co., Ltd.) and Jikken Kagaku Koza (Lectures on Experimental Chemistry), 4th edition, vol. 9, p. 282 to 344, edited by the Chemical Society of Japan, (Maruzen Co., Ltd.). Specific examples thereof include a rotation disk voltammetry technique, in which a sample is dissolved in a mixed solution of methanol and a Britton-Robinson buffer solution (pH 6.5) (10/90 in terms of % by volume), after nitrogen gas is bubbled therein for 10 minutes, the oxidation potential is measured by using a glassy carbon rotating disk electrode (RDE) as an operating electrode, a platinum wire as a counter electrode and a saturated calomel electrode as a reference electrode at 25° C., 1,000 rpm and a sweep rate of 20 mV/sec. A half-wave potential (E1/2) can be obtained from a voltammogram thus obtained.

In the case where the reductive group represented by B in the invention is measured in the aforementioned method, the oxidation potential thereof is preferably in a range of about from −0.3 to 1.0 V, more preferably in a range of from about −0.1 to 0.8 V, and particularly preferably about from 0 to 0.7 V.

The most the reductive group represented by B in the invention are compounds known in the photographic industry, and examples thereof are also described, for example, in JP-A Nos. 2001-42466, 8-114884, 8-314051, 8-333325, 9-133983, 11-282117, 10-246931, 10-90819, 9-54384, 10-171060 and 7-77783. Examples of the phenol compound include compounds described in U.S. Pat. No. 6,054,260 (a general formula shown in columns 60 to 63 and example compounds thereof).

The compound represented by the general formula (I) in the invention may be those having a ballast group or a polymer chain incorporated therein, which are ordinarily used in an immobilized photographic additive, such as a coupler. Examples of the polymer also include those described in JP-A No. 1-100530.

The compound represented by the general formula (I) in the invention may be a bis body or a tris body. The molecular weight of the compound represented by the general formula (I) in the invention is preferably from 100 to 10,000, more preferably from 120 to 1,000, and particularly preferably from 150 to 500.

Examples of the compound represented by the general formula (I) in the invention are shown below, but the invention is not limited thereto.

(1)

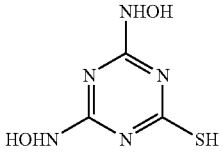

(2)

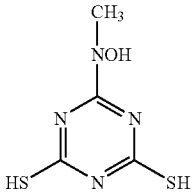

(3)

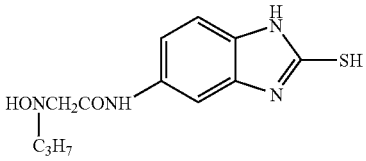

(4)

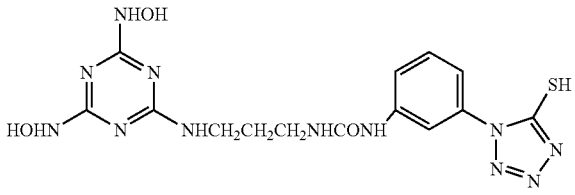

(5)

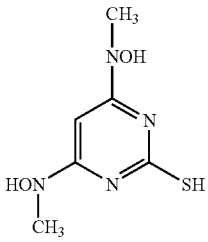

-continued (6)

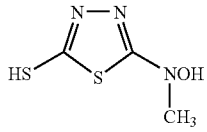

(7)

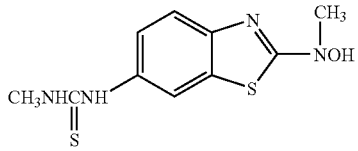

(8)

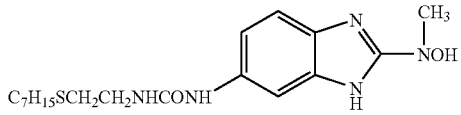

(9)

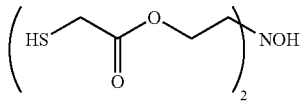

(10)

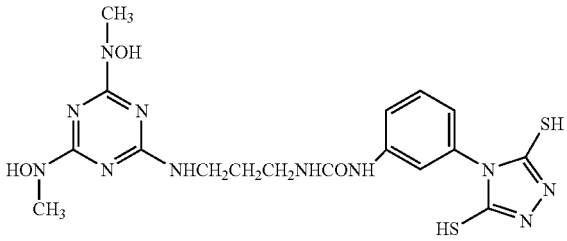

(19)

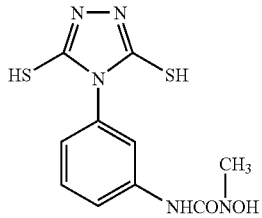

(20)

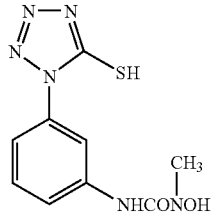

(21)

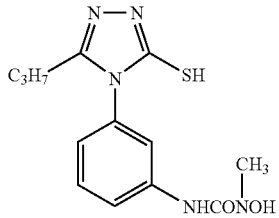

(22)

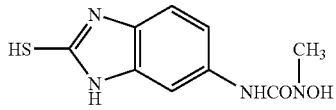

-continued
(23)
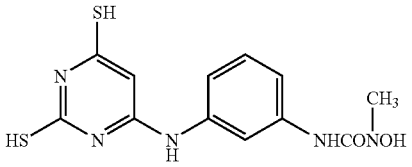
(24)
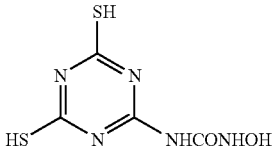
(25)
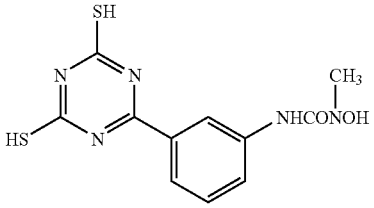
(26)
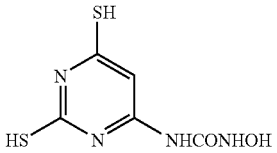
(27)
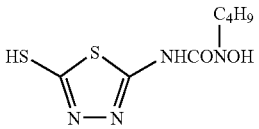
(28)
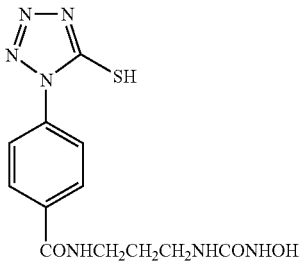
(29)
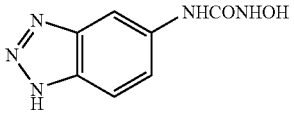
(30)
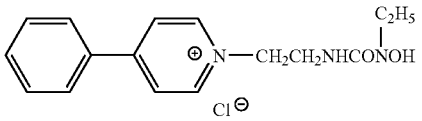
-continued
(41)
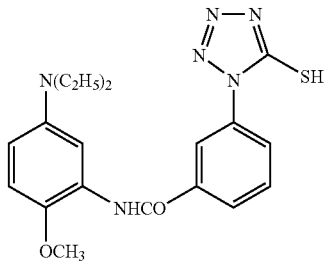
(42)
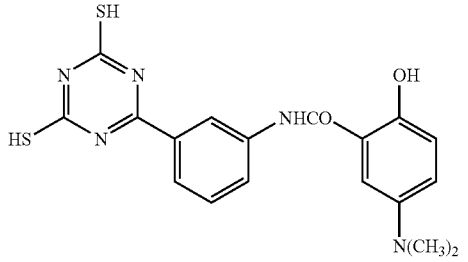
(43)
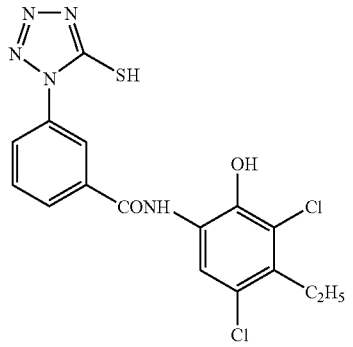
(44)
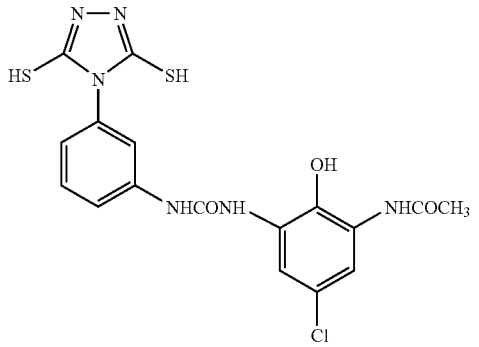
(45)
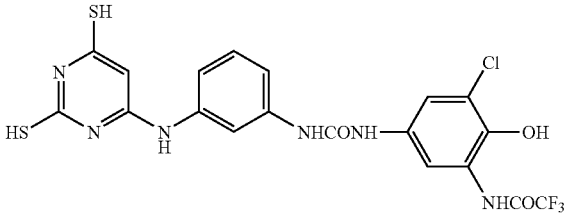

-continued
(46)
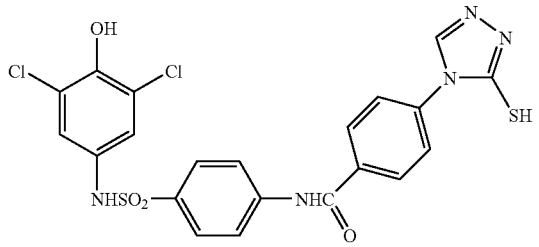
(47)
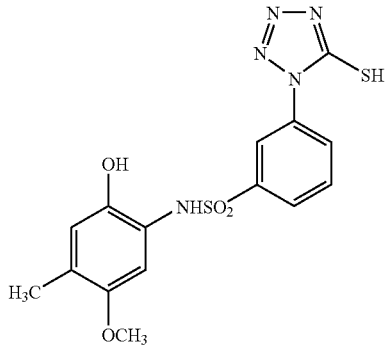
(48)
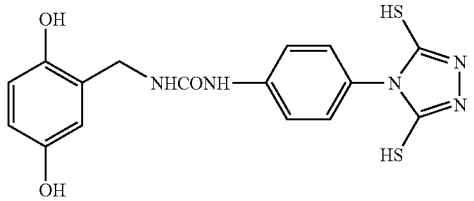
(49)
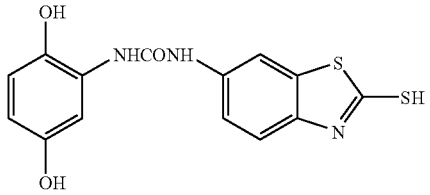
(50)
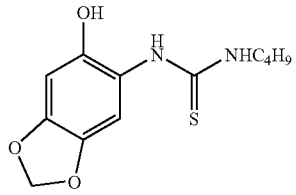
(61)
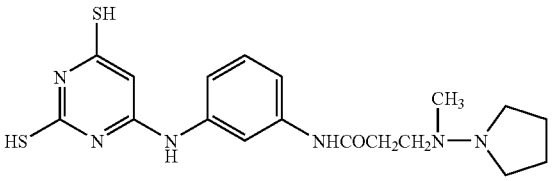
-continued
(62)
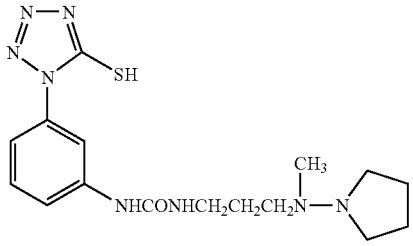
(63)
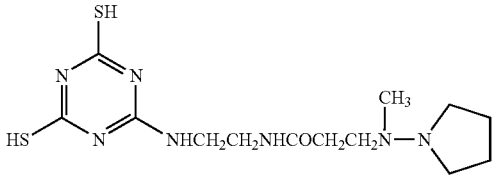
(64)
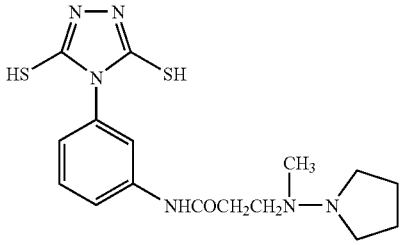
(65)
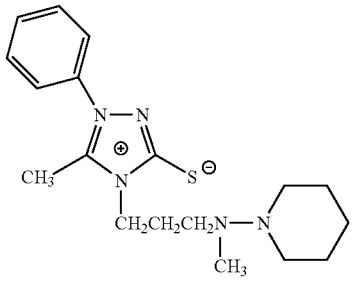
(66)
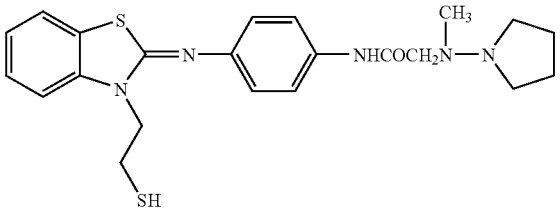
(67)
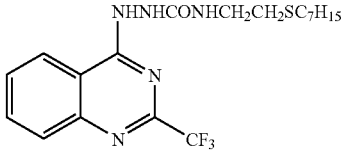
(68)
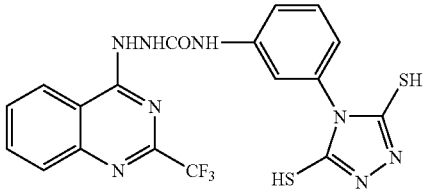

-continued
(69)
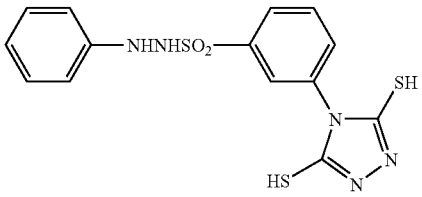
(70)
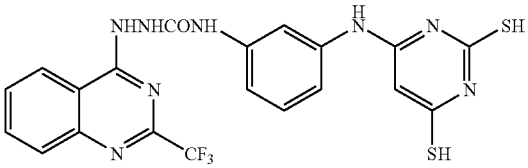
(71)
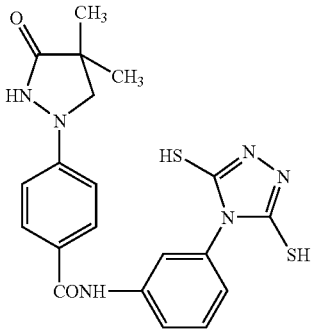
(72)
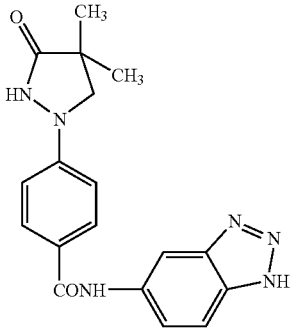
(73)
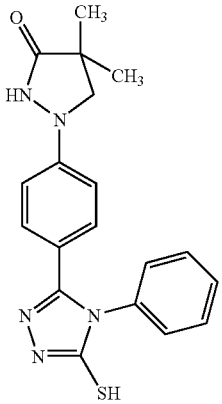
-continued
(74)
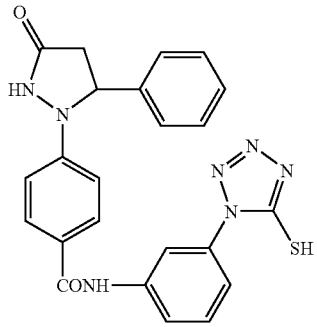
(75)
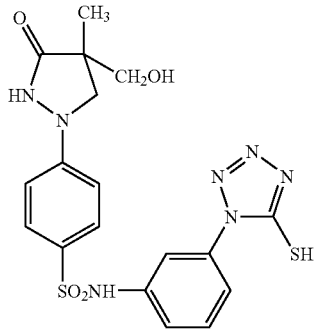
(76)
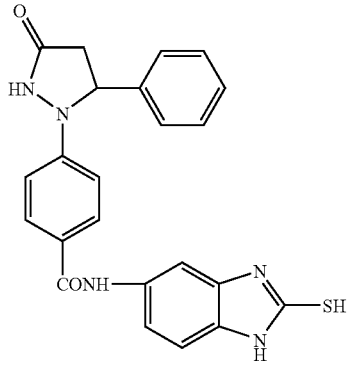
(77)
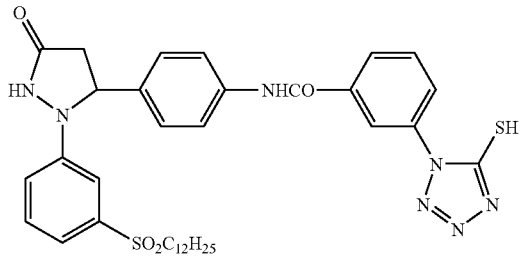

-continued (78)

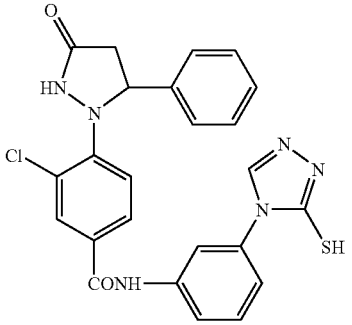

(79)

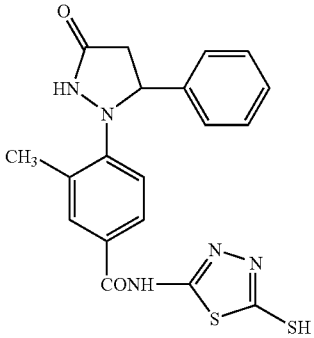

(80)

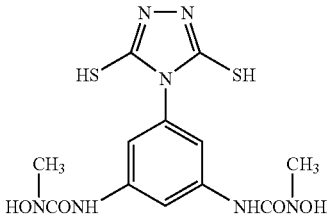

(81)

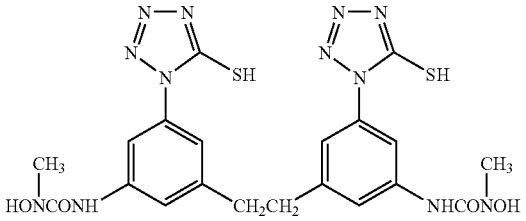

(82)

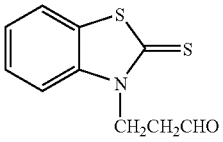

(83)

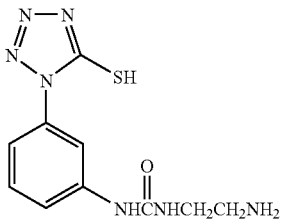

-continued (84)

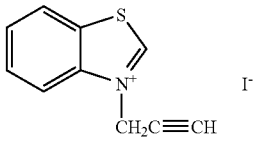

(85)

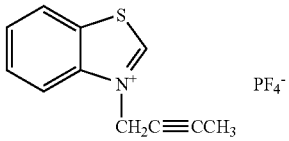

(86)

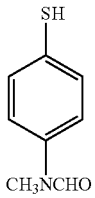

(87)

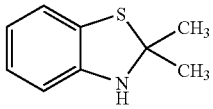

(88)

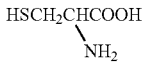

(89)

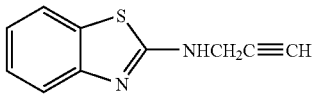

(90)

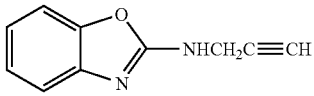

These compounds can be easily synthesized according to a known method.

The compound represented by the general formula (I) in the invention may be used solely, and it is preferred that two or more kinds of the compounds are simultaneously used. In the case where two or more kinds of the compounds are used, they may be added to the same layer or may be added to different layers, and the addition methods thereof may be different from each other.

The compound represented by the general formula (I) in the invention is preferably added to a silver halide image forming layer, and is preferably added upon preparation of an emulsion. In the case where it is added upon preparation of an emulsion, it may be added upon any occasion during the process, and examples thereof include during formation process of silver halide particles, before starting a desalting step, upon a desalting step, before starting chemical ripening, upon chemical ripening, and upon a step before preparation of a completed emulsion. The compound may be added separately in plural times upon these steps. The compound is preferably added to the image forming layer, and may be added to a protective layer or an intermediate layer adjacent to the image forming layer, followed by being diffused upon coating.

The preferred addition amount thereof largely depends on the addition method and the compound species as described in the foregoing, and is generally from $1\times10^{-6}$ to 1 mole, preferably from $1\times10^{-5}$ to $5\times10^{-1}$ mole, and more preferably from $1\times10^{-4}$ to $1\times10^{-1}$ mole, per 1 mole of photosensitive silver halide.

The compound represented by the general formula (I) in the invention may be added after dissolving in water, a water miscible solvent, such as methanol and ethanol, or a mixed solvent thereof. At this time, the pH may be adjusted with an acid or a base, and a surface active agent may be used in combination. The compound may also be added as an emulsion dispersion by dissolving in a high boiling point organic solvent, and may be added as a solid dispersion.

(12) Sensitizing Dye

The sensitizing dye that can be applied to the invention is one capable of spectrally sensitizing silver halide particles within a desired wavelength region upon adsorbing on silver halide particles, and such a sensitizing dye can be advantageously selected that has a spectral sensitivity suitable for spectral characteristics of an exposure light source. It is preferred that the photothermographic material of the invention is spectrally sensitized to have a spectral sensitivity peak in a rage of from 600 to 900 nm, or a range of from 300 to 500 nm. The sensitizing dye and the addition method thereof are described in paragraphs 0103 to 0109 of JP-A No. 11-65021, a compound represented by the general formula (II) in JP-A No. 10-186572, a dye represented by the general formula (I) and paragraph 0106 of JP-A No. 11-119374, U.S. Pat. No. 5,510,236, dyes described in Example 5 of U.S. Pat. No. 3,871,887, JP-A No. 2-96131, a dye described in JP-A No. 59-48753, page 19, line 38 to page 20, line 35 of EP-A No. 0,803,764A1, and JP-A Nos. 2001-272747, 2001-290238 and 2002-023306. The sensitizing dye may be used solely or in combination of two or more kinds thereof.

The addition amount of the sensitizing dye in the invention may be a desired amount corresponding to performance in sensitivity and fogging, and is preferably from $10^{-6}$ to 1 mole, and more preferably from $10^{-4}$ to $10^{-1}$ mole, per 1 mole of silver halide in the image forming layer.

In order to improve the efficiency of spectral sensitization in the invention, a chromatic sensitizing agent may be used. Examples of the chromatic sensitizing agent used in the invention include compounds described in EP-A No. 587, 338, U.S. Pat. Nos. 3,877,943 and 4,873,184, and JP-A Nos. 5-341432, 11-109547 and 10-111543.

(13) Combination Use of Silver Halide

The photosensitive silver halide emulsion used in the photothermographic material of the invention may be used solely or in combination of two or more kinds thereof (for example, those having different average particle sizes, different halogen compositions, different crystal habits, or different conditions for chemical sensitization). The use of plural kinds of silver halides having different sensitivities can adjust the gradation. Techniques relating thereto are described in JP-A Nos. 57-119341, 53-106125, 47-3929, 48-55730, 46-5187, 50-73627 and 57-150841. The difference in sensitivity is preferably 0.2 logE for the respective emulsions.

(14) Mixing of Silver Halide and Organic Silver Salt

It is particularly preferred that the particles of photosensitive silver halide in the invention are formed and chemically sensitized in the absence of a non-photosensitive organic silver salt. This is because there are some cases where the method where silver halide is formed by adding a halogenating agent to an organic silver salt cannot attain the sufficient sensitivity.

Examples of the method for mixing a silver halide and an organic silver salt include a method, in which a photosensitive silver halide and an organic silver salt, which have been separately prepared, are mixed in a ball mill, a sand mill, a colloid mill, a vibration mill or a homogenizer, and a method, in which a photosensitive silver halide is mixed on any occasion during preparation of an organic silver salt, and then the preparation of an organic silver salt is completed. The effect of the invention can be obtained by any of these methods.

(15) Mixing of Silver Halide to Coating Composition

The timing of adding the silver halide to the coating composition for forming the image forming layer in the invention may be from 180 minutes before coating to immediately before coating, and preferably 60 minutes before coating to 10 seconds before coating. The mixing method and the mixing conditions are not particularly limited as far as the effect of the invention can be sufficiently exerted. Specific examples of the mixing method include a method for mixing in a tank, in which the average residence time calculated from the addition flow amount and the liquid delivery amount to a coater is adjusted to a desired value, and a method using a static mixer described in N. Harnby, M. F. Edwards and A. W. Neinow, translation by K. Takahashi, Ekitai Kongo Gijutu (Liquid Mixing Technologies), chapter 8, (published by Nikkan Kogyo Shimbun, Ltd. on 1989).

[Description of Organic Silver Salt]

The non-photosensitive organic silver salt used in the invention is such a silver salt that is relatively stable to light, and forms a silver image upon heating to 80° C. or higher in the presence of an exposed photosensitive silver halide and a reducing agent. The organic silver salt may be an arbitrary organic substance containing a source capable of reducing a silver ion. The non-photosensitive silver salt is described in paragraphs 0048 to 0049 of JP-A No. 10-62899, page 18, line 24 to page 19, line 37 of EP-A No. 0,803,764A1, EP-A No. 0,962,812A1, JP-A Nos. 11-349591, 2000-7683 and 2000-72711. A silver salt of an organic acid, particularly a silver salt of a long-chain aliphatic carboxylic acid (particularly having from 10 to 30 carbon atoms, and preferably from 15 to 28 carbon atoms), is preferred. Preferred examples of the organic silver salt include silver behenate, silver arachidinate, silver stearate, silver oleate, silver laurate, silver caproate, silver myristate, silver palmitate and a mixture thereof. Among these organic silver salts, an organic silver salt containing from 50 to 100% by mole, more preferably from 75 to 98% by mole, of silver behenate is preferably used in the invention.

The shape of the organic silver salt that can be used in the invention is not particularly limited and may be a needle shape, a rod shape, a tabular shape and a flaky shape.

An organic silver salt in a flaky shape is preferably used in the invention. The organic silver salt having a flaky shape in the invention is defined as follows. An organic silver salt is observed with an electron microscope, and the shape of the organic silver salt particles is approximated to a rectangular parallelepiped. The lengths of the edges of the rectangular parallelepiped are designated as a, b and c from the shorter one (where b and c may be the same), and x is calculated from the shorter two values a and b according to the following equation.

$$x=b/a$$

The value x is obtained for about 200 particles, and particles having an average of the values x (average) satisfying x (average)≧1.5 are defined as particles having a flaky shape. The value x preferably satisfies 30≧x (average)≧1.5, and more preferably 15≧x (average)≧1.5. The needle-like shape is defined by 1≦x (average)<1.5.

In the flaky shape particles, the value a can be understood as a thickness of a tabular particle having a plane formed by edges b and c as a principal plane. The average value of a is preferably from 0.01 to 0.3 μm, and more preferably from 0.1 to 0.23 μm. The average value of c/b is preferably from 1 to 6, more preferably from 1 to 4, further preferably from 1 to 3, and particularly preferably from 1 to 2.

The particle size distribution of the organic silver salt is preferably mono-dispersion. The mono-dispersion means that the percentages of a values obtained by dividing standard deviations of the lengths of the shorter axis and the longer axis by the lengths of the shorter axis and the longer axis, respectively, are preferably 100% or less, more preferably 80% or less, and further preferably 50% or less. The shape of the organic silver salt can be measured from an image the organic silver salt dispersion observed with a transmission electron microscope. As another method for measuring the mono-dispersion property, it can be measured from a standard deviation of a volume weighted average particle diameter of the organic silver salt, and a percentage of a value obtained by dividing the standard deviation by the volume weighted average particle diameter (i.e., variation coefficient) is preferably 100% or less, more preferably 80% or less, and further preferably 50% or less. The measurement may be carried out, for example, in such a manner that an organic silver salt dispersed in a liquid is irradiated with laser light, an autocorrelation function of the wobble of the scattered light with respect to time-rate-of-change is obtained to calculate the particle size (the volume weighted average particle diameter), from which the mono-dispersion property is obtained.

As the production method and the dispersion method for the organic silver salt used in the invention, known methods may be applied. The methods can be referred, for example, in JP-A No. 10-62899, EP-A Nos. 0,803,763A1 and 0,962,812A1, JP-A Nos. 11-349591, 2000-7683, 2000-72711, 2001-163827, 2001-163889, 2001-163890, 11-203413, 2001-188313, 2001-083652, 2002-006442, 2002-031870 and 2002-006442.

The photosensitive material of the invention can be produced by mixing an organic silver salt aqueous dispersion and a photosensitive silver salt aqueous dispersion. It is a preferred method for adjusting photographic characteristics that two or more kinds of organic silver salt aqueous dispersions and two or more kinds of photosensitive silver salt aqueous dispersions are mixed.

The organic silver salt may be used in a desired amount in the invention, and it is preferably, in terms of silver amount, from 0.1 to 5 g/m$^2$, more preferably from 1 to 3 g/m$^2$, and particularly preferably from 1.2 to 2.5 g/m$^2$.

[Description of Reducing Agent]

The photothermographic material of the invention contains a reducing agent for reducing the organic silver salt. The reducing agent may be any substance (preferably an organic substance) that is capable of reducing a silver ion to metallic silver. Examples of the reducing agent include those described in paragraphs 0043 to 0045 of JP-A No. 11-65021, and page 7, line 34 to page 18, line 12 of European Patent No. 0,803,764.

Preferred examples of the reducing agent used in the invention include a so-called hindered phenol reducing agent having a substituent at an opposition of a phenolic hydroxyl group, and a bisphenol reducing agent. In particular, a compound represented by the following general formula (R) is preferred.

General formula (R)

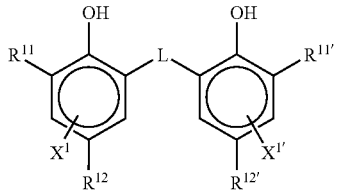

In the general formula (R), $R^{11}$ and $R^{11'}$ each independently represents an alkyl group having from 1 to 20 carbon atoms, $R^{12}$ and $R^{12'}$ each independently represents a hydrogen atom or a substituent capable of being substituted on a benzene ring, L represents —S— or $CHR^3$—, $R^{13}$ represents a hydrogen atom or an alkyl group having from 1 to 20 carbon atoms, and $X^1$ and $X^{1'}$ each independently represents a hydrogen atom or a group capable of being substituted on a benzene ring.

The substituents will be described in detail below.

(1) $R^{11}$ and $R^{11'}$ $R^{11}$ and $R^{11'}$ each independently represents a substituted or unsubstituted alkyl group having from 1 to 20 carbon atoms. The substituent on the alkyl group is not particularly limited, and preferred examples thereof include an aryl group, a hydroxyl group, an alkoxy group, an aryloxy group, an alkylthio group, an arylthio group, an acylamino group, a sulfonamide group, a sulfonyl group, a phosphoryl group, an acyl group, a carbamoyl group, an ester group and a halogen atom.

(2) $R^{12}$ and $R^{12'}$, and $X^1$ and $X^{1'}$ $R^{12}$ and $R^{12'}$ each independently represents a hydrogen atom or a substituent capable of being substituted on a benzene ring.

$X^1$ and $X^{1'}$ each independently represents a hydrogen atom or a group capable of being substituted on a benzene ring. Examples of the group capable of being substituted on a benzene ring include an alkyl group, an aryl group, a halogen atom, an alkoxy group and an acylamino group.

(3) L

L represents —S— or $CHR^{13}$—, wherein $R^{13}$ represents a hydrogen atom or an alkyl group having from 1 to 20 carbon atoms, and the alkyl group may have a substituent.

Examples of the unsubstituted alkyl group represented by $R^{13}$ include a methyl group, an ethyl group, a propyl group, a butyl group, a heptyl group, an undecyl group, an isopropyl group, a 1-ethylpentyl group and a 2,4,4-trimethylpentyl group.

Examples of the substituent on the alkyl group include, as similar to the substituent on $R^{11}$, a halogen atom, an alkoxy group, an alkylthio group, an aryloxy group, an arylthio group, an acylamino group, a sulfonamide group, a sulfonyl group, a phosphoryl group, an oxycarbonyl group, a carbamoyl group and a sulfamoyl group.

(4) Preferred Substituent $R^{11}$ and $R^{11'}$ each preferably represents a secondary or tertiary alkyl group having from 3 to 15 carbon atoms, and specific examples thereof include an isopropyl group, an isobutyl group, a t-butyl group, a t-amyl group, a t-octyl group, a cyclohexyl group, a cyclopentyl group, a 1-methylcyclohexyl group and a 1-methylcyclopropyl group. $R^{11}$ and $R^{11'}$ each more preferably represents a tertiary alkyl group having from 4 to 12 carbon atoms, and a t-butyl group, a t-amyl group and a 1-methylcyclohexyl group are more preferred among them, with a t-butyl group being most preferred.

$R^{12}$ and $R^{12'}$ each preferably represents an alkyl group having from 1 to 20 carbon atoms, and specific examples thereof include a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group and a methoxyethyl group, and more preferably a methyl group, an ethyl group, a propyl group, an isopropyl group and a t-butyl group.

$X^1$ and $X^{1'}$ each preferably represents a hydrogen atom, a halogen atom or an alkyl group, and more preferably a hydrogen atom.

L preferably represents a —$CHR^{13}$— group.

$R^{13}$ preferably represents a hydrogen atom or an alkyl group having from 1 to 15 carbon atoms, and preferred examples of the alkyl group include a methyl group, an ethyl group, a propyl group, an isopropyl group and a 2,4,4-trimethylpentyl group. $R^{13}$ particularly preferably represents a hydrogen atom, a methyl group, a propyl group or an isopropyl group.

In the case where $R^{13}$ represents a hydrogen atom, $R^{12}$ and $R^{12'}$ each preferably represents an alkyl group having from 2 to 5 carbon atoms, more preferably an ethyl group or a propyl group, and most preferably an ethyl group.

In the case where $R^{13}$ represents a primary or secondary alkyl group having from 1 to 8 carbon atoms, $R^{12}$ and $R^{12'}$ each preferably represents a methyl group. Preferred examples of the primary or secondary alkyl group having from 1 to 8 carbon atoms represented by $R^{13}$ include a methyl group, an ethyl group, a propyl group and an isopropyl group, and more preferably a methyl group, an ethyl group and a propyl group.

In the case where all $R^{11}$, $R^{11'}$, $R^{12}$ and $R^{12'}$ represent methyl groups, $R^{13}$ preferably represents a secondary alkyl group. Preferred examples of the secondary alkyl group represented by $R^{13}$ in this case include an isopropyl group, an isobutyl group and a 1-ethylpentyl group, and more preferably an isopropyl group.

The reducing agent has various thermal development performances depending on the combinations of $R^{11}$, $R^{11'}$, $R^{12}$, $R^{12'}$ and $R^{13}$. The thermal development performance can be adjusted by mixing two or more kinds of reducing agents having different thermal development performances, and therefore, it is preferred to use a combination of two or more kinds of the reducing agents depending on purposes.

Specific examples of the compound represented by the general formula (R) are shown below, but the invention is not limited thereto.

(R-1)

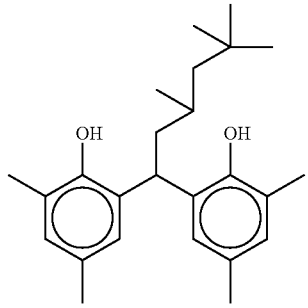

(R-2)

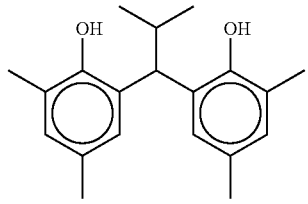

(R-3)

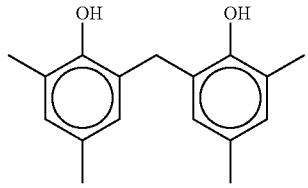

(R-4)

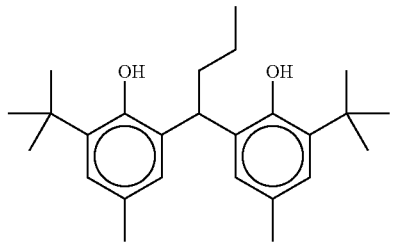

(R-5)

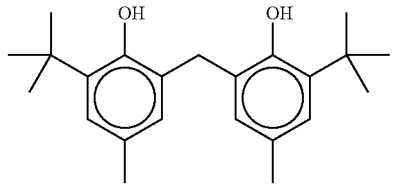

-continued
(R-6)
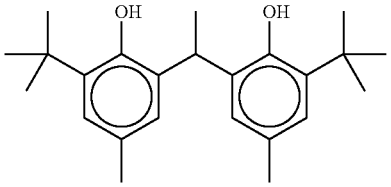
(R-7)
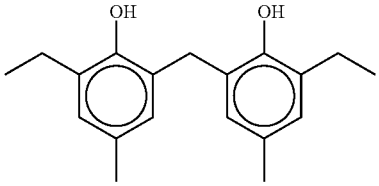
(R-8)
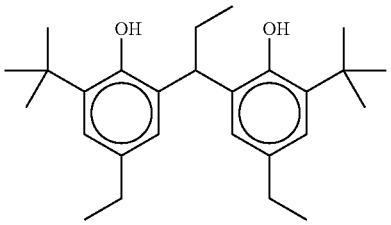
(R-9)
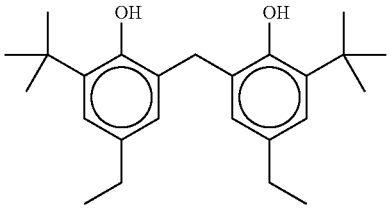
(R-10)
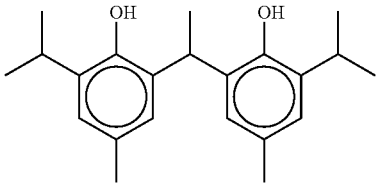
(R-11)
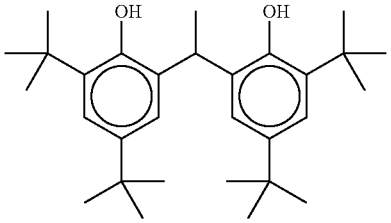
(R-12)
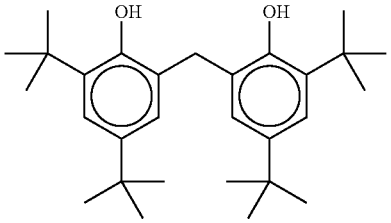
-continued
(R-13)
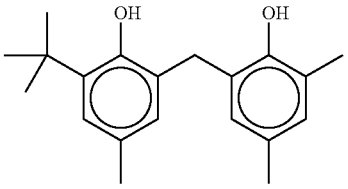
(R-14)
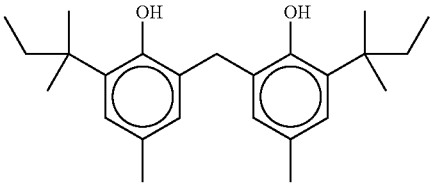
(R-15)
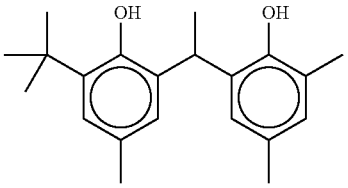
(R-16)
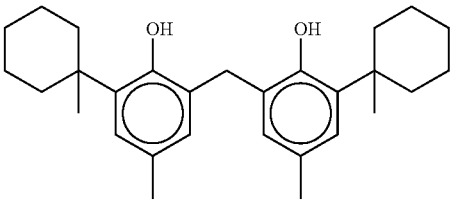
(R-17)
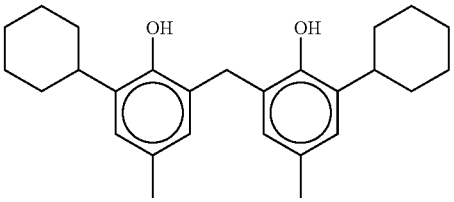
(R-18)
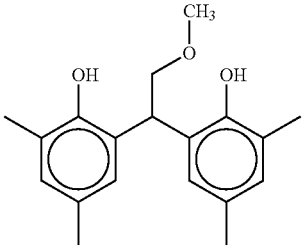
(R-19)
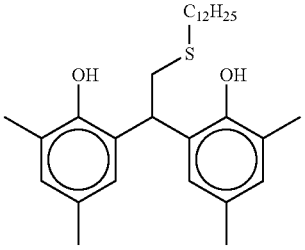

-continued
(R-20)
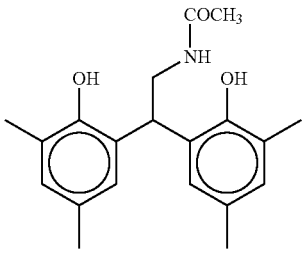
(R-21)
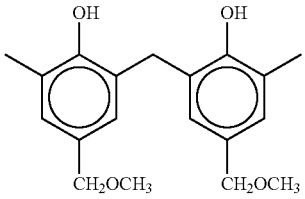
(R-22)
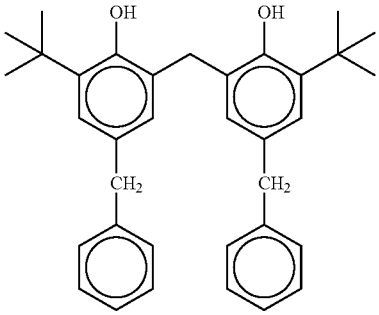
(R-23)
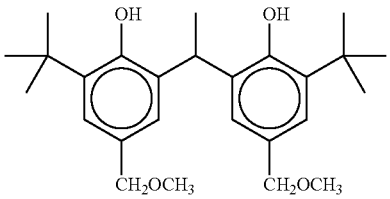
(R-24)
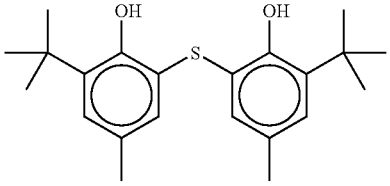
(R-25)
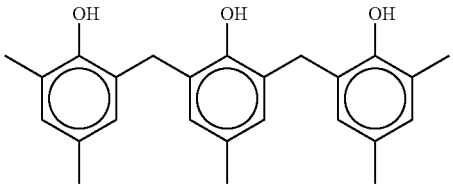
-continued
(R-26)
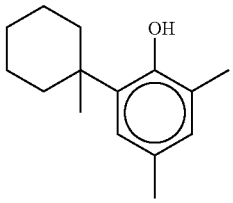
(R-27)
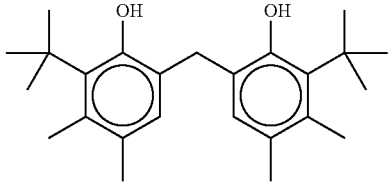
(R-28)
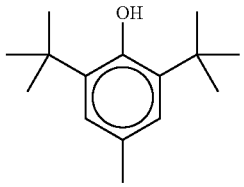
(R-29)
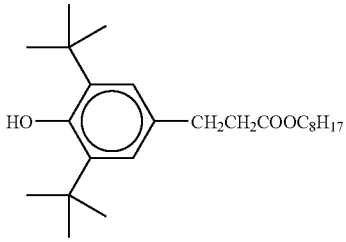
(R-30)
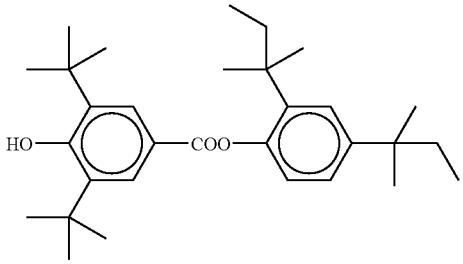
(R-31)
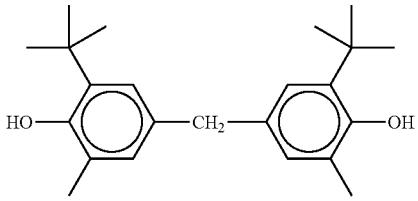

-continued (R-32)

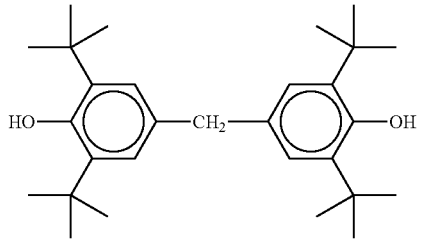

(R-33)

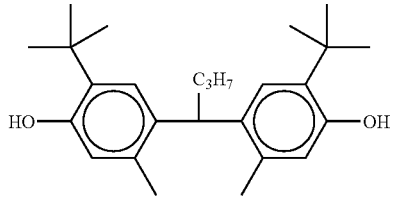

(R-34)

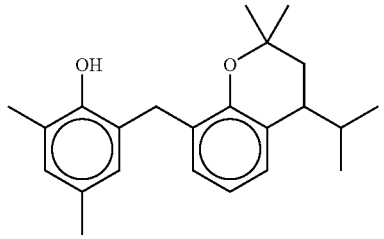

The addition amount of the reducing agent in the invention is preferably from 0.01 to 5.0 g/m$^2$, and more preferably from 0.1 to 3.0 g/m$^2$, and is preferably from 5 to 50% by mole, and more preferably from 10 to 40% by mole, based on 1 mole of silver on the side where the image forming layer is provided.

The reducing agent in the invention may be added to the image forming layer containing the organic silver salt and the photosensitive silver halide, and a layer adjacent thereto, and more preferably it is added to the image forming layer.

The reducing agent of the invention may be added in any form, e.g., a solution form, an emulsion dispersion form and a solid fine particle dispersion form, to a coating composition for adding to the photosensitive material.

Examples of a well known emulsion dispersion method include such a method in that the reducing agent is dissolved in an auxiliary solvent, such as an oil, e.g., dibutyl phthalate, tricresyl phosphate, glyceryl triacetate and diethyl phthalate, ethyl acetate and cyclohexanone, and the resulting solution is mechanically dispersed to form an emulsion dispersion.

Examples of the solid fine particle dispersion method include such a method in that the reducing agent is dispersed in an appropriate solvent, such as water, with a ball mill, a colloid mill, a vibration ball mill, a sand mill, a jet mill, a roller mill or ultrasonic vibration, so as to form a solid dispersion. A dispersion method using a sand mill is preferred. A protective colloid (such as polyvinyl alcohol) and a surface active agent (such as an anionic surface active agent, e.g., sodium triisopropylnaphthalenesulfonate (a mixture of isomers having different substitution positions of three isopropyl groups) may be used. An antiseptic (such as benzeneisothiazolinone sodium salt) may be added to the aqueous dispersion.

The solid particle dispersion method is particularly preferred for the reducing agent, and it is preferably added in the form of fine particles having an average particle diameter of from 0.01 to 10 μm, more preferably from 0.05 to 5 μm, and further preferably from 0.1 to 1 μm. In the invention, other solid dispersions are preferably dispersed to a particle diameter within the range.

[Description of Development Accelerator]

The photothermographic material of the invention preferably contains, as a development accelerator, sulfonamide phenol compounds described in JP-A No. 2000-267222 and the general formula (A) in JP-A No. 2000-330234, a hindered phenol compound represented by the general formula (II) in JP-A No. 2001-92075, hydrazine compounds described in JP-A No. 10-62895, the general formula (I) in JP-A No. 11-15116 and the general formula (1) in JP-A No. 2002-278017, and a phenol or naphthol compound represented by the general formula (2) in JP-A No. 2001-264929. These development accelerators may be used in an amount of from 0.1 to 20% by mole, preferably from 0.5 to 10% by mole, and more preferably from 1 to 5% by mole, based on the amount of the reducing agent. The addition method thereof to the photosensitive material may be the same as those described for the reducing agent, and it is preferably added as a solid dispersion or an emulsion dispersion. In the case where it is added in the form of an emulsion dispersion, it is preferably added in the form of an emulsion dispersion obtained by dispersing by using a high boiling point solvent, which is in a solid state at ordinary temperature, and a low boiling point auxiliary solvent, or in the form of a so-called oilless emulsion dispersion using no high boiling point solvent.

Among the aforementioned development accelerators, a hydrazine compound represented by the general formula (1) in JP-A No. 2002-278017, and a phenol or naphthol compound represented by the general formula (2) in JP-A No. 2001-264929 are particularly preferred.

Specific examples of the development accelerator in the invention are shown below, but the invention is not limited thereto.

(A-1)

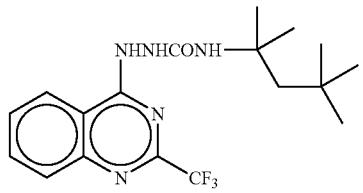

(A-2)

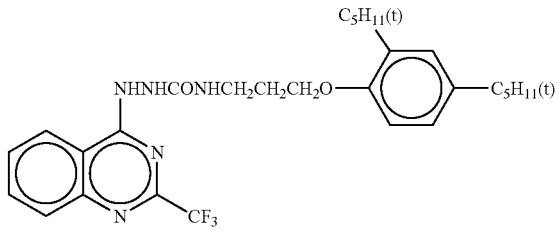

-continued (A-3)

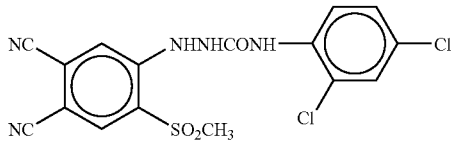

(A-4)

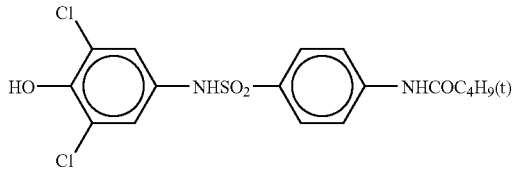

(A-5)

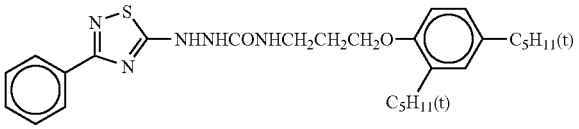

(A-6)

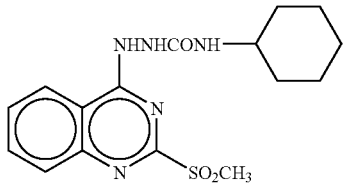

(A-7)

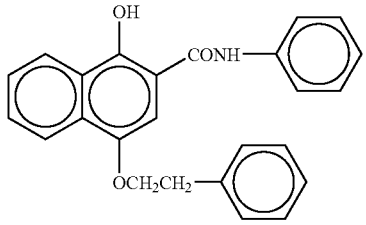

(A-8)

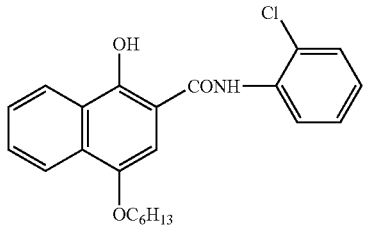

(A-9)

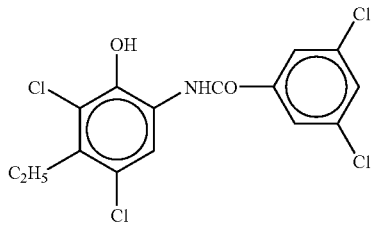

-continued (A-10)

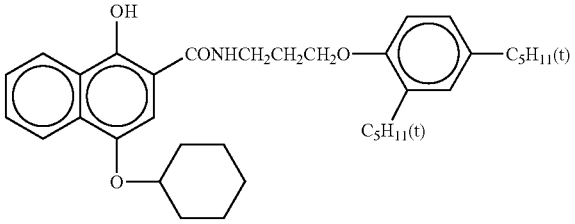

[Description of Hydrogen Bonding Compound]

In the invention, it is preferred to use, in combination, a non-reductive compound having a group capable of forming a hydrogen bond with an aromatic hydroxyl group (—OH) of the reducing agent.

Examples of the group capable of forming a hydrogen bond include a phosphoryl group, a sulfoxide group, a sulfonyl group, a carbonyl group, an amide group, an ester group, a urethane group, an ureido group, a tertiary amino group and a nitrogen-containing aromatic group. Among these, compounds having a phosphoryl group, a sulfoxide group, an amide group (provided that it does not have an >N—H group but is blocked to be >N—Ra (wherein Ra represents a substituent other than H)), a urethane group (provided that it does not have an >N—H group but is blocked to be >N—Ra (wherein Ra represents a substituent other than H)) and an ureido group (provided that it does not have an >N—H group but is blocked to be >N—Ra (wherein Ra represents a substituent other than H)) are preferred.

A compound represented by the following general formula (D) is preferred as the hydrogen bonding compound in the invention.

General formula (D)

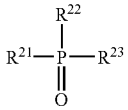

In the general formula (D), $R^{21}$ to $R^{23}$ each independently represents an alkyl group, an aryl group, an alkoxy group, an aryloxy group, an amino group or a heterocyclic group, which may be unsubstituted or may have a substituent.

In the case where $R^{21}$ to $R^{23}$ have a substituent, examples of the substituent include a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group and a phosphoryl group, and preferred examples of the substituent include an alkyl group and an aryl group, examples of which include a methyl group, an ethyl group, an isopropyl group, a t-butyl group, a t-octyl group, a phenyl group, a 4-alkoxyphenyl group and a 4-acyloxyphenyl group.

Specific examples of the alkyl group represented by $R^{21}$ to $R^{23}$ include a methyl group, an ethyl group, a butyl group, an octyl group, a dodecyl group, an isopropyl group, a t-butyl group, a t-amyl group, a t-octyl group, a cyclohexyl group, a 1-methylcyclohexyl group, a benzyl group, a phenethyl group and a 2-phenoxypropyl group.

Examples of the aryl group include a phenyl group, a cresyl group, a xylyl group, a naphthyl group, a 4-t-butylphenyl group, a 4-t-octylphenyl group, a 4-anisidyl group and a 3,5-dichlorophenyl group.

Examples of the alkoxy group include a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group and a benzyloxy group.

Examples of the aryloxy group include a phenoxy group, a cresyloxy group, an isopropylphenoxy group, a 4-t-butylphenoxy group, a naphthoxy group and a biphenyloxy group.

Examples of the amino group include a dimethylamino group, a diethylamino group, a dibutylamino group, a dioctylamino group, an N-methyl-N-hexylamino group, a dicyclohexylamino group, a diphenylamino group and an N-methyl-N-phenylamino group.

$R^{21}$ to $R^{23}$ each preferably represents an alkyl group, an aryl group, an alkoxy group or an aryloxy group. It is preferred from the standpoint of the effect of the invention that at least one of $R^{21}$ to $R^{23}$ represents an alkyl group or an aryl group, and it is more preferred that two or more of them each represents an alkyl group or an aryl group. The case where $R^{21}$ to $R^{23}$ represent the same groups is preferred since the compound can be inexpensively available.

Examples of the hydrogen bonding compound in the invention including the compound represented by the general formula (D) are shown below, but the invention is not limited thereto.

(D-1)

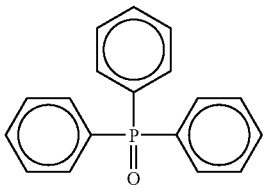

(D-2)

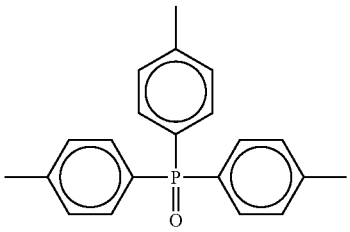

-continued (D-3)

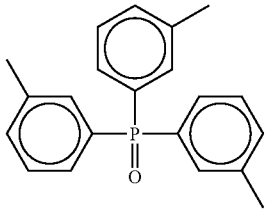

(D-4)

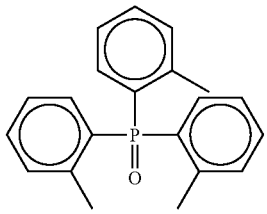

(D-5)

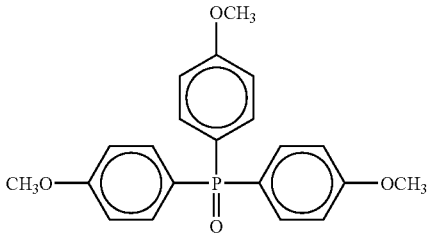

(D-6)

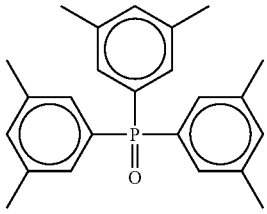

(D-7)

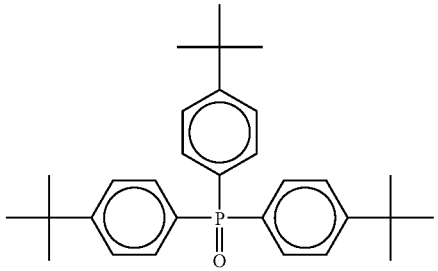

(D-8)

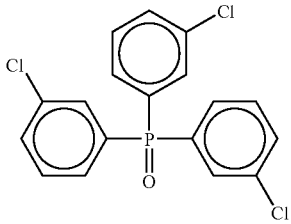

(D-9)

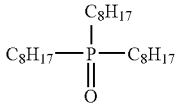

-continued (D-10)

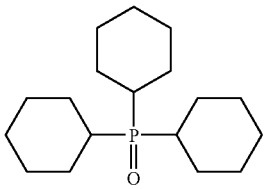

(D-11)

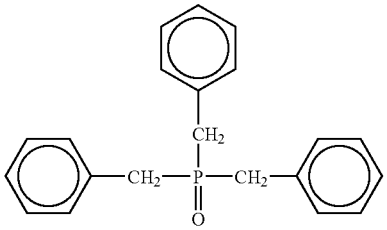

(D-12)

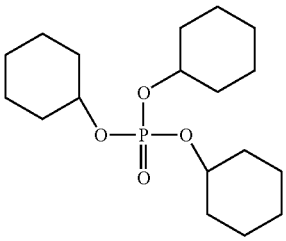

(D-13)

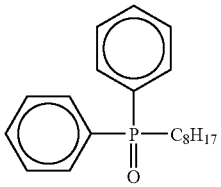

(D-14)

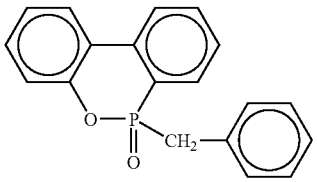

(D-15)

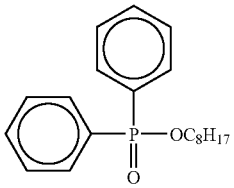

(D-16)

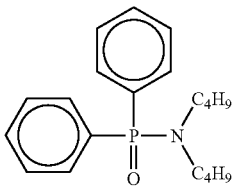

-continued (D-17)

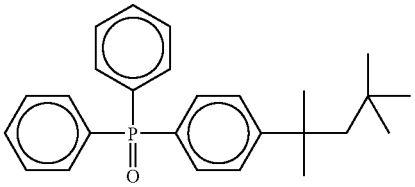

(D-18)

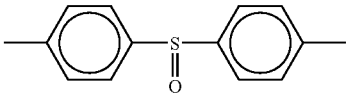

(D-19)

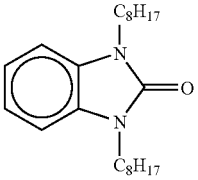

(D-20)

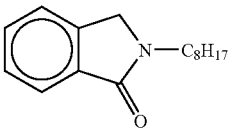

(D-21)

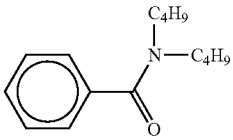

Specific examples of the hydrogen bonding compound also include those described in JP-A Nos. 2001-281793 and 2002-014438.

The hydrogen bonding compound in the invention can be added in the form of a solution, an emulsion dispersion or a solid dispersion to the coating composition, and can be used in the photosensitive material, as similar to the reducing agent. The compound forms a complex with a compound having a phenolic hydroxyl group in a solution state through a hydrogen bond, and can be isolated as crystals depending on the combination with the reducing agent and the compound represented by the general formula (A) in the invention.

It is particularly preferred for obtaining stable performance that the thus isolated crystal powder is used as a solid fine particle dispersion. Such a method is also preferably used in that the reducing agent and the hydrogen bonding compound in the invention are mixed in a powder state, and a complex is formed upon dispersing with a sand grinder mill or the like by using a suitable dispersing agent.

The hydrogen bonding compound in the invention is preferably used in an amount of from 1 to 200% by mole, more preferably from 10 to 150% by mole, and further preferably from 30 to 100% by mole, based on the amount of the reducing agent.

[Description of Binder]

The binder for the image forming layer in the invention may be any polymer, and preferred examples of the binder include a transparent or translucent and generally colorless natural resin, polymer or copolymer, a synthetic resin, polymer or copolymer, or medium capable of forming a film. Examples thereof include a gelatin compound, a rubber compound, a poly(vinyl alcohol) compound, a hydroxyethylcellulose compound, a cellulose acetate compound, a cellulose acetate butyrate compound, a poly(vinylpyrrolidone) compound, casein, starch, a poly(acrylic acid) compound, a poly(methylmethacrylic acid) compound, a poly(vinyl chloride) compound, a poly(methacrylic acid) compound, a styrene-maleic anhydride copolymer, a styrene-acrylonitrile copolymer, a styrene-butadiene copolymer, a poly(vinylacetal) compound (such as poly(vinylformal) and poly(vinylbutyral)), a poly(ester) compound, a poly(urethane) compound, a phenoxy resin, a poly(vinylidene chloride) compound, a poly(epoxide) compound, a poly(carbonate) compound, a poly(vinyl acetate) compound, a poly(olefin) compound, a cellulose ester compound and a poly(amide) compound. The binder may be formed into a film through water, an organic solvent or an emulsion.

The binder used in the layer containing the organic silver salt preferably has a glass transition temperature of from 10 to 80° C., more preferably from 20 to 70° C., and further preferably from 23 to 65° C.

The glass transition temperature Tg in the invention is calculated according to the following equation.

$$1/Tg=\Sigma(X_i/Tg_i)$$

It is assumed herein that the polymer is formed by copolymerizing n monomer components of from i=1 to n. $X_i$ represents the weight fraction of the i-th monomer (where $\Sigma X_i=1$), and $Tg_i$ represents the glass transition temperature (K) of a homopolymer of the i-th monomer, provided that Σ means the sum of i=1 to n.

The glass transition temperatures of the homopolymers of the respective monomers ($Tg_i$) are those described in J. Brandrup and E. H. Immergut, Polymer Handbook (3rd Edition) (Wiley-Interscience, Inc. (1989)).

The polymer used as the binder may be used solely or may be used in combination of two or more kinds thereof. A polymer having a glass transition temperature of 20° C. or more and a polymer having a glass transition temperature of less than 20° C. may be used in combination. In the case where two or more kinds of polymers having different glass transition temperatures are used in combination, it is preferred that the weight average glass transition temperature of the mixture is in the aforementioned range.

The performance in the invention is improved in the following cases, i.e., the case where the image forming layer is formed by coating and drying a coating composition using a solvent containing 30% by mass or more of water, and the case where the binder of the image forming layer can be dissolved or dispersed in an aqueous solvent, and in particular, is formed with a polymer latex having an equilibrium water content at 25° C. 60% RH of 2% by mass or less.

In the most preferred embodiment, the binder is prepared to have an ionic electroconductivity of 2.5 mS/cm or less, and examples of the preparation method therefor include such a method in that the polymer is purified by using an isolation functional film after the synthesis thereof.

Examples of the aqueous solvent, in which the polymer is soluble or dispersible, include water and a mixed solvent containing water and 70% by mass or less water miscible organic solvent.

Examples of the water miscible organic solvent include an alcohol solvent, such as methyl alcohol, ethyl alcohol and propyl alcohol, a cellosolve solvent, such as methylcellosolve, ethylcellosolve and butylcellosolve, ethyl acetate, and dimethylformamide.

The equilibrium water content at 25° C. 60% RH can be expressed by the weight W1 of the polymer in an equilibrium humidity state under an atmosphere at 25° C. 60% RH and the weight W0 of the polymer in the bone dry state.

Equilibrium water content at 25° C. 60% RH= $((W1-W0)/W0)\times 100$ (% by mass)

The definition and the measurement method of the water content can be referred in Kobunshi Kogaku Koza 14, Kobunshi Zairyo Siken-ho (Lectures on Polymer Engineering 14, Test Method for Polymer Materials), edited by Society of Polymer Science, Japan (published by Chijin Shokan Co., Ltd.).

The equilibrium water content at 25° C. 60% RH of the binder polymer in the invention is preferably 2% by mass or less, more preferably from 0.01 to 1.5% by mass, and further preferably from 0.02 to 1% by mass.

The binder in the invention is particularly preferably a polymer that is dispersible in an aqueous solvent. Examples of the dispersion state include a latex having fine particles of a water insoluble hydrophobic polymer dispersed therein, and a state where polymer molecules are dispersed in a molecular state or through formation of micelles, both of which are preferred. The average particle diameter of the dispersed particles is generally from 1 to 50,000 nm, and preferably from 5 to 1,000 nm. The particle diameter distribution of the dispersed particles is not particularly limited, and those having a broad particle diameter distribution and those having a mono-dispersion particle diameter distribution may be used.

Preferred embodiments of the polymer dispersible in an aqueous solvent are the same as those described for the aforementioned latex polymer. Specific examples and preferred examples of the latex are the same as those described for the aforementioned latex.

The image forming layer of the photosensitive material of the invention may contain a hydrophilic polymer, such as gelatin, polyvinyl alcohol, methylcellulose, hydroxypropylcellulose and carboxymethylcellulose, depending on necessity. The addition amount of the hydrophilic polymer is generally from 30% by mass or less, and preferably 20% by mass or less, based on the total binder in the image forming layer.

The layer containing the organic silver salt (i.e., the image forming layer) of the invention is preferably formed by using a polymer latex. The amount of the binder in the image forming layer in terms of the mass ratio of (total binder)/(organic silver salt) is generally from 1/10 to 10/1, preferably from 1/3 to 5/1, and more preferably from 1/1 to 3/1.

The image forming layer is generally an emulsion layer containing a photosensitive silver halide, which is a photosensitive silver salt, and in this case, the mass ratio of (total binder)/(silver halide) is generally from 400 to 5, and preferably from 200 to 10.

The total amount of the binder in the image forming layer in the invention is preferably from 0.2 to 30 g/m$^2$, more preferably from 1 to 15 g/m$^2$, and further preferably from 2 to 10 g/m$^2$. The image forming layer in the invention may further contain a crosslinking agent for crosslinking, a surface active agent for improving coating property, and the like.

[Description of Preferred Solvent for Coating Composition]

The solvent of the coating composition for the image forming layer of the photosensitive material in the invention (herein, a solvent and a dispersion medium are totally referred to as a solvent for convenience) is preferably an aqueous solvent containing 30% by mass or more water. The component other than water may be an arbitrary water miscible organic solvent, such as methyl alcohol, ethyl alcohol, isopropyl alcohol, methylcellosolve, ethylcellosolve, dimethylformamide and ethyl acetate. The water content of the solvent is more preferably 50% by mass or more, and further preferably 70% by mass or more.

Specific examples of the preferred solvent composition include 100% by mass of water, water/methyl alcohol=90/10, water/methyl alcohol=70/30, water/methyl alcohol/dimethylformamide=80/15/5, water/methyl alcohol/ethylcellosolve=85/10/5, and water/methyl alcohol/isopropyl alcohol=85/10/5 (all the numerals indicate percentages by mass).

[Description of Antifoggant]

The photothermographic material of the invention preferably contains a compound represented by the following general formula (H) as an antifoggant.

General formula (H)

$$Q\text{-}(Y)_n\text{—}C(Z_1)(Z_2)X$$

In the general formula (H), Q represents an alkyl group, an aryl group or a heterocyclic group, Y represents a divalent linking group, n represents 0 or 1, $Z_1$ and $Z_2$ each represents a halogen atom, and X represents a hydrogen atom or an electron attracting group.

Q preferably represents a phenyl group substituted with an electron attracting group having a positive value of Hammet's substituent constant σp. The Hammet's substituent constant can be referred in Journal of Medical Chemistry, vol. 16, No. 11, p. 1207 to 1216 (1973).

Examples of the electron attracting group include a halogen atom (such as a fluorine atom (σp value: 0.06), a chlorine atom (σp value: 0.23), a bromine atom (σp value: 0.23) and an iodine atom (σp value: 0.18)), a trihalomethyl group (such as a tribromomethyl group (σp value: 0.29), a trichloromethyl group (σp value: 0.33) and atrifluoromethyl group (up value: 0.54)), a cyano group (σp value: 0.66), a nitro group (σp value: 0.78), an aliphatic, aryl or heterocyclic sulfonyl group (such as methanesulfonyl group (σp value: 0.72), an aliphatic, aryl or heterocyclic acyl group (such as an acetyl group (σp value: 0.50) and a benzoyl group (σp value: 0.43)), an alkynyl group (such as a —C≡CH group (σp value: 0.23)), an aliphatic, aryl or hetrocyclic oxycarbonyl group (such as a methoxycarbonyl group (σp value: 0.45) and a phenoxycarbonyl group (σp value: 0.44)), a carbamoyl group (σp value: 0.36), a sulfamoyl group (σp value: 0.57), a sulfoxide group, a heterocyclic group, and a phosphoryl group.

The σp value is preferably from 0.2 to 2.0, and more preferably from 0.4 to 1.0.

Preferred examples of the electron attracting group include a carbamoyl group, an alkoxycarbonyl group, an alkylsulfonyl group, an alkylphosphoryl group, a carboxyl group, an alkyl or arylcarbonyl group, and an arylsulfonyl group, and particularly preferably a carbamoyl group, an alkoxycarbonyl group, an alkylsulfonyl group and an alkylphosphoryl group, with a carbamoyl group being most preferred.

X preferably represents an electron attracting group, and more preferably a halogen atom, an aliphatic, aryl or heterocyclic sulfonyl group, an aliphatic, aryl or heterocyclic acyl group, an aliphatic, aryl or heterocyclic oxycarbonyl group, a carbamoyl group or a sulfamoyl group, and particularly preferably a halogen atom.

The halogen atom is preferably a chlorine atom, a bromine atom or an iodine atom, more preferably a chlorine atom or a bromine atom, and particularly preferably a bromine atom.

Y preferably represents —C(=O)—, —SO— or —$SO_2$—, more preferably —C(=O)— or —$SO_2$—, and particularly preferably —$SO_2$—. n represents 0 or 1, and preferably 1.

Specific examples of the compound represented by the general formula (H) are shown below, but the invention is not limited thereto.

(H-1)

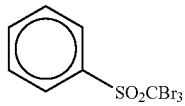

(H-2)

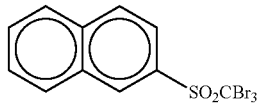

(H-3)

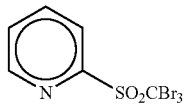

(H-4)

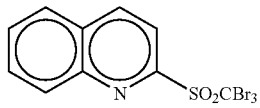

(H-5)

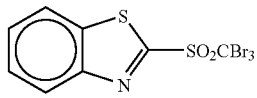

(H-6)

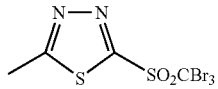

(H-7)

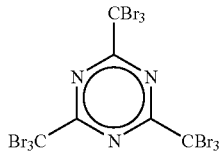

(H-8)

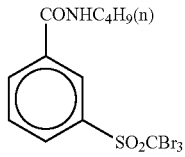

-continued (H-9)

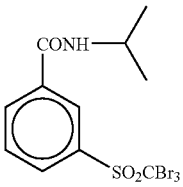

(H-10)

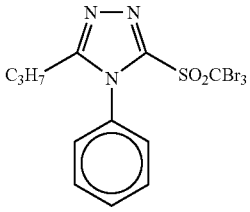

(H-11)

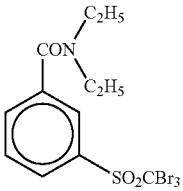

(H-12)

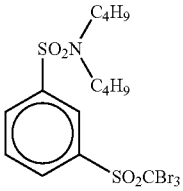

(H-13)

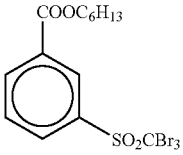

(H-14)

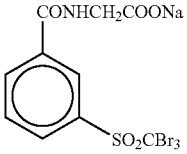

(H-15)

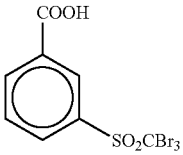

(H-16)

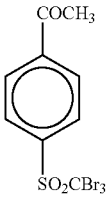

-continued (H-17)

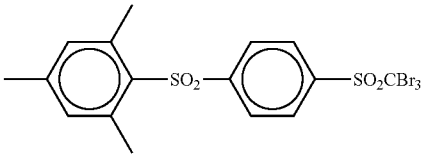

(H-18)

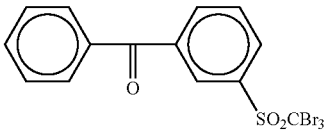

(H-19)

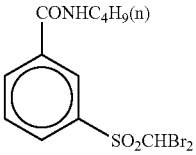

(H-20)

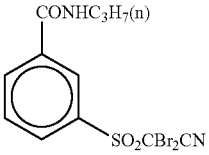

(H-21)

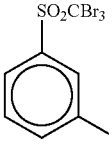

(H-22)

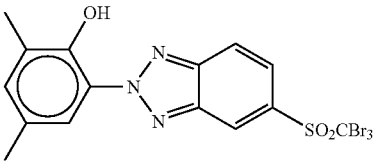

(H-23)

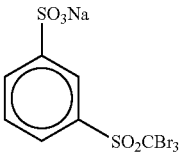

(H-24)

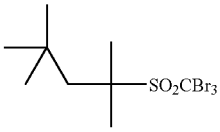

The compound represented by the general formula (H) in the invention is preferably added in an amount of from $10^{-4}$ to 0.8 mole, more preferably from $10^{-3}$ to 0.1 mole, and further preferably from $5\times10^{-3}$ to 0.05 mole, per 1 mole of the non-photosensitive silver salt in the image forming layer.

In the case where a silver halide having a composition having a high silver iodide content, the addition amount of the compound represented by the general formula (H) is important for obtaining a sufficient fog preventing effect, and the compound is most preferably used in an amount of from $5\times10^{-3}$ to 0.03 mole per 1 mole of the non-photosensitive silver salt in the image forming layer.

Examples of a method for adding the compound represented by the general formula (H) to the photosensitive material include the aforementioned methods described for adding the reducing agent.

The compound represented by the general formula (H) preferably has a melting point of 200° C. or less, and more preferably 170° C. or less.

Examples of other organic polyhalogenide compound used in the invention include those described in paragraphs 0111 to 0112 of JP-A No. 11-65021. In particular, an organic halogenide compound represented by the formula (P) in JP-A No. 2000-284399, an organic polyhalogenide compound represented by the general formula (II) in JP-A No. 10-339934, and an organic polyhalogenide compound described in JP-A No. 2001-033911 are preferred.

Other examples of the antifoggant include a mercury(II) salt described in paragraph 0113 of JP-A No. 11-65021, a benzoic acid compound described in paragraph 0114 of the same literature, a salicylic acid derivative described in JP-A No. 2000-206642, a formalin scavenger compound represented by the formula (S) in JP-A No. 2000-221634, a triazine compound described in the claim 9 of JP-A No. 11-352624, a compound represented by the general formula (III) in JP-A No. 6-11791, and 4-hydroxy-6-methyl-1,3,3a,7-tetrazaindene.

Examples of the antifoggant, a stabilizing agent and a stabilizer precursor include those described in paragraph 0070 of JP-A No. 10-62899, and page 20, line 57 to page 21, line 7 of EP-A No. 0,803,764A1, and compounds described in JP-A Nos. 9-281637 and 9-329864.

The photothermographic material of the invention may contain an azolium salt for fog prevention. Examples of the azolium salt include a compound represented by the general formula (XI) in JP-A No. 59-193447, a compound represented by the general formula (II) in JP-B No. 55-12581, and a compound represented by the general formula (II) in JP-A No. 60-153039. The azolium salt may be added any part of the photosensitive material, and it is preferably added to a layer on the side where the image forming layer is formed, and more preferably added to the image forming layer.

The addition of the azolium salt may be carried out any occasion during the preparation of the coating composition, and in the case where the azolium salt is added to the image forming layer, it may added on any occasion of from preparation of the organic silver salt to preparation of the coating composition, and is preferably added on an occasion after completion of preparation of the organic silver salt and immediately before coating. The azolium salt may be added in any method, such as in the form of powder, a solution or a fine particle dispersion. It may also be added as a solution formed by mixing with the sensitizing dye, the reducing agent or other additives, such as a color toning agent.

The addition amount of the azolium salt in the invention is not particularly limited, and is preferably from $1\times10^{-6}$ to 2 mole, and more preferably from $1\times10^{-3}$ to 0.5 mole, per 1 mole of silver.

[Description of Other Additives]

(1) Mercapto, Disulfide and Thione Compounds

A mercapto compound, a disulfide compound and a thione compound may be added to the photothermographic material of the invention in order to suppress, accelerate or control the development, to improve the spectral sensitization efficiency, and to improve the storage stability before and after development. Examples thereof include compounds described in paragraphs 0067 to 0069 of JP-A No. 10-62899 and a compound represented by the general formula (I) in JP-A No. 10-186527, with specific example compounds thereof being described in paragraphs 0033 to 0052 of the same literature, and compounds described in page 20, lines 36 to 56 of EP-A No. 0,803,764A1, and JP-A No. 2001-100358. Among these, a mercapto-substituted heterocyclic aromatic compound is preferred.

(2) Color Toning Agent

A color toning agent is preferably added to the photothermographic material of the invention. The color toning agent is described in paragraphs 0054 to 0055 of JP-A No. 10-62899, page 21, lines 23 to 48 of EP-A No. 0,803,764A1, and JP-A No. 2000-356317. In particular, preferred examples thereof include a phthalazinone compound (such as phthalazinone, a phthalazinone derivative and a metallic salt thereof, e.g., 4-(1-naphthyl)phthalazinone, 6-chlorophthalazinone, 5,7-dimethoxyphthalazinone and 2,3-dihydro-1,4-phthalazinone), a combination of a phthalazinone compound and a phthalic acid compound (such as phthalic acid, 4-methylphthalic acid, 4-nitrophthalic acid, diammonium phthalate, sodium phthalate, potassium phthalate and tetrachlorophthalic anhydride), and a phthalazine compound (such as phthalazine, a phthalazine derivative and a metallic salt thereof, e.g., 4-(1-naphthylphthalazine, 6-isopropylphthalazine, 6-t-butylphthalazine, 6-chlorophthalazine, 5,7-dimethoxyphthalazine and 2,3-dihydrophthalazine), and in the case of a combination with a silver halide having a high silver iodide content, a combination of a phthalazine compound and a phthalic acid compound is particularly preferred.

The addition amount of the phthalazine compound is preferably from 0.01 to 0.3 mole, more preferably from 0.02 to 0.2 mole, and particularly preferably from 0.02 to 0.1 mole, per 1 mole of the organic silver salt. The addition amount is an important factor with respect to development acceleration, which is a problem in a silver halide emulsion having a high silver iodide content, and the selection of an appropriate addition amount attains both sufficient developing property and low fogging.

(3) Plasticizer and Lubricant

Examples of a plasticizer and a lubricant that can be used in the image forming layer in the invention are described in paragraph 0117 of JP-A No. 11-65021. Examples of a lubricant are also described in paragraphs 0061 to 0064 of JP-A No. 11-84573.

(4) Dye and Pigment

Various kinds of dyes and pigments may be used in the image forming layer in the invention from the standpoint of improvement of color tone, prevention of formation of interference band upon laser exposure, and prevention of irradiation, such as C.I. Pigment Blue 60, C.I. Pigment Blue 64 and C.I. Pigment Blue 15:6). These are described in detail in WO98/36322 and JP-A Nos. 10-268465 and 11-338098.

(5) Super Hard Toning agent

In order to form a super hard tone image suitable for prepress purpose, a super hard toning agent is preferably added to the image forming layer. Examples of the super hard toning agent, and an addition method and an addition amount thereof can be referred in paragraph 0118 of JP-A No. 11-65021, paragraphs 0136 to 0139 of JP-A No. 11-223898 and compounds represented by formulae (H), (1) to (3), (A) and (B) in JP-A No. 2000-284399, and examples of a super hard tone accelerator can be referred in paragraph 0102 of JP-A No. 11-65012 and paragraphs 0194 to 0195 of JP-A No. 11-223898.

In the case where forminc acid or a formate salt is used as a strong fogging agent, it is preferably added on the side where the image forming layer coutaining a photosensitive silver halide is formed in an amount of 5 mmole or less, and more preferably 1 mmole or less, per 1 mole of silver.

In the case where a super hard toning agent is used in the photothermographic material of the invention, it is preferred to use an acid obtained by hydrating diphosphorous pentoxide or a salt thereof in combination. Examples of the acid obtained by hydrating diphosphorous pentoxide or a salt thereof include metaphosphoric acid (or a salt thereof), pyrophosphoric acid (or a salt thereof), orthophosphoric acid (or a salt thereof), triphosphoric acid (or a salt thereof), tetraphosphoric acid (or a salt thereof and hexametaphosphoric acid (or a salt thereof), and particularly preferred examples of the acid obtained by hydrating diphosphorous pentoxide or a salt thereof include orthophosphoric acid (or a salt thereof) and hexametaphosphoric acid (or a salt thereof). Specific examples of the salt include sodium orthophosphate, sodium dihydrogen orthophosphate, sodium hexametaphosphate and ammonium hexametaphosphate.

The using amount (a coated amount per 1 $m^2$ of the photosensitive material) of the acid obtained by hydrating diphosphorous pentoxide or a salt thereof may be a desired amount corresponding to the performance, such as sensitivity and fogging, and is preferably from 0.1 to 500 $mg/M^2$, and more preferably from 0.5 to 100 $mg/M^2$.

[Description of Preparation and Coating of Coating Composition]

The preparation temperature of the coating composition for forming the image forming layer in the invention is preferably from 30 to 65° C., more preferably 35° C. or more and less than 60° C., and further preferably from 35 to 55° C. The temperature of the coating composition for forming the image forming layer immediately after adding the polymer latex is preferably maintained at a temperature of from 30 to 65° C.

[Description of Other Layer Constitutions]

(1) Anti-halation Layer

In the photothermographic material of the invention, an anti-halation layer may be provided on the side far from an exposure light source with respect to the image forming layer. The anti-halation layer is described, for example, in paragraphs 0123 to 0124 of JP-A No. 11-65021, and JP-A Nos. 11-223898,9-230531, 10-36695, 10-104779, 11-231457, 11-352625 and 11-352626.

The anti-halation layer contains an anti-halation dye that has absorption at the exposure wavelength. In the case where the exposure wavelength is in an infrared region, an infrared ray absorbing dye can be used, and in this case, such a dye that does not have absorption in a visible range is preferred.

In the case where halation is prevented by using a dye having absorption in a visible range, it is preferred that the color of the dye does not remain after forming an image. In this case, such a measure is preferably employed that is decolored through heat of thermal development, and it is particularly preferred that a heat decoloring dye and a base precursor are added to a non-photosensitive layer to function as an anti-halation layer. The techniques are described in JP-A No. 11-231457.

The addition amount of the decoloring dye is determined depending on the purpose of the dye. In general, it is used in such an amount that provides an optical density (light absorbance) measured at the objective wavelength exceeding 0.1, preferably from 0.2 to 2. The using amount of the dye for providing the optical density is generally about from 0.001 to 1 $g/m^2$.

The optical density after thermal development can be decreased to 0.1 or less by decoloring the dye. Two or more kinds of decoloring dye may be used in combination in a thermal decoloring recording material or a photothermographic material. Similarly, two or more kinds of base precursors may be used in combination.

In the thermal decoloring system using a decoloring dye and a base precursor, it is preferred to use such a substance that decreases the melting point of the base precursor by 3° C. or more upon mixing therewith (such as diphenylsulfone and 4-chlorophenyl(phenyl)sulfone), from the standpoint of thermal decoloring property.

(2) Back Layer

The back layer that can be used in the invention is described in paragraphs 0128 to 0130 of JP-A No. 11-65021.

In the invention, a coloring agent having an absorption maximum at a wavelength of from 300 to 450 nm may be added to improve the silver color tone and the time-lapse stability of an image. The coloring agent is described in JP-A Nos. 62-210458, 63-104046, 63-103235, 63-208846, 63-306436, 63-314535, 1-61745 and 2001-100363. The coloring agent is generally added in an amount of from 0.1 to 1 $g/m^2$, and a layer, to which the coloring agent is added, is preferably a back layer provided on the side opposite to the image forming layer.

(3) Film Surface pH

The photothermographic material of the invention preferably has a film surface pH before thermal development of 7.0 or less, and more preferably 6.6 or less. The lower limit thereof is not particularly limited and is generally about 3. The film surface pH is most preferably in a range of from 4 to 6.2.

Adjustment of the film surface pH is preferably attained by using an organic acid, such as a phthalic acid derivative, a non-volatile acid, such as sulfuric acid, or a volatile base, such as ammonia, from the standpoint of reduction of the film surface pH. In particular, ammonia is preferred since it is liable to vaporize and thus can be removed before coating or thermal development to attain a low film surface pH.

It is also preferred that a non-volatile base, such as sodium hydroxide, potassium hydroxide and lithium hydroxide, is used in combination with ammonia. The measurement method of the film surface pH is described in paragraph 0123 of JP-A No. 2000-2843997.

(4) Film Hardener

A film hardener may be used in various layers in the invention, such as the image forming layer, the protective layer and the back layer.

Examples of the film hardener include methods described in T. H. James, The Theory of The Photographic Process, Fourth Edition, (published by Macmillan Publishing Co., Inc. on 1977), p. 77 to 78, and in addition to chrome alum, 2,4-dichloro-6-hydroxy-s-triazine sodium salt, N,N-ethylenebis(vinylsulfoneacetamide) and N,N-propylenebis(vinylsulfoneacetamide), polyvalent metallic ions described on page 78 of the aforementioned literature, polyisocyanate compounds described in U.S. Pat. No. 4,281,060 and JP-A No. 6-208193, an epoxy compound described in U.S. Pat. No. 4,791,042, and a vinylsulfone compound described in JP-A No. 62-89048 are preferably used.

The film hardener is added in the form of a solution, and the addition of the solution to the coating composition for the protective layer may be attained from 180 minutes before coating to immediately before coating, and preferably from 60 minutes before coating to 10 second before coating, but the mixing method and the mixing conditions are not particularly limited as far as the effect of the invention is sufficiently exerted.

Specific examples of the mixing method include a method for mixing in a tank, in which the average residence time calculated from the addition flow amount and the liquid delivery amount to a coater is adjusted to a desired value, and a method using a static mixer described in N. Harnby, M. F. Edwards and A. W. Neinow, translation by K. Takahashi, Ekitai Kongo Gijutu (Liquid Mixing Technologies), chapter 8, (published by Nikkan Kogyo Shimbun, Ltd. on 1989).

(5) Surface Active Agent

The surface active agent that can be used in the invention is described in paragraph 0132 of JP-A No. 11-65021.

A fluorine surface active agent is preferably used in the invention. Preferred specific examples of the fluorine surface active agent include compounds described in JP-A Nos. 10-197985, 2000-19680 and 2000-214554. A polymer fluorine surface active agent described in JP-A No. 9-281636 is also preferably used.

(6) Antistatic Agent

The photothermographic material of the invention may have an antistatic layer containing known various kinds of metallic oxides or electroconductive polymers. The antistatic layer may be served by the undercoating layer or the back layer surface protective layer, or may be provided separately. With respect to the antistatic layer, techniques described in paragraph 0135 of JP-A No. 11-65021, JP-A Nos. 56-143430, 56-143431, 58-62646 and 56-120519, paragraphs 0040 to 0051 of JP-A No. 11-84573, U.S. Pat. No. 5,575,957, and paragraphs 0078 to 0084 of JP-A No. 11-223898 may be applied.

(7) Support

As a transparent support, a polyester having been subjected to a heat treatment at a temperature of from 130 to 185° C., particularly polyethylene terephthalate, is preferably used in order to relax the internal stress remaining in the film upon biaxial stretching to reduce distortion due to thermal shrinkage occurring upon thermal development processing.

In the case of a photothermographic material for medical use, the transparent support may be colored with a blue dye (for example, Dye-1 described in Example of JP-A No. 8-240877) or may not be colored.

Specific examples of the support are described in paragraph 0134 of JP-A No. 11-65021.

An undercoating technique, such as a water soluble polyester described in JP-A No. 11-84574, a styrene-butadiene copolymer described in JP-A No. 10-186565, and a vinylidene chloride copolymer described in JP-A No. 2000-39684, is preferably applied to the support.

(8) Other Additives

The photothermographic material may further contain an antioxidant, a stabilizing agent, a plasticizer, an UV absorbent and a coating aid. A solvent described in paragraph 0133 of JP-A No. 11-65021 may also be contained. The additives are added to the image forming layer or the non-photosensitive layer. These can be referred in WO98/36322, EP-A No. 803,764A1, and JP-A Nos. 10-186567 and 10-18568.

(9) Coating Method

The photothermographic material may be formed by coating by any method. Specific examples of the coating method include various kinds of coating operations, such as extrusion coating, slide coating, curtain coating, dip coating, knife coating, flow coating, and extrusion coating using a hopper described in U.S. Pat. No. 2,681,294, and extrusion coating described in Stephen F. Kistler and Petert M. Schweizer, Liquid Film Coating, (published by Chapman & Hall, Inc. (1997)), p. 399 to 536, and slide coating are preferably employed, with slide coating being particularly preferably used.

Examples of the shape of the slide coater used in slide coating are shown in p. 427, FIG. 11b. 1 of the aforementioned literature. Two or more layers may be simultaneously coated according to methods described in p. 399 to 536 of the aforementioned literature, U.S. Pat. No. 2,761,791 and British Patent No. 837,095.

The coating composition for forming the image forming layer in the invention is preferably a so-called thixotropic fluid. The technique in this regard can be referred in JP-A No. 11-52509.

The coating composition for forming the image forming layer in the invention preferably has a viscosity at a shearing rate of 0.1 $s^{-1}$ of from 400 to 100,000 mPa·s, and more preferably from 500 to 20,000 mPa·s.

The viscosity thereof at a shearing rate of 1,000 $s^{-1}$ is preferably from 1 to 200 mPa·s, and more preferably from 5 to 80 mPa·s.

(10) Packaging Material

The photothermographic material of the invention is preferably hermetically packed with a packaging material that is low in oxygen permeability and/or water permeability in order to prevent deterioration in photographic performance during storage before use, and to prevent curling due to winding in the case of a rolled product. The oxygen permeability at 25° C. is preferably 50 mL/atm/$m^2$·day or less, more preferably 10 mL/atm/$m^2$·day or less, and further preferably 1.0 mL/atm/$m^2$·day or less. The water permeability is preferably 10 g/atm/$m^2$·day or less, more preferably 5 g/atm/$m^2$·day or less, and further preferably 1 g/atm/$m^2$·day or less. Specific examples of a packaging material that is low in oxygen permeability and/or water permeability include those described in JP-A Nos. 8-254793 and 2000-206653.

(11) Other Usable Techniques

Examples of techniques that can be used in the photothermographic material of the invention include those described in EP-A Nos. 803,764A1 and 883,022A1, WO98/36322, JP-A Nos. 56-62648, 58-62644, 9-43766, 9-281637, 9-297367, 9-304869, 9-311405, 9-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, 2001-200414, 2001-234635, 2002-020699, 2001-275471, 2001-275461, 2000-313204, 2001-292844, 2000-324888, 2001-293864 and 2001-348546.

(12) Color Image Formation

The constitution of the multi-color photothermographic material may contain a combination of the two layers for the respective colors, or in alternative, all the components may be contained in one layer as described in U.S. Pat. No. 4,708,928.

In the case of the multi-color photothermographic material, the respective emulsion layers are generally maintained separately from each other with a functional or non-functional barrier layer intervening therebetween as described in U.S. Pat. No. 4,460,681.

3. Image Forming Process 3-1. Exposure

The photosensitive material of the invention may be exposed by any method, and laser light is preferred as an exposure light source. There has been a problem of low sensitivity in a silver halide emulsion having a high silver iodide content as in the invention. However, it has been found that the problem of low sensitivity is dissolved by writing with light of high illuminance, such as laser light, and furthermore, recordation of an image can be attained by using less energy. The objective sensitivity can be attained by using strong light in a short period of time.

In the case where such an exposure amount is applied that provides the maximum density (Dmax), the light amount on the surface of the photosensitive material is generally from 0.1 to 100 W/mm$^2$, more preferably from 0.5 to 50 W/mm$^2$, and most preferably from 1 to 50 W/mm$^2$.

Preferred examples of the laser light used in the invention include those emitted from a gas laser (such as $Ar^+$, He—Ne and He—Cd), a YAG laser, a dye laser and a semiconductor laser. A semiconductor laser and a second harmonic generation element may be used. Preferred examples of the laser used are determined by the light absorption peak wavelength of the spectral sensitizing dye of the photothermographic material and include a He—Ne laser emitting red to infrared light, a red semiconductor laser, an $Ar^+$, He—Ne or He—Cd laser emitting blue to green light, and a blue semiconductor laser.

In recent years, a module formed by integrating an SHG (second harmonic generation) element and a semiconductor laser, and a blue semiconductor laser have been developed, and thus a laser output device in a short wavelength range is receiving attention. The blue semiconductor laser is expected to show increasing demand since it can attain high-definition image recordation, increased recording density, and stable output with prolonged service life. The peak wavelength of the laser light is generally from 300 to 500 nm for blue color, preferably from 400 to 500 nm, and is generally from 600 to 900 nm for red to near infrared region, and preferably from 620 to 850 nm.

Laser light that exhibits vertical multiple vibration by high frequency convolution can be preferably used.

3-2. Thermal Development

The photothermographic material of the invention may be developed by any method, and in general, the photothermographic material having been imagewise exposed is developed by increasing the temperature. The development temperature is preferably from 80 to 250° C., and more preferably from 100 to 140° C.

The development time is preferably from 1 to 60 seconds, more preferably from 5 to 30 seconds, and particularly preferably from 5 to 20 seconds.

The method for thermal development is preferably a plate heater system. As the thermal development method using a plate heater system, a method described in JP-A No. 11-133572 is preferred, which is a thermal development device for obtaining a visible image by contacting a photothermographic material having a latent image formed thereon with a heating means at a thermal development part. In the thermal development device, the heating means contains a plate heater and plural holding rollers disposed opposed to and along one surface of the plate heater, and the photothermographic material is passed between the holding rollers and the plate heater to effect thermal development. It is preferred that the plate heater is divided into two to six stages, and the temperature of the top end thereof is decreased by 1 to 10° C.

The aforementioned method is also described in JP-A No. 54-30032, by which water and an organic solvent contained in the photothermographic material can be removed to the exterior of the system, and change of the shape of the support due to rapid heating of the photothermographic material can be suppressed.

3-3. System

Examples of a medical laser imager equipped with the exposure part and the thermal development part include FUJI MEDICAL DRY IMAGER FM-DPL, produced by Fuji Photo Film Co., Ltd. The system is described in Fuji Medical Review, No. 8, p. 39 to 55, and techniques described therein can be utilized. The photothermographic material of the invention can be used as a photothermographic material for a laser imager involved in AD NETWORK, which is proposed by Fuji Medical Co., Ltd. as a network system adapted to the DICOM standard.

4. Purpose of Invention

The photothermographic material using a high silver iodide photographic emulsion of the invention forms a monochrome image with a silver image, and is preferably used as a photothermographic material for medical diagnosis, a photothermographic material for industrial photography, a photothermographic material for printing, and a photothermographic material for COM.

EXAMPLES

The invention will be described in more detail with reference to the following examples, but the invention is not construed as being limited thereto.

Example 1

1-1. Production of PET Support

PET having an intrinsic viscosity of 0.66 (measured in phenol/tetrachloroethane=6/4 (weight ratio) at 25° C.) was obtained by using terephthalic acid and ethylene glycol according to an ordinary method. The resulting PET was pelletized and dried at 130° C. for 4 hours, and after melting, it was then extruded from a T-die at 300° C. to produce a non-stretched film having such a thickness that provided a thickness of 175 μm after thermal fixation.

The film was stretched in the machine direction by 3.3 times by using rolls having different peripheral velocities, and then stretched in the transversal direction by 4.5 times by using a tenter. The temperatures upon stretching were 110° C. and 130° C., respectively. Thereafter, the film was thermally fixed at 240° C. for 20 seconds and then relaxed at the same temperature by 4% in the transversal direction.

The parts chacked by the tenter were slit, and the both ends thereof were knurled, followed by winding at 4 kg/cm$^2$, to obtain a roll of a film having a thickness of 175 μm.

(Surface Corona Discharge Treatment)

Both surfaces of the support was treated by using a solid state corona discharge treating device 6 kVA Model, produced by Pillat Technologies, Inc., at 20 m/min. It was found from the read values of electric current and voltage that a treatment of 0.375 kV·A·min/m$^2$ was applied to the support. The treatment frequency was 9.6 kHz, and the gap clearance between the electrode and the dielectric material roll was 1.6 mm 1-2. Production of Undercoated Support

| (1) Production of Undercoating Composition | |
|---|---|
| Formulation (1) (undercoating on image forming layer side) | |
| PESRESIN A-520 (30% by mass solution, produced by Takamatsu Oil & Fat Co., Ltd.) | 59 g |
| Polyethylene glycol monononylphenyl ether (average number of ethylene oxide units: 8.5, 10% by mass solution) | 5.4 g |
| MP-1000 (polymer fine particles, average particle diameter: 0.4 μm, produced by Soken Chemical Co., Ltd.) | 0.91 g |
| Distilled water | 935 mL |
| Formulation (2) (first layer on back surface) | |
| Styrene-butadiene copolymer latex (solid content: 40% by mass, styrene/butadiene weight ratio: 68/32) | 158 g |
| 2,4-Dichloro-6-hydroxy-S-triazine sodium salt 8% by mass aqueous solution | 20 g |
| Sodium laurylbenzenesulfonate 1% by mass aqueous solution | 10 mL |
| Distilled water | 854 mL |
| Formulation (3) (second layer on back surface) | |
| $SnO_2$/SbO (9/1 by weight, average particle diameter: 0.038 μm, 17% by mass dispersion) | 84 g |
| Gelatin (10% by mass aqueous solution) | 89.2 g |
| METLOSE TC-5 (2% by weight aqueous solution, produced by Shin-Etsu Chemical Co., Ltd.) | 8.6 g |
| MP-1000 (produced by Soken Chemical Co., Ltd.) | 0.01 g |
| Sodium dodecylbenzenesulfonate 1% by mass aqueous solution | 10 mL |
| NaOH (1% by mass) | 6 mL |
| PROXEL (produced by ICI Japan Ltd.) | 1 mL |
| Distilled water | 805 mL |

The formulation (1) of the coating composition for an undercoating layer was coated on both surfaces of the biaxially stretched polyethylene terephthalate support with a thickness of 175 μm having been subjected to the corona discharge treatment with a wire bar to a wet coated amount of 6.6 mL/m$^2$ (per one surface) and dried at 180° C. for 5 minutes. The formulation (2) of the coating composition for an undercoating layer was coated on the back surface with a wire bar to a wet coated amount of 5.7 mL/m$^2$ and dried at 180° C. for 5 minutes. The formulation (3) of the coating composition for an undercoating layer was further coated on the back surface with a wire bar to a wet coated amount of 7.7 mL/m$^2$ and dried at 180° C. for 6 minutes, so as to produced an undercoated support.

(Preparation of Coating Compositions on Back Surface)

Preparation of Coating Composition for Anti-halation Layer 60 g of gelatin, 24.5 g of polyacrylamide, 2.2 g of 1 mole/L sodium hydroxide solution, 2.4 g of mono-dispersion polymethyl methacrylate fine particles (average particle diameter: 8 μm, standard deviation of particle diameter: 0.4), 0.08 g of benzoisothiazoline, 0.3 g of sodium polystyrenesulfonate, 0.21 g of blue dye compound 1, 6.8 g of UV absorbent 1, and 8.3 g of an acrylic acid/ethyl acrylate copolymer latex (copolymerization ratio: 5/95) were mixed, and water was added thereto to make 818 mL in total, so as to prepare a coating composition for an anti-halation layer.

Preparation of Coating Composition for Back Surface Protective Layer

In a vessel maintained at 40° C., 40 g of gelatin, 1.5 g in terms of liquid paraffin of an emulsion of liquid paraffin, 35 mg of benzoisothiazoline, 6.8 g of 1 mol/L sodium hydroxide solution, 0.5 g of sodium t-octylphenoxyethoxyethanesulfonate, 0.27 g of sodium polystyrenesulfonate, 5.4 mL of fluorine surface active agent (F-1) 2% by mass aqueous solution, 6.0 g of an acrylic acid/ethyl acrylate copolymer latex (copolyermization ratio: 5/95), and 2.0 g of N,N-ethylenebis(vinylsulfonacetamide) were mixed, and water was added thereto to make 1,000 mL in total, so as to prepare a coating composition for a back surface protective layer.

1-3. Image Forming Layer, Intermediate Layer, and Surface Protective Layer 1-3-1. Preparation of Materials for Coating (1) Preparation of Silver Halide Emulsions (Preparation of Silver Halide Emulsion 1)

4.3 mL of a 1% by mass potassium iodide solution was added to 1,420 mL of distilled water, and 3.5 mL of sulfuric acid having a concentration of 0.5 mole/L and 36.7 g of phthalated gelatin were added thereto to form a solution. The solution was maintained to a solution temperature of 42° C. under stirring in a stainless steel reaction vessel, and solution A formed by diluting 22.22 g of silver nitrate with distilled water to make 195.6 mL and solution B formed by diluting 21.8 g of potassium iodide with distilled water to make 218 mL were entirely added thereto at constant flow rates over 9 minutes. Thereafter, 10 mL of a 3.5% by mass hydrogen peroxide aqueous solution was added thereto, and further, 10.8 mL of a 10% by mass benzimidazole aqueous solution was added thereto.

Solution C formed by diluting 51.86 g of silver nitrate with distilled water to make 317.5 mL and solution D formed by diluting 60 g of potassium iodide with distilled water to make 600 mL were prepared. The solution C was entirely added at a constant flow rate over 120 minutes, and the solution D was added by a controlled double jet method with pAg maintained at 8.1. $1\times10^{-4}$ mole per 1 mole of silver of potassium iridate(III) hexachloride was entirely added after 10 minutes from the start of the addition of the solution C and the solution D. After 5 seconds from the completion of the addition of the solution C, $3\times10^{-4}$ mole per 1 mole of silver of a potassium iron(II) hexacyanide aqueous solution was entirely added. The pH was adjusted to 3.8 by using sulfuric acid having a concentration of 0.5 mole/L, and after stopping stirring, sedimentation, desalting and water washing steps were carried out. The pH was adjusted to 5.9 by using a sodium hydroxide solution having a concentration of 1 mole/L to produce a silver halide dispersion having pAg of 8.0.

The silver halide dispersion thus prepared was maintained at 38° C. under stirring, and 5 mL of a 0.34% by mass methanol solution of 1,2-benzoisothiazolin-3-one was added, followed by increasing the temperature to 47° C.

After 20 minutes from the temperature increase, $7.6\times10^{-5}$ mole per 1 mole of silver of sodium benzenethiosulfonate was added in the form of a methanol solution, and after 5 minutes, $2.9\times10^{-4}$ mole per 1 mole of silver of a tellurium sensitizing agent C was added in the form of a methanol solution, followed by ripening for 91 minutes.

1.3 mL of a 0.8% by mass methanol solution of N,N'-dihydroxy-N''-diethylmelamine was added, and after 4 minutes, $4.8\times10^{-3}$ mole per 1 mole of silver of 5-methyl-2-mercaptobenzimidazole in the form of a methanol solution and $5.4\times10^{-3}$ mole per 1 mole of silver of 1-phenyl-2-heptyl-5-mercapto-1,3,4-triazole in the form of a methanol solution were added to produce silver halide emulsion 1.

The particles of the silver halide emulsion thus prepared were pure silver iodide particles having an average sphere-equivalent diameter of 0.040 μm and a variation coefficient of a sphere-equivalent diameter of 18%. The particles were tetradecahedral particles having (001), {100} and {101} planes and had a proportion of the y-phase of 30% as measured by X-ray powder diffraction analysis. The particle size and the like were measured as an average of 1,000 particles by using an electron microscope.

(Preparation of Silver Halide Emulsion 2)

Silver halide emulsion 2 was produced in the same manner as in the silver halide emulsion 1 except that the temperature of the reaction solution was changed to 65° C., 5 mL of a 5% by mass methanol solution of 2,2'-(ethylenedithio)diethanol was added after the addition of the solutions A and B, the solution D was added by a controlled double jet method with pAg maintained at 10.5, and upon chemical sensitization, $5\times10^{-4}$ mole per 1 mole of silver of bromoauric acid and $2\times10^{-3}$ mole per 1 mole of silver of potassium thiocyanate were added after 3 minutes from the addition of the tellurium sensitizing agent C.

The particles of the silver halide emulsion thus prepared were pure silver iodide tabular particles having an average circle-equivalent diameter of projected area of 0.164 μm, a particle thickness of 0.032 μm, an average aspect ratio of 5, and an average sphere-equivalent diameter of 0.11 μm and a variation coefficient of a sphere-equivalent diameter of 23%. The particles had a proportion of the γ-phase of 80% as measured by X-ray powder diffraction analysis. The particle size and the like were measured as an average of 1,000 particles by using an electron microscope.

(Preparation of Silver Halide Emulsion 3)

Silver halide emulsion 3 was produced in the same manner as in the silver halide emulsion 1 except that the temperature of the reaction solution was changed to 27° C., and the solution D was added by a controlled double jet method with pAg maintained at 10.2.

The particles of the silver halide emulsion thus prepared were pure silver iodide particles having an average sphere-equivalent diameter of 0.022 μm and a variation coefficient of a sphere-equivalent diameter of 17%. The particles were dodecahedral particles having (001), {1(−1)0} and {101} planes and were formed silver iodide substantially with the β-phase as measured by X-ray powder diffraction analysis. The particle size and the like were measured as an average of 1,000 particles by using an electron microscope.

(Preparation of Mixed Emulsion A for Coating Composition)

The silver halide emulsion 1, the silver halide emulsion 2 and the silver halide emulsion 3 were mixed at a ratio of 5/2/3 as a silver ratio, to which a 1% by mass benzotiazolium iodide aqueous solution was added in an amount of $7\times10^{-3}$ mole per 1 mole of silver. Water was added thereto to make a silver halide content in terms of silver of 38.2 g per 1 kg of the mixed emulsion for a coating composition, and 1-(3-methylureidophenyl)-5-mercaptotetrazole was added in an amount of 0.34 g per 1 kg of the mixed emulsion for a coating composition.

Furthermore, $2\times10^{-3}$ mole per 1 mole of silver of each of compounds 2, 20 and 26 were added as a compound forming a one-electron oxidant by one-electron oxidation capable of releasing one or more electron.

Moreover, $8\times10^{-3}$ mole per 1 mole of silver halide of each of compounds (19), (49) and (71) were added as a compound having an adsorbing group and a reductive group.

(2) Preparation of Fatty Acid Silver Salt Dispersion (Preparation of Recrystallized Behenic Acid)

100 kg of behenic acid (EDENOR C22-85R, a trade name, produced by Henkel, Inc.) was mixed with 1,200 kg of isopropyl alcohol and dissolved therein at 50° C. After filtering, the resulting solution with a filter having a pore size of 10 μm, the solution was cooled to 30° C. to attain recrystallization. The cooling rate upon recrystallization was controlled to 3° C. per hour. The resulting crystals were subjected to centrifugal filtration washed by pouring 100 kg of isopropyl alcohol and then dried. The resulting crystals were esterified and measured with GC-FID, and as a result, the behenic acid content was 96% by mole, with 2% by mole of lignoceric acid, 2% by mole of arachidinic acid and 0.001% by mole of erucic acid being contained.

(Preparation of Aliphatic Acid Silver Salt Dispersion)

88 kg of the recrystallized behenic acid, 422 L of distilled water, 49.2 L of a 5 mole/L sodium hydroxide aqueous solution and 120 L of t-butyl alcohol were mixed and reacted by stirring at 75° C. for 1 hour to obtain sodium behenate solution B. Separately, 206.2 L of an aqueous solution of 40.4 kg of silver nitrate (pH 4.0) was prepared and maintained at 10° C. A reaction vessel charged with 635 L of distilled water and 30 L of t-butyl alcohol was maintained at 30° C., and the sodium behenate solution and the silver nitrate aqueous solution were entirely added thereto under sufficiently stirring at constant flow rates over 93 minutes and 15 seconds and 90 minutes, respectively. At this time, only the silver nitrate aqueous solution was added in the duration for 11 minutes after starting the addition of the silver nitrate aqueous solution. Thereafter, the addition of the sodium behenate solution was started, and only the sodium behenate solution was added in the duration for 14 minutes and 15 seconds after completing the addition of the silver nitrate aqueous solution. The temperature inside the reaction vessel at this time was 30° C., and the outer temperature was controlled to maintain the liquid temperature constant. The piping of the addition system for the sodium behenate solution was kept temperature by circulating warm water in the outer space of the double pipe, so as to adjust the liquid temperature at the outlet of the addition nozzle to 75° C. The piping of the addition system for the silver nitrate aqueous solution was kept temperature by circulating cold water in the outer space of the double pipe. The addition position of the sodium behenate solution and the addition position of the sodium nitrate aqueous solution were symmetrically disposed with respect to the stirring axis, and were prevented from being in contact with the reaction solution by adjusting the heights thereof.

After completing the addition of the sodium behenate solution, the reaction solution was allowed to stand for 20 minutes at that temperature under stirring, and then the temperature was increased to 35° C. over 30 minutes, followed by ripening for 210 minutes. Immediately after completing the ripening, a solid content was filtered by centrifugal separation and was washed with water until the electroconductivity of the filtrate reached 30 μS/cm. Thus, an aliphatic acid silver salt was obtained. The resulting solid content was not dried but was stored as a wet cake.

The shape of the resulting silver behenate particles was evaluated with an electron microscope, and as a result, the particles were crystals having a =0.21 μm, b=0.4 μm, c=0.4 μm, an average aspect ratio of 2.1, and a variation coefficient of a sphere-equivalent diameter of 11% (wherein a, b and c have been defined in the foregoing description).

19.3 kg of polyvinyl alcohol (PVA-217, a trade name) and water were added to 260 kg in dry weight of the wet cake to make 1,000 kg in total, and the mixture was formed into a slurry with dissolver blades and was then preliminarily dispersed with a pipeline mixer (Model PM-10, produced by Mizuho Industry, Co., Ltd.).

The stock dispersion thus preliminarily dispersed was treated three times by using a dispersing machine (MICROFLUIDIZER M-61, a trade name, produced by Microfluidex International Corp., using a Z-type interaction chamber) adjusted to a pressure of 1,150 kg/cm$^2$ to obtain a silver behenate dispersion. The cooling operation was carried out by attaching coiled heat exchangers before and after the interaction chamber to adjust the temperature of the cold medium, whereby the dispersion temperature was adjusted to 18° C.

(3) Preparation of Reducing Agent Dispersion (Preparation of Reducing Agent Dispersion 1)

10 kg of water was added to 10 kg of reducing agent 1 (2,2'-methylenebis(4-ethyl-6-tert-butylphenol)) and 16 kg of a 10% by mass modified polyvinyl alcohol (Poval MP203, produced by Kuraray Co., Ltd.) aqueous solution, and well mixed to form a slurry. The resulting slurry was delivered with a diaphragm pump and dispersed with a transverse sand mill (UVM-2, produced by Imex Co., Ltd.) charged with zirconia beads having an average particle diameter of 0.5 mm for 3 hours, and 0.2 g of banzoisothiazolinone sodium salt and water were added to make the concentration of the reducing agent being 25% by mass. The resulting dispersion was heat-treated at 60° C. for 5 hours to obtain a reducing agent dispersion 1. The reducing agent particles contained in the reducing agent dispersion had a median diameter of 0.40 μm and a maximum particle diameter of 1.4 μm or less. The resulting reducing agent dispersion was filtrated with a polypropylene filter having a pore size of 3.0 μm to remove foreign matters, such as dusts, and then housed.

(Preparation of Reducing Agent Dispersion 2)

10 kg of water was added to 10 kg of reducing agent 2 (6,6'-di-t-butyl-4,4'-dimethyl-2,2'-butylidenediphenol) and 16 kg of a 10% by mass modified polyvinyl alcohol (Poval MP203, produced by Kuraray Co., Ltd.) aqueous solution, and well mixed to form a slurry. The resulting slurry was delivered with a diaphragm pump and dispersed with a transverse sand mill (UVM-2, produced by Imex Co., Ltd.) charged with zirconia beads having an average particle diameter of 0.5 mm for 3 hours and 30 minutes, and 0.2 g of banzoisothiazolinone sodium salt and water were added to make the concentration of the reducing agent being 25% by mass. The resulting dispersion was heated at 40° C. for 1 hour and further heated at 80° C. for 1 hour to obtain a reducing agent dispersion 2. The reducing agent particles contained in the reducing agent dispersion had a median diameter of 0.50 μm and a maximum particle diameter of 1.6 μm or less. The resulting reducing agent dispersion was filtrated with a polypropylene filter having a pore size of 3.0 μm to remove foreign matters, such as dusts, and then housed.

(4) Preparation of Hydrogen Bonding Compound Dispersion (Preparation of Hydrogen Bonding Compound 1)

10 kg of water was added to 10 kg of hydrogen bonding compound 1 (tri(4-t-butylphenyl)phosphineoxide) and 16 kg of a 10% by mass modified polyvinyl alcohol (Poval MP203, produced by Kuraray Co., Ltd.) aqueous solution, and well mixed to form a slurry. The resulting slurry was delivered with a diaphragm pump and dispersed with a transverse sand mill (UVM-2, produced by Imex Co., Ltd.) charged with zirconia beads having an average particle diameter of 0.5 mm for 4 hours, and 0.2 g of banzoisothiazolinone sodium salt and water were added to make the concentration of the hydrogen bonding compound being 25% by mass. The resulting dispersion was heated at 40° C. for 1 hour and further heated at 80° C. for 1 hour to obtain a hydrogen bonding compound dispersion 1. The hydrogen bonding compound particles contained in the hydrogen bonding compound dispersion had a median diameter of 0.45 μm and a maximum particle diameter of 1.3 μm or less. The resulting hydrogen bonding compound dispersion was filtrated with a polypropylene filter having a pore size of 3.0 μm to remove foreign matters, such as dusts, and then housed.

(5) Preparation of Development Accelerator Dispersion and Color Toning Agent Dispersion (Preparation of Development Accelerator Dispersion 1)

10 kg of water was added to 10 kg of development accelerator 1 and 20 kg of a 10% by mass modified polyvinyl alcohol (Poval MP203, produced by Kuraray Co., Ltd.) aqueous solution, and well mixed to form a slurry. The resulting slurry was delivered with a diaphragm pump and dispersed with a transverse sand mill (UVM-2, produced by Imex Co., Ltd.) charged with zirconia beads having an average particle diameter of 0.5 mm for 3 hours and 30 minutes, and 0.2 g of banzoisothiazolinone sodium salt and water were added to make the concentration of the development accelerator being 20% by mass to obtain a development accelerator dispersion 1. The development accelerator particles contained in the development accelerator dispersion had a median diameter of 0.48 μm and a maximum particle diameter of 1.4 μm or less. The resulting development accelerator dispersion was filtrated with a polypropylene filter having a pore size of 3.0 μm to remove foreign matters, such as dusts, and then housed.

Solid dispersions of development accelerator 2 and color toning agent 1 were dispersed in the same manner as the development accelerator 1 to obtain dispersions of 20% by mass and 15% by mass, respectively.

(6) Preparation of Polyhalogenide Compound Dispersion (Preparation of Organic Polyhalogenide Compound Dispersion 1)

10 kg of organic polyhalogenide compound 1 (tribromomethanesulfonylbenzene), 10 kg of a 20% by mass modified polyvinyl alcohol (Poval MP203, produced by Kuraray Co., Ltd.) aqueous solution, 0.4 kg of a 20% by mass sodium triisopropylnaphthalenesulfonate aqueous solution and 14 kg of water were well mixed to form a slurry.

The resulting slurry was delivered with a diaphragm pump and dispersed with a transverse sand mill (UVM-2, produced by Imex Co., Ltd.) charged with zirconia beads having an average particle diameter of 0.5 mm for 5 hours, and 0.2 g of banzoisothiazolinone sodium salt and water were added to make the concentration of the organic polyhalogenide compound being 30% by mass to obtain an organic polyhalogenide compound dispersion 1. The organic polyhalogenide compound particles contained in the organic polyhalogenide compound dispersion had a median diameter of 0.41 μm and a maximum particle diameter of 2.0 μm or less. The resulting organic polyhalogenide compound dispersion was filtrated with a polypropylene filter having a pore size of 10.0 μm to remove foreign matters, such as dusts, and then housed.

(Preparation of Organic Polyhalogenide Compound Dispersion 2)

10 kg of organic polyhalogenide compound 2 (N-butyl-3-tribromomethanesulfonylbenzamide), 20 kg of a 10% by mass modified polyvinyl alcohol (Poval MP203, produced by Kuraray Co., Ltd.) aqueous solution and 0.4 kg of a 20% by mass sodium triisopropylnaphthalenesulfonate aqueous solution were well mixed to form a slurry. The resulting slurry was delivered with a diaphragm pump and dispersed with a transverse sand mill (UVM-2, produced by Imex Co., Ltd.) charged with zirconia beads having an average particle diameter of 0.5 mm for 5 hours, and 0.2 g of banzoisothiazolinone sodium salt and water were added to make the concentration of the organic polyhalogenide compound being 30% by mass. The resulting dispersion was heated at 40° C. for 5 hours to obtain an organic polyhalogenide compound dispersion 2. The organic polyhalogenide compound particles contained in the organic polyhalogenide compound dispersion had a median diameter of 0.40 μm and a maximum particle diameter of 1.3 μm or less. The resulting organic polyhalogenide compound dispersion was filtrated with a polypropylene filter having a pore size of 3.0 μm to remove foreign matters, such as dusts, and then housed.

(7) Preparation of Phthalazine Compound Solution (Preparation of Phthalazine Compound Solution 1)

8 kg of a modified polyvinyl alcohol (Poval MP203, produced by Kuraray Co., Ltd.) was dissolved in 174.57 kg of water, and 3.15 kg of a 20% by mass sodium triisopropylnaphthalenesulfonate aqueous solution and 14.28 g of a 70% by mass phthalazine compound 1 (6-isopropylphthalazine) aqueous solution were added thereto to prepare a 5% by mass phthalazine compound solution 1.

(8) Preparation of Mercapto Compound Aqueous Solution (Preparation of Mercapto Compound Aqueous Solution 1)

7 g of mercapto compound 1 (1-(3-sulfophenyl)-5-mercaptotetrazole sodium salt) was dissolved in 993 g of water to prepare a 0.7% by mass aqueous solution.

(Preparation of Mercapto Compound Aqueous Solution 2)

20 g of mercapto compound 1 (1-(3-methylureidophenyl)-5-mercaptotetrazole) was dissolved in 980 g of water to prepare a 2.0% by mass aqueous solution.

(9) Preparation of Pigment Dispersion 1

250 g of water was added to 64 g of C.I. Pigment Blue 60 and 6.4 g of DEMOL N, produced by Kao Corp. and well mixed to prepare a slurry. 800 g of zirconia beads having an average particle diameter of 0.5 mm were prepared and charged in a vessel along with the slurry, and they were dispersed with a dispersing device (1/4G sand grinder mill, produced by Imex Co., Ltd.) for 25 hours, to which water was added to make the concentration of the pigment being 5% by mass, so as to prepare pigment dispersion 1. The pigment particles contained in the pigment dispersion had an average particle diameter of 0.21 μm.

(10) Preparation of SBR Latex Dispersion

An SBR latex was prepared in the following manner.

287 g of distilled water, 7.73 g of a surface active agent (PIONIN A-43-S, produced by Takemoto Oil and Fat Co., Ltd.), 14.06 mL of a 1 mole/L sodium hydroxide solution, 0.15 g of tetrasodium ethylenediamine tetraacetate, 255 g of styrene, 11.25 g of acrylic acid and 3.0 g of tert-dodecylmercaptane were charged in a gas monomer reaction device (TAS-2J, produced by Taiatsu Techno Corp.), after sealing the reaction vessel, the mixture was stirred at a stirring rate of 200 rpm. After repeating deaeration with a vacuum pump and replacement with nitrogen gas several times, 108.75 g of 1,3-butadiene was pressed therein, and the internal temperature was increased to 60° C. A solution formed by dissolving 1.875 g of ammonium persulfate in 50 mL water was added thereto, followed by stirring for 5 hours. After increasing the temperature to 90° C., the mixture was further stirred for 3 hours. After completing the reaction, the internal temperature was decreased to room temperature, and the ratio of $Na^+$ ion/$NH_4^+$ ion is adjusted to 1/5.3 (by mole) by adding a 1 mole/L sodium hydroxide solution and $NH_4OH$, followed by adjusting the pH to 8.4. Thereafter, the resulting latex was filtrated with a polypropylene filter having a pore size of 1.0 μm to remove foreign matters, such as dusts, and then housed to obtain 774.7 g of an SBR latex. The measurement of halogen ion by ion chromatography revealed that the chloride ion concentration was 3 ppm. The measurement of the concentration of the chelating agent by high-speed liquid chromatography revealed that it was 145 ppm.

The latex had an average particle diameter of 90 nm, a glass transition temperature Tg of 17° C., a solid concentration of 44% by mass, an equilibrium water content at 25° C. 60% RH of 0.6% by mass, an ionic electroconductivity of 4.80 mS/cm (the ionic electroconductivity of the latex stock dispersion (44% by mass) was measured with an electroconduction meter, CM-30S, produced by To a Dempa Kogyo Co., Ltd. at 25° C.) and pH 8.4.

Other SBR latexes having different glass transition temperatures Tg were prepared in the same manner except that the ratio of styrene and butadiene was appropriately changed.

1-3-2. Preparation of Coating Composition (1) Preparation of Coating Composition for Image Forming Layer 1

To 1,000 g of the fatty acid silver salt dispersion obtained in the foregoing and 276 mL of water, the pigment dispersion 1, the organic polyhalogenide compound dispersion 1, the organic polyhalogenide compound dispersion 2, the phthalazine compound solution 1, the SBR latex (Tg: 17° C.) dispersion, the reducing agent dispersion 1, the reducing agent dispersion 2, the hydrogen bonding compound dispersion 1, the development accelerator dispersion 1, the development accelerator dispersion 2, the color toning agent dispersion 1, the mercapto compound dispersion 1 and the mercapto compound dispersion 2 were sequentially added. The silver halide mixed emulsion A was added thereto immediately before coating, and the mixture was well mixed to form a coating composition for an image forming layer, which was directly delivered to a coating die for coating.

The viscosity of the coating composition for an image forming layer measured with a B-type viscometer, produced by Tokyo Keiki Co., Ltd., with No. 1 rotor at 60 rpm, was 25 mPa·s at 40° C.

The viscosity of the coating composition measured with RFS FLUID SPECTROMETER, produced by Rheometrix Far East, Inc. at 25° C. was 242, 65, 48, 26 and 20 mPa·s at shearing rates of 0.1, 1, 10, 100 and 1,000 $S^{-1}$, respectively.

The amount of zirconium in the coating composition was 0.52 mg per 1 g of silver.

(2) Preparation of Coating Composition for Intermediate Layer on Image Forming Layer Side To 1,000 g of polyvinyl alcohol PVA-205, produced by Kuraray Co., Ltd., 272 g of the pigment dispersion 1 and 4,200 mL of a 19% by mass methyl methacrylate/styrene/butyl acrylate/hydroxyethyl methacrylate/acrylic acid copolymer (copolymerization ratio: 64/9/20/5/2) latex solution, 27 mL of a 5% by mass AEROSOL OT (produced by American Cyanamid Company) aqueous solution, 135 mL of a 20% by mass diammonium phthalate aqueous solution and water were added to make 10,000 g in total, and the pH was adjusted with sodium hydroxide to 7.5 to prepare a coating composition for an intermediate layer, which was then delivered to a coating die to a coated amount of 9.1 mL/$m^2$.

The viscosity of the coating composition measured with a B-type viscometer, with No. 1 rotor at 60 rpm, was 58 mPa·s at 40° C.

(3) Preparation of Coating Composition for Layer adjacent to Outermost Layer 64 g of inert gelatin was dissolved in water, to which 112 g of a 19% by mass methyl methacrylate/styrene/butyl acrylate/hydroxyethyl methacrylate/acrylic acid copolymer (copolymerization ratio: 64/9/20/5/2) latex solution, 30 mL of a 15% by mass phthalic acid methanol solution, 23 mL of a 10% by mass 4-methylphthalic acid aqueous solution, 28 mL of sulfuric acid having a concentration of 0.5 mole/L, 5 mL of a 5% by mass AEROSOL OT (produced by American Cyanamid Company) aqueous solution, 0.5 of phenoxyethanol and 0.1 g of benzoisothiazoline were added, and water was further added to make 750 g in total to form a coating composition. 26 mL of a 4% by mass chrome alum solution was mixed thereto immediately before coating with a static mixer, and the coating composition was delivered to a coating die to a coated amount of 18.6 mL/$m^2$.

The viscosity of the coating composition measured with a B-type viscometer, with No. 1 rotor at 60 rpm, was 20 mPa·s at 40° C.

(4) Preparation of Coating Composition for Outermost Layer (Preparation of Coating Composition for Outermost Layer 1)

100 g of inert gelatin and 10 mg of benzoisothiazoline were dissolved in 800 mL of water, to which 180 g of a 19% by mass methyl methacrylate/styrene/butyl acrylate/hydroxyethyl methacrylate/acrylic acid copolymer (copolymerization ratio: 57/8/28/5/2) latex solution, 40 mL of a 15% by mass phthalic acid methanol solution, 5.5 mL of a 1% by mass fluorine surface active agent (F-1) solution, 5.5 mL of a 1% by mass fluorine surface active agent (F-2) solution, 28 mL of a 5% by mass sodium di(2-ethylhexyl) sulfosuccinate solution, 4 g of polymethyl methacrylate fine particles (average particle diameter: 0.7 μm), and 21 g of polymethyl methacrylate fine particles (average particle diameter: 4.5 μm) where mixed to prepare a coating composition for an outermost layer, which was delivered to a coating die to a coated amount of 8.3 mL/$m^2$.

The viscosity of the coating composition measured with a B-type viscometer, with No. 1 rotor at 60 rpm, was 19 mPa·s at 40° C.

(Preparation of Coating Compositions for Outermost Layer 2 to 4)

Coating compositions for an outermost layer 2 to 4 were prepared in the same manner as in the preparation of the coating composition for an outermost layer 1 except that 19% by mass polymer latex solutions shown in Table 1 below were used instead of the inert gelatin.

(Preparation of Coating Compositions for Outermost Layer 5 and 6)

Coating compositions for an outermost layer 5 and 6 were prepared in the same manner as in the preparation of the coating composition for an outermost layer 1 except that water soluble polymers that is not derived from an animal protein shown in Table 1 below were used instead of the inert gelatin.

1-4. Production of Photothermographic Materials 1 to 6

The coating composition for an anti-halation layer and the coating composition for a back surface protective layer were coated on the back surface of the undercoated support to coated amounts of 0.88 g/$m^2$ and 1.2 g/$m^2$, respectively, by simultaneous double-layer coating, and then dried to form a back layer.

As shown in Table 1, an image forming layer, an intermediate layer, a layer adjacent to an outermost layer, and an outermost layer were coated in this order on the surface of the support opposite to the back surface by simultaneous double-layer coating by slide bead coating method to produce a sample of a photothermographic material. At this time, the image forming layer and the intermediate layer were adjusted in temperature to 31° C., the layer adjacent to the outermost layer was adjusted in temperature to 36° C., and the outermost layer was adjusted in temperature to 37° C.

The coated amounts (g/$m^2$) of the compounds in the image forming layer were as follows.

| | |
|---|---|
| Fatty acid silver salt | 5.27 |
| Pigment (C.I. Pigment Blue 60) | 0.036 |
| Polyhalogenide compound 1 | 0.09 |
| Polyhalogenide compound 2 | 0.14 |
| Phthalazine compound 1 | 0.18 |
| SBR latex | 9.43 |
| Reducing agent 1 | 0.55 |
| Reducing agent 2 | 0.22 |
| Hydrogen bonding compound 1 | 0.28 |
| Development accelerator 1 | 0.025 |
| Development accelerator 2 | 0.020 |
| Color toning agent 1 | 0.008 |
| Mercapto compound 1 | 0.002 |
| Mercapto compound 2 | 0.006 |
| Silver halide (as Ag) | 0.046 |

The coating and drying conditions were as follows.

The support was destaticized with an ion stream before coating, and the coating was carried out at 160 m/min. The coating and drying conditions were adjusted within the following ranges depending on the respective samples to select such conditions that provided the most stable surface property.

The distance between the tip of the coating die and the support was from 0.10 to 0.30 mm, and the pressure of the decompression chamber was lower than the atmospheric pressure by 196 to 882 Pa. The support was destaticized with an ion stream before coating. After the coating composition was cooled with air blow at a dry-bulb temperature of from 10 to 20° C. in the subsequent chilling zone, the support was conveyed by a non-contact conveying system and dried with air blow at a dry-bulb temperature of from 23 to 45° C. and a wet-bulb temperature of from 15 to 21° C. in a helical type contactless drying apparatus. After drying, the coated support was adjusted in humidity to 40 to 60% RH at 25° C. and then heated to 70 to 90° C. on the coated film surface. After heating, the coated film surface was cooled to 25° C.

The photothermographic material thus produced had a mat degree in terms of Beck's smoothness of 550 seconds on the image forming layer side and 130 seconds on the back surface. The pH on the film surface on the image forming layer side was 6.0.

The chemical structures of the compounds used in the example of the invention are shown below.

Tellurium sensitizing dye C

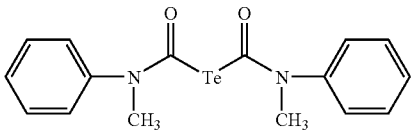

Compound 2 forming one-electron oxidant by one-electron oxidation capable of releasing one or more electron

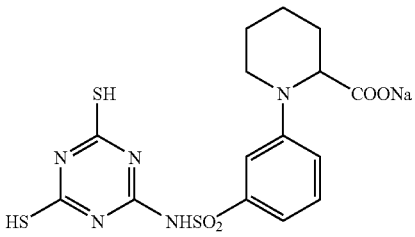

Compound 20 forming one-electron oxidant by one-electron oxidation capable of releasing one or more electron

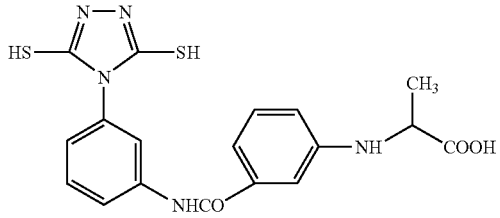

Compound 26 forming one-electron oxidant by one-electron oxidation capable of releasing one or more electron

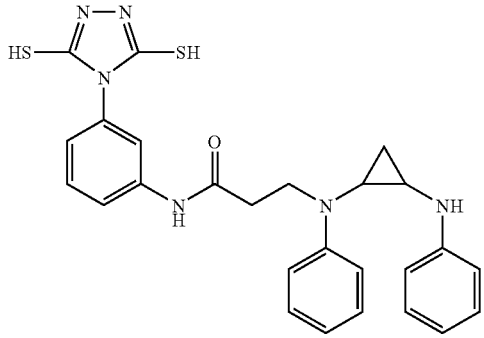

Compound (19) having adsorbing group and reducing group

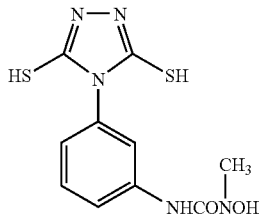

Compound (49) having adsorbing group and reducing group

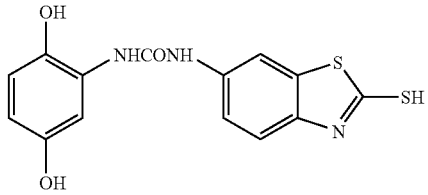

Compound (71) having adsorbing group and reducing group

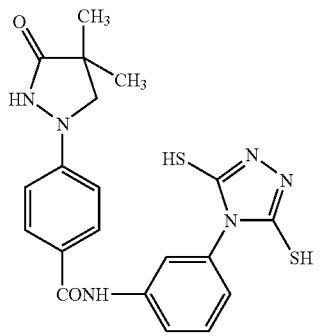

Blue dye compound 1

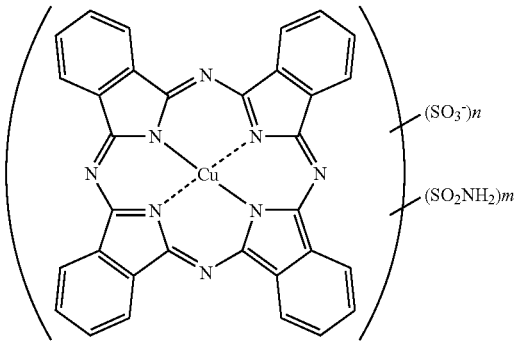

n = 1 ~ 3
m = 1 ~ 3

UV absorbent 1

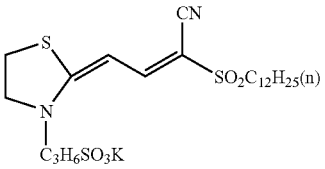

(Development accelerator 1)

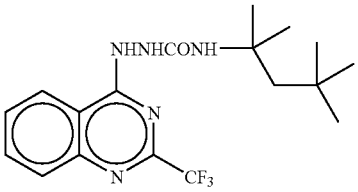

(Development accelerator 2)

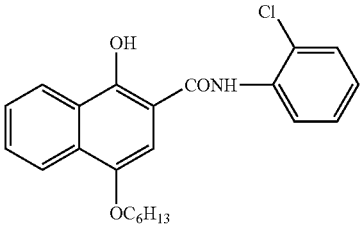

-continued (Color toning agent 1)

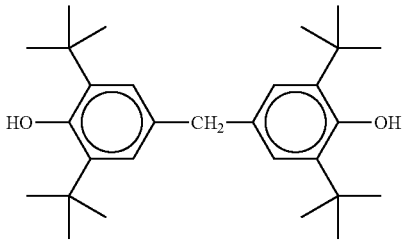

1-5. Evaluation of Photographic Performance

The resulting sample was cut in a size of 14×17-in and packed with a packaging material under conditions of 25° C. and 50% RH. The packed samples were stored at ordinary temperature for 2 weeks, and then subjected to the following evaluation.

(Packaging Material)

The packaging material was a laminated material of PET (10 μm)/PE (12 μm)/aluminum foil (9 μm)/nylon (15 μm)/polyethylene containing 3% by mass of carbon (50 μm) having an oxygen permeability of 0.02 mL/atm·$m^2$·25° C.·day and a water permeability of 0.10 g/atm·$m^2$·25° C.·day.

(Exposure and Development)

A semiconductor laser NLHV3000E, produced by Nichia Corp. was mounted on an exposure part of FUJI MEDICAL DRY IMAGER FM-DP L, and the beam diameter was narrowed down to 100 μm. Exposure for $10^{-6}$ second was carried out by changing the illuminance of laser light on the surface of the photosensitive material within a range of from 1 to 1,000 mW/$mm^2$. The oscillation frequency of the laser light was 405 nm. Thermal development was carried out by setting the four panel heaters at 112° C., 118° C., 120° C. and 120° C., respectively, with an increased conveying velocity to make a total duration of 14 seconds. The resulting image was evaluated with a densitometer. Dmin represents a density on a non-exposed area. The sensitivity and Dmin were expressed by relative values with the values for Sample No. 1 being 100. A smaller value of Dmin means less fogging to provide a good photosensitive material, and a larger sensitivity means high sensitivity to provide a good photosensitive material.

(Evaluation of Image Storage Stability against Stain)

10 g of NaCl was dissolved in 497 mL of water to prepare a salt solution. The samples thus exposed and developed were prepared. The minimum density area of the image was once exposed to a fluorescent lamp and was superimposed on filter paper impregnated with the salt solution, and the assembly was pressed onto a heat plate set at 90° C. for 5 seconds. After removing the filter paper, a ½ part of the sample was irradiated with a fluorescent lamp at 8,500 lux under conditions of 40° C. and 50% RH for 4 hours, and the irradiated part was compared to the remaining ½ part.

The maximum density area of the image was also once exposed to a fluorescent lamp and was superimposed on filter paper impregnated with the salt solution, and the assembly was pressed onto a heat plate set at 90° C. for 5 seconds. After removing the filter paper, a ½ part of the sample was irradiated with a fluorescent lamp at 8,500 lux under conditions of 40° C. and 50% RH for 4 hours, and the irradiated part was compared to the remaining ½ part.

The resulting samples were visually evaluated based on the following standard. The evaluation is made under the forced conditions, and thus the level 2 or better results in no practical problem.

Level 4: No discoloration was found on both the minimum density area and the maximum density area, and no unevenness was found on surface gloss.

Level 3: Slight discoloration was found, and slight unevenness was found on surface gloss.

Level 2: Slight discoloration was found, and unevenness was found on surface gloss.

Level 1: Apparent discoloration was found on both the minimum density area and the maximum density area, and unevenness was found on surface gloss.

(6) Evaluation Result

The results of the evaluation are shown in Table 1 below.

TABLE 1

| Sample No. | Outermost Layer Coating Composition | Outermost Layer Species | Layer Adjacent to Outermost layer | Fogging Dmin | Image Storage Stability | Note |
|---|---|---|---|---|---|---|
| 1 | 1 | gelatin | gelatin | 100 | 1 | Comparison |
| 2 | 2 | latex P-7 | gelatin | 95 | 3 | Invention |
| 3 | 3 | latex P-12 | gelatin | 95 | 3 | Invention |
| 4 | 4 | latex P-14 | gelatin | 95 | 3 | Invention |
| 5 | 5 | PVA-217 | gelatin | 97 | 2 | Invention |
| 6 | 6 | PVA-124 | gelatin | 97 | 2 | Invention |

The samples of the invention suffered less occurrence of fog and were good in image storage stability. In particular, excellent results were obtained in the case where a latex was used as the binder of the outermost layer.

Example 2

(Preparation of Coating Compositions for Layer Adjacent to Outermost Layer 2 and 3)

A coating composition for a layer adjacent to an outermost layer 2 was prepared in the same manner as in the preparation of the coating composition for a layer adjacent to an outermost layer 1 except that polyvinyl alcohol PVA-217 (produced by Kuraray Co., Ltd.) added with κ-carrageenan gelling agent-1 in an amount of 3% by mass based on the PVA was used instead of gelatin.

A coating composition for a layer adjacent to an outermost layer 3 was prepared in the same manner as in the preparation of the coating composition for a layer adjacent to an outermost layer 1 except that a 19% by mass methyl methacrylate/styrene/butyl acrylate/hydroxyethyl methacrylate/acrylic acid copolymer (copolymerization ratio: 57/8/28/5/2) latex aqueous solution added with κ-carrageenan (gelling agent-1) in an amount of 3% by mass based on the latex was used instead of gelatin.

(Production of Sample Nos. 7 and 8)

Sample Nos. 7 and 8 were produced in the same manner as in Sample No. 3 in Example 1 except that the coating composition for a layer adjacent to an outermost layer was changed to those shown in Table 2 below.

(Evaluation)

The samples were evaluated for storage stability of an image in the same manner as in Example 1 and also evaluated for coated surface property. The method for evaluating coated surface property was as follows.

The entire surface of the respective samples were uniformly exposed to provide a density of 1.5 and subjected to thermal development under the same conditions as in the evaluation of the photographic characteristics, and then the number of coating stripes per unit coated width was evaluated. A smaller number of coating stripes means an excellent photothermographic material with excellent coating property.

The evaluation was made based on the following standard.

AA: No stripe was observed.

A: Slight stripe with low density occurred.

B: Slight stripe with high density occurred.

C: Coating stripes occurred on the whole surface.

The results are shown in Table 2.

TABLE 2

| Sample No. | Outermost Layer Coating Composition | Outermost Layer Species | Layer Adjacent to Outermost Layer Coating Composition | Layer Adjacent to Outermost Layer Species | Image Storage Stability | Coated Surface Property | Note |
|---|---|---|---|---|---|---|---|
| 3 | 3 | latex P-12 | 1 | gelatin | 3 | A | Invention |
| 7 | 3 | latex P-12 | 2 | PVA + gelation agent | 3 | A | Invention |
| 8 | 3 | latex P-12 | 3 | latex + gelation agent | 3 | A | Invention |

As shown in Table 2, good coated surface property was obtained in the case where a binder that gels upon decreasing temperature. The storage stability of an image was also good.

Example 3

(Preparation of Mating Agent Dispersion 1)

40 g of polymethyl methacrylate fine particles (average particle diameter: 0.7 μm) was mixed with an aqueous medium formed by previously dissolving 60 g of partially saponified polyvinyl alcohol (PVA-205, produced by Kuraray Co., Ltd.) in 900 g of water in a vessel, and the mixture was agitated with a homogenizer (HIFLEX HOMOGENIZER HF93, produced by SMT Corp.) at a rotation number of 3,000 rpm for 10 minutes to prepare a matting agent dispersion 1.

(Preparation of Mating Agent Dispersion 2)

40 g of polymethyl methacrylate fine particles (average particle diameter: 0.7 μm) was mixed with an aqueous medium formed by previously dissolving 9.6 g of a suface active agent (sodium triisopropylnaphthalensulfonate) in 950.4 g of water in a vessel, and the mixture was agitated with a homogenizer (HIFLEX HOMOGENIZER HF93, produced by SMT Corp.) at a rotation number of 3,000 rpm for 10 minutes to prepare a matting agent dispersion 2.

(Preparation of Mating Agent Dispersion 3)

A matting agent dispersion 3 was prepared in the same manner as in the preparation of the matting agent dispersion 1 except that 9.6 g of a surface active agent (sodium triisopropylnaphthalenesulfonate) was added.

(Preparation of Coating Compositions for Outermost Layer 7 to 9)

Coating compositions for an outermost layer 7 to 9 were prepared in the same manner as in the preparation of the coating composition for an outermost layer 1 except that 100 g of one of the matting agent dispersions 1 to 3 was used instead of the polymethyl methacrylate fine particles (average particle diameter: 0.7 μm).

(Production of Sample Nos. 9 to 11)

Samples Nos. 9 to 11 were produced in the same manner as in the production of Sample No. 3 in Example 1 except that the coating composition for an outermost layer was those shown in Table 3 below.

(Evaluation)

The samples were evaluated for storage stability of an image in the same manner as in Example 1 and also evaluated for coated surface property in the same manner as in Example 3. The results are shown in Table 3 below.

TABLE 3

| | Outermost Layer | | Matting | Layer Adjacent to Outermost Layer | | Image | Coated | |
|---|---|---|---|---|---|---|---|---|
| Sample No. | Coating Composition | Species | Agent Species | Coating composition | Species | Storage Stability | Surface Property | Note |
| 3 | 3 | latex P-12 | PMMA (directly added) | 1 | gelatin | 3 | A | Invention |
| 9 | 7 | latex P-12 | PMMA (dispersed with PVA) | 1 | gelatin | 4 | AA | Invention |
| 10 | 8 | latex P-12 | PMMA (dispersed with surface active agent) | 1 | gelatin | 4 | AA | Invention |
| 11 | 9 | latex P-12 | PMMA (dispersed with PVA and surface active agent) | 1 | gelatin | 4 | AA | Invention |

As shown in Table 3, good coated surface property was obtained in the case where a matting agent dispersion having been dispersed with polyvinyl alcohol and/or a surface active agent was used in the outermost layer. The storage stability of an image was also good.

According to the invention, such a photothermographic material can be provided that suppressed in fogging and printout and is excellent in storage stability of an image against stain.

What is claimed is:

1. A photothermographic material comprising:

a support having thereon an image forming layer containing a photosensitive silver halide, and a non-photosensitive organic silver salt, both of which have been separately prepared, a reducing agent and a binder, and a non-photosensitive outermost layer on a side of the support where the image forming layer is provided, the photosensitive silver halide which has been separately prepared containing silver iodide in an amount of from 40 to 100% by mole, a binder contained in the non-photosensitive—therein; outermost layer containing at least one of a latex polymer and a water soluble polymer that is not derived from an animal protein in an amount of 50% by mass or more based upon the total binder in the non-photosensitive—therein; outermost layer, and a layer adjacent to the non-photosensitive—therein; outermost layer, which contains a binder of a water soluble polymer that is derived from an animal protein in an amount of 50% by mass or more based upon the total binder in the layer adjacent to the non-photosensitive—therein; outermost layer.

2. A photothermographic material as claimed in claim 1 wherein the water soluble polymer that is derived from an animal protein is gelatin.

3. A photothermographic material as claimed in claim 1, wherein one of layers on the side of the support where the non-photosensitive—therein; outermost layer is provided contains a fluorine compound having a fluoroalkyl group having at least 2 carbon atoms and no more than 13 fluorine atoms.

4. A photothermographic material as claimed in claim 1, wherein one of layers on the side of the support where the non-photosensitive—therein; outermost layer is provided contains a fluorine compound having a fluoroalkyl group having at least 2 carbon atoms and no more than 12 fluorine atoms.

5. A photothermographic material as claimed in claim 1 wherein at least one of the non-photosensitive—therein; outermost layer and a layer adjacent to the outermost layer contains a matting agent.

6. A photothermographic material as claimed in claim 5, wherein the matting agent has been dispersed with a surface active agent.

7. A photothermographic material as claimed in claim 5, wherein the matting agent has been dispersed with a water soluble polymer that is not derived from an animal protein.

8. A photothermographic material as claimed in claim 1, wherein the non-photosensitive layer and the image forming layer are formed by simultaneous a multiple layer coating.

9. A photothermographic material comprising:

a support having thereon an image forming layer containing a photosensitive silver halide and a non-photosensitive organic silver salt both of which have been separately prepared, a reducing agent and a binder, and a non-photosensitive outermost layer on a side of the support where the image forming layer is provided, the photosensitive silver halide which has been separately prepared containing silver iodide in an amount of from 40 to 100% by mole, and a binder contained in the non-photosensitive—therein; outermost layer containing at least one of a latex polymer and a water soluble polymer that is not derived from an animal protein in an amount of 50% by mass or more based upon the total binder in the non-photosensitive—therein; outermost layer, and a layer adjacent to the non-photosensitive—therein; outermost layer, which contains a gelation agent and a binder that gels upon decrease in temperature of the binder.

10. A photothermographic material as claimed in claim 9, wherein the gelation agent is at least one selected from the group consisting of agar, κ-carrageenan, ι-carrageenan, alginic acid, an alginate salt, agarose, furcelleran, gellan gum, glucono-δ-lactone, azotobacter vinelandii gum, xanthan gum, pectin, guar gum, locust bean gum, tara gum, cassia gum, glucomannan, tragant gum, karaya gum, pullulan, gum arabic, arabinogalactan, dextran, a carboxymethylcellulose sodium salt, methylcellulose, cyalume seed gum, starch, chitin, chitosan and curdlan.

11. A photothermographic material as claimed in claim 10, wherein the gelation agent is κ-carrageenan.

12. A photothermographic material as claimed in claim 9, wherein a layer adjacent to the non-photosensitive—therein; outermost layer contains a polymer latex.

13. A photothermographic material as claimed in claim 9, wherein a layer adjacent to the non-photosensitive—therein; outermost layer contains a water soluble polymer that is not derived from an animal protein.

14. A photothermographic material as claimed in claim 13, wherein the water soluble polymer that is not derived from an animal protein is polyvinyl alcohol.

15. A photothermographic material as claimed in claim 9, further comprising a gelation accelerator.

16. A photothermographic material as claimed in claim 15, wherein the gelation accelerator is contained in a layer that is not in direct contact with a layer containing the gelation agent.

17. A photothermographic material as claimed in claim 15, wherein the gelation accelerator is at least one selected from the group consisting of salts of potassium, calcium, magnesium, zinc, cobalt and nickel.

* * * * *